United States Patent [19]

Shiba et al.

[11] Patent Number: 5,037,728

[45] Date of Patent: Aug. 6, 1991

[54] PHOTOGRAPHIC MATERIAL PACKAGE UNIT

[75] Inventors: Keisuke Shiba; Noboru Sasaki, both of Kanagawa, Japan

[73] Assignee: Fuji Photo Film Co., Ltd., Kanagawa, Japan

[21] Appl. No.: 241,736

[22] Filed: Sep. 8, 1988

[30] Foreign Application Priority Data

Sep. 11, 1987 [JP] Japan ..... 62-227904

[51] Int. Cl.[5] ..... G03C 1/46

[52] U.S. Cl. ..... 430/505; 430/504; 430/496; 430/567; 354/145.1; 354/149.11; 354/126

[58] Field of Search ..... 430/496, 505, 504, 567; 354/145.1, 149.11, 126

[56] References Cited

U.S. PATENT DOCUMENTS

| | | | |
|---|---|---|---|
| 4,189,222 | 2/1980 | Maitani | 354/126 |
| 4,705,744 | 11/1987 | Sasaki et al. | 430/505 |
| 4,820,624 | 4/1989 | Hasebe et al. | 430/567 |
| 4,830,956 | 5/1989 | Waki | 430/558 |
| 4,849,325 | 7/1989 | Sasaki et al. | 430/505 |

FOREIGN PATENT DOCUMENTS

| | | | |
|---|---|---|---|
| 1032494 | 6/1066 | United Kingdom | 354/145.1 |

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A photographic material package unit composed of a container sealed to ambient light containing a silver halide color light-sensitive film, the container having a shutter means for admitting a predetermined amount of light to the container and a lens for forming an image on the film using the light admitted by the shutter means; the color film being composed of a support having thereon:

(a) at least one blue-sensitive silver halide emulsion layer containing a yellow coupler and having a spectral sensitivity distribution with a maximum spectral sensitivity of from 406 nm to 480 nm, the distribution within 80% of the maximum value being in a range of from 400 nm to 500 nm;

(b) at least one green-sensitive silver halide emulsion layer containing a magenta coupler and having a spectral sensitivity distribution with a maximum spectral sensitivity of from 527 nm to 580 nm, the distribution within 80% of the maximum value being in a range of from 500 nm to 600 nm;

(c) at least one red-sensitive silver halide emulsion layer containing a cyan coupler, and having a spectral sensitivity distribution with a maximum spectral sensitivity of from 595 nm to 640 nm, the distribution within 80% of the maximum value being in a range of from 575 nm to 650 nm; and (d) at least one protective layer. The photographic material packaging unit of the invention provides even exposure and excellent color reproduction for indoor and outdoor light, independent of the quality or intensity of the light source.

9 Claims, 9 Drawing Sheets

PHOTOGRAPHIC MATERIAL PACKAGE UNIT

FIELD OF THE INVENTION

The present invention relates to photographic material package units which may be handled easily and simply, which are compact and which have a lens and shutter with a fixed shutter speed, especially those providing improved color reproducibility, and specifically those which provide auxiliary lighting by a flash emission based on a synchro-signal which provide improved color reproducibility.

BACKGROUND OF THE INVENTION

Photographic material package units having a lens and shutter, or "film-with-lens" units have heretofore been commercially sold by Fuji Photo Film Co. (Japan) under the trade names of "Utsurundesu", "Utsurundesu-Hi" or "Quick-snap". Most users consider that film-with-lens units are photographic materials and strongly require that the films used have improved image sharpness and graininess and smooth film runnability because of the high quality brand image of the films. For instance, Kokai Giho No. 86-11650 mentions a method for improving the quality of the film-with-lens.

The films used could have a photographic sensitivity of from ISO 100 to ISO 3200. However, in the case of a fixed shutter speed system where the photographically possible shutter level has been fixed, the films cannot sufficiently photographically record various objects in various and different lights or illuminations, and therefore the films are often lacking in exposure latitude. As mentioned in Kokai Giho No. 86-11650, a functional filter, for example a photochromic filter or an electrochromic filter, may be used. However, since filters of this kind are used to substantially lower the photographic sensitivity of the film, these are disadvantageous for the graininess and sharpness of the film.

In addition, the films used are exposed at the same shutter speed and the same aperture irrespective of outdoor and indoor subjects and also irrespective of day and night, and by illumination of natural light, an incandescent lamp, a fluorescent lamp or a flash. Under the situation, therefore, the conventional films used are not only lacking in exposure latitude but also would form extremely different photographic images in accordance with the light source in photography. Thus conventional films have the disadvantage that natural color reproducibility is lost because of the difference in the light quality in photography.

In addition, if the lighting strength is relatively low though the depth of focus of the lens is sufficiently deep, there is a problem of uneven exposure. Accordingly, further improved film-with-lens units which may be used with excellent photographic results, irrespective of outdoor or indoor objects and also irrespective of day or night, are desired in this technical field.

SUMMARY OF THE INVENTION

A first object of the present invention is to provide a film-with-lens unit which may be handled with ease to form photographic pictures with a nearly visual color-reproducibility independent of the light quality of the photographing light source.

A second object of the present invention is to provide a film-with-lens unit which may form photographic pictures with a nearly visual color-reproducibility independent of the light quality or light amount of the light source, both indoors and outdoors.

Other objects of the present invention will be apparent from the description that follows.

The present inventors studied various combinations of photographic film, exposing mechanism and auxiliary lighting mechanism in one film unit and, as a result, have found that these and other objects of the present invention can be attained by a photographic material package unit having a built-in photographic material, which is composed of an yellow coupler-containing blue-sensitive emulsion layer (hereinafter referred to as BL), a magenta coupler-containing green-sensitive emulsion layer (hereinafter referred to as GL) and a cyan coupler-containing red-sensitive emulsion layer (hereinafter referred to as RL) and additionally a protective layer as provided on a support, and having an exposing function, which is characterized in that the spectral sensitivity distribution (hereinafter referred to as S (λ)) of the respective light-sensitive layers of the photographic material satisfies the following conditions (A) through (C):

(A) In BL, the wavelength (hereinafter referred to as $\lambda_B^{max}$) of imparting the maximum value of the S(λ) falls within a wavelength range of from 406 nm to 480 nm, and the wavelength (hereinafter referred to as $\lambda_B^{80}$) of imparting 80% of the maximum value of the S(λ) falls within a wavelength range of from 400 nm to 500 nm.

(B) In GL, the wavelength (hereinafter referred to as $\lambda_G^{max}$) of imparting the maximum value of the S(λ) falls within a wavelength range of from 527 nm to 580 nm, and the wavelength (hereinafter referred to as $\lambda_G^{80}$) of imparting 80% of the maximum value of the S(λ) falls within a wavelength range of from 500 nm to 600 nm.

(C) In RL, the wavelength (hereinafter referred to as $\lambda_R^{max}$) of imparting the maximum value of the S(λ) falls within a wavelength range of from 595 nm to 640 nm, and the wavelength (hereinafter referred to as $\lambda_R^{80}$) of imparting 80% of the maximum value of the S(λ) falls within a wavelength range of from 575 nm to 650 nm.

Namely, the present inventors have found that the objects of the present invention can be attained by a photographic material package unit composed of a container sealed to ambient light containing a silver halide color light-sensitive film, the container having a shutter means for admitting a predetermined amount of light to the container and a lens for forming an image on the film using the light admitted by the shutter means; the color film being composed of a support having thereon:

(a) at least one blue-sensitive silver halide emulsion layer containing a yellow coupler and having a spectral sensitivity distribution with a maximum spectral sensitivity of from 406 nm to 480 nm, the distribution within 80% of the maximum value being in a range of from 400 nm to 500 nm;

(b) at least one green-sensitive silver halide emulsion layer containing a magenta coupler and having a spectral sensitivity distribution with a maximum spectral sensitivity of from 527 nm to 580 nm, the distribution within 80% of the maximum value being in a range of from 500 nm to 600 nm;

(c) at least one red-sensitive silver halide emulsion layer containing a cyan coupler, and having a spectral sensitivity distribution with a maximum spectral sensitivity of from 595 nm to 640 nm, the distribution within 80% of the maximum value being in a range of from 575 nm to 650 nm; and (d) at least one protective layer.

In addition, the invention relates to a photographic material package unit with a built-in auxiliary lighting function for flush emission based on the synchro-signal of the shutter operation.

DETAILED DESCRIPTION OF THE INVENTION

Figure 1:
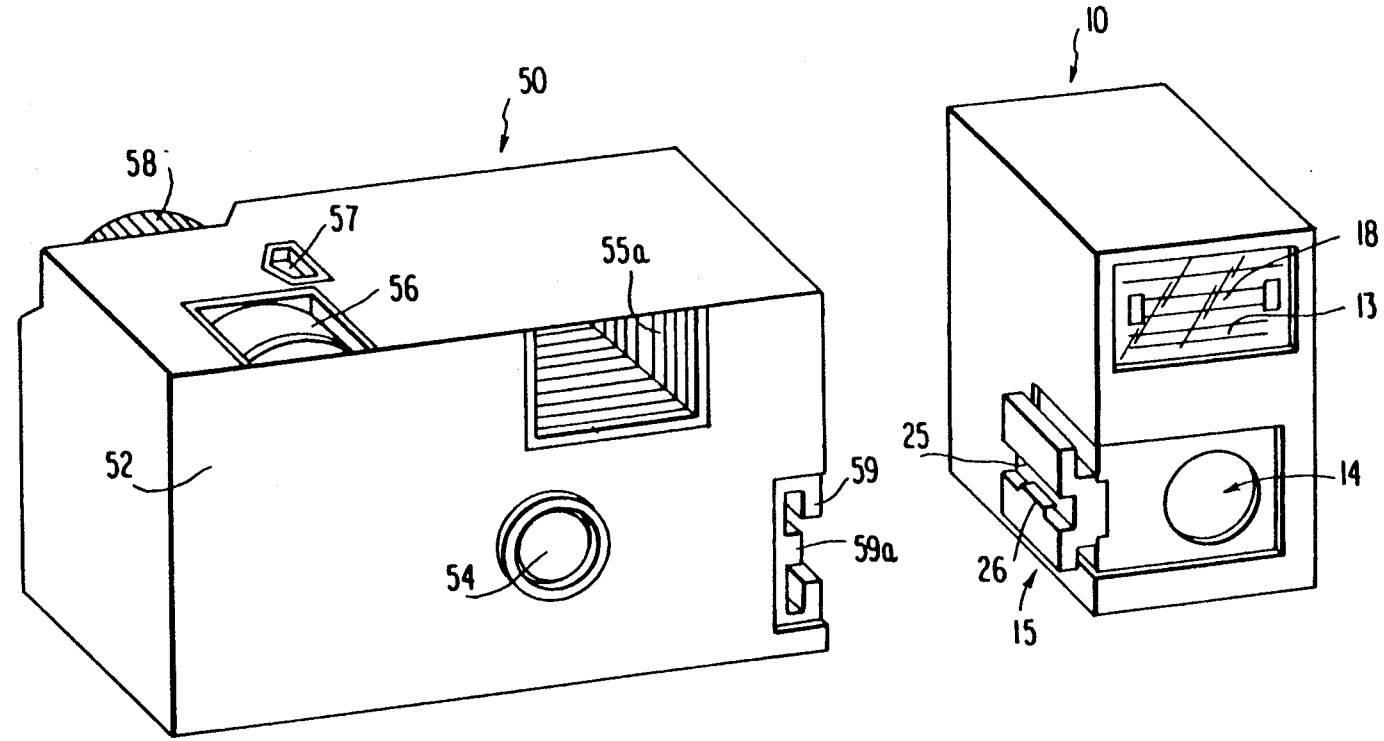
FIG. 1 shows a photographic material package unit with auxiliary flash unit which is one embodiment of the present invention.

The present invention requires a particular spectral sensitivity distribution of the respective light-sensitive layers in the photographic material used in the package unit. In order to constantly obtain visually natural color photographs by photographing with a photographic material package unit composed of a shutter with a fixed shutter speed, a single lens, especially a plastic single lens, and an exposing mechanism with an aperture ratio of fixed F value, under the lighting conditions of various natural lights, electric lamps, fluorescent lamps or flash optionally combined with any other auxiliary lighting source, various proposals have been made in JP-A-63-17448 (the term "JP-A" as used herein means an "unexamined Japanese patent application" and JP-A-63-118157 and Japanese Patent Application Nos. 16201/87, 27649/87, 27650/87, 27651/87 and 27652/87. In the present invention, the spectral sensitivity distributions of the blue-sensitive layer (BL) and the red-sensitive layer (RL) of the photographic material are required to be near to the visual spectral sensitivity distribution (above-mentioned conditions (A) and (C)), and the spectral sensitivity distribution of the green-sensitive layer (GL) is required to fall within a determined range in accordance with the spectral sensitivity distributions of the BL and RL (above-mentioned condition (B)). In particular, in order to reduce the deviation of the color reproducibility because of the spectral transmission characteristics of the materials for plastic lenses in the near-ultraviolet wavelength range, it is desired that the spectral sensitivity at 420 nm or less is lowered.

Further, in RL of the photographic material, it is preferred that the value $\lambda_R^{80}$ with the longest wavelength among the all values of $\lambda_R^{80}$ is within a wavelength range of from 610 nm to 650 nm and that the value $\lambda_R^{80}$ with the shortest wavelength among the all values thereof is within a wavelength range of from 575 nm to 625 nm.

Also, in BL of the photographic material, it is preferred that the value $\lambda_B^{80}$ with the longest wavelength among the all values of $\lambda_B^{80}$ is within a wavelength range of from 455 nm to 500 nm.

The spectral sensitivity distribution of the respective light-sensitive layers of the photographic material for use in the present invention varies, depending upon (1) the halogen composition and the crystal habit of the light-sensitive silver halide grains in the silver halide emulsions used, (2) the kind and the amount of the sensitizing dye used, the method of using the dye, for example, step for adding the dye, as well as the state of the dye as adsorbed to silver halide grains, (3) the layer constitution and the kind and amount of the coloring material used in the respective layers, and (4) the spectral transmission characteristics of the optical exposing system of the film-with-lens used.

In the photographic material for use in the present invention, one or more sensitizing dyes selected from compounds represented by formulae (II), (III) and (IV) are preferbly used singly or in combination.

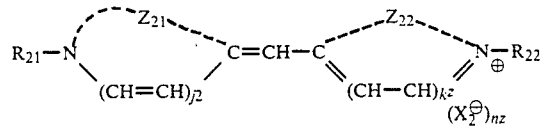

(II)

where $Z_{21}$ and $Z_{22}$, which may be the same or different, each represents an atomic group necessary for forming a substituted or unsubstituted heterocyclic groups selected from benzothiaozle, naphthothiazole, benzoselenazole, naphthoselenazole, benzoxazole, naphthoxazole, benzimidazole, naphthimidazole, indolenine, benzindolenine, indole and quinoline; $R_{21}$ and $R_{22}$, which may be the same or different, each represents an alkyl group, an alkenyl group, an alkinyl group or an aralkyl group, provided that at least one of $R_{21}$ and $R_{22}$ is substituted with at least one sulfonic acid group, carboxyl group or hydroxyl group;

$j_2$ and $k_2$ each is 0 or 1;

$n_2$ is 0 or 1, provided that when $n_2$ is 0, the compound forms an internal salt; and $X_2\ominus$ represents an acid anion necessary for charge balance.

In formula (II), the hetero-ring formed by $Z_{21}$ or $Z_{22}$ may be substituted by substituent(s) selected from a halogen atom (e.g., F, Cl, Br), a lower alkyl group (e.g., methyl, ethyl, trifluoromethyl), a benzyl group, a phenethyl group, a hydroxyl group, an alkoxy group, an acetyl group, an aryl group (e.g., phenyl, chlorophenyl), a carboxyl group or an esterified carboxyl group, a carbamoyl group and a sulfamoyl group. In particular, groups capable of strongly forming J-band, such as a halogen atom, a trifluoromethyl group, an aryl group and an esterified carboxyl group are preferred.

As $R_{21}$ and $R_{22}$, groups which are generally used in cyanine dyes may be used, for example, a lower alkyl group having from 1 to 6 carbon atoms, an alkoxyalkyl group, an acetoxyalkyl group, an alkylureidoalkyl group, a hydroxyalkyl group, a chloroalkyl group, a sulfoalkyl group, a carboxyalkyl gorup, an allyl group, a benzyl group or a phenethyl group.

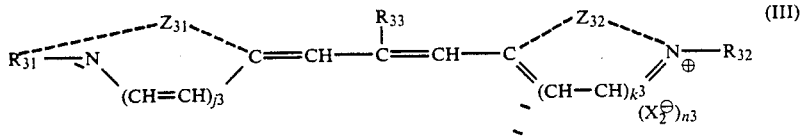

(III)

In formula (III), $Z_{31}$ represents an atomic group necessary for forming a substituted or unsubstituted heterocyclic group selected from benzimidazole, benzoxazole, naphthimidazole and naphthoxazole; $Z_{32}$ represents an atomic group necessary for forming a substituted or unsubstituted heterocyclic group selected from benzimidazole, naphthimidazole, benzoxazole, naphthoxazole, benzothiazole and benzoselenazole; $R_{31}$ has the same definition as $R_{21}$ in formula (II); $R_{32}$ has the same definition as $R_{22}$ in formula (II); $R_{33}$ represents hydrogen, a lower alkyl group or an aralkyl group; $j_3$ and $k_3$ each is 0 or 1; $n_3$ has the same definition $n_2$ in formula (II); $X_3\ominus$ represents an acid anion necessary for chanrge balance.

Preferred substituents for the hetero-ring formed by $Z_{31}$ or $Z_{32}$ in formula (III) include substituents for the hetero-ring formed by $Z_{21}$ or $Z_{22}$ in formula (II).

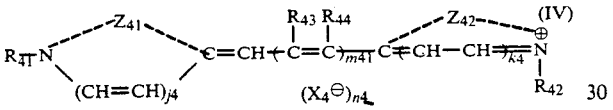

(IV)

In formula (IV), $Z_{41}$ and $Z_{42}$, which may be the same or different, each represents an atomic group necessary for forming a substituted or unsubstituted 5-membered or 6-membered hetero-ring, alone or condensed with another ring for example, a thiazole, benzothiazole, naphthothiazole, selenazole, benzoselenazole, naphthoselenazole, oxazole, benzoxazole, naphthoxazole, imidazole, benzimidazole, naphthimidazole, 4-quinoline, pyrroline, pyridine, tetrazole, indolenine, benzindolenine, indole, tetrazole, benzotetrazole or naphthotetrazole nuclei; $R_{41}$ and $R_{42}$, which may be the same or different, each represents an alkenyl group, an alkinyl group, an aralkyl group, an unsubstituted alkyl group or an alkyl group substituted with a halogen atom, a cyano group, an aryloxy group, a substituted or unsubstituted amino group, a carboxylic acid group, a sulfonic acid group or a hydroxyl group; $m_{41}$ is an integer of 1, 2 or 3; when $m_{41}$ is 1, $R_{43}$ represents hydrogen, a lower alkyl group, an aralkyl group or an aryl group, and $R_{44}$ represents hydrogen; when $m_{41}$ is 2 or 3, $R_{43}$ represents hydrogen and $R_{44}$ represents hydrogen, a lower alkyl group or an aralkyl gorup, and plural $R_{43}$ groups may be linked to form a hydrocarbon ring or a hetero ring; $j_4$ and $k_4$ each is 0 or 1; $X_4\ominus$ represents an acid anion necesary for charge balance; and $n_4$ is 0 or 1.

The sensitizing dyes of the present invention can be used singly or in combination, and other merocyanine dyes, hemicyanine dyes, styryl dyes or rhodacyanine dyes may be used together with the sensitizing dyes for the purpose of adjusting the spectral sensitivity distribution and for supersensitization. In addition, other supersensitizers, for example, mercaptoheterocyclic compounds, especially hydrophilic mercaptoheterocyclic compounds, formaldehyde condensation products (such as those described in U.S. Pat. No. 3,743,510) and azaindene heterocyclic compounds may also be used together.

The sensitizing dyes of the present invention can be added in varying amounts according to purpose, for example, in an amount of from $1\times10^{-7}$ mol to $1\times10^{-3}$ mol, preferably from about $1\times10^{-6}$ mol to $1\times10^{-4}$ mol, per mol of silver halide, during formation of silver halide grains, during physical ripening, or before or after chemical sensitization, or these may also be added in the form of an additive. When the dyes are added during or before chemical ripening, stable and strong spectral sensitization may be attained with small desensitization.

Specific examples of cyanine dyes which may be used in the light-sensitive layers in accordance with the present invention are described below, which are not to be construed as limiting the scope of the present invention.

1. Blue-sensitive Silver Halide Emulsion Layer:

1-(1)

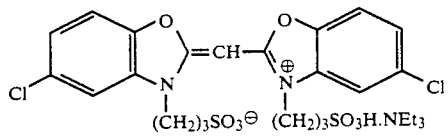

1-(2)

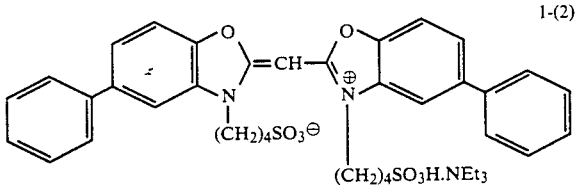

1-(3)

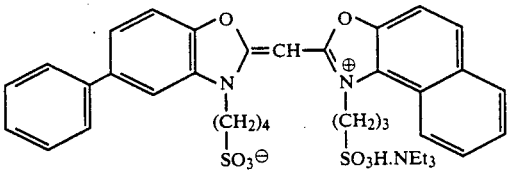

1-(4)

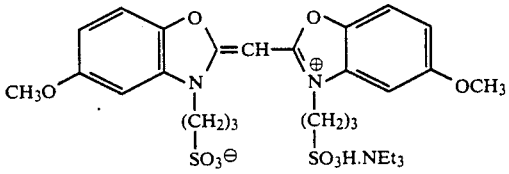

1-(5)

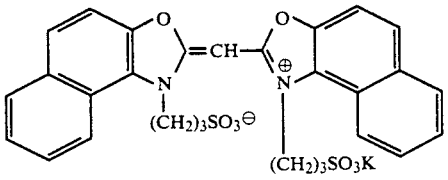

-continued
1. Blue-sensitive Silver Halide Emulsion Layer:
1-(6)
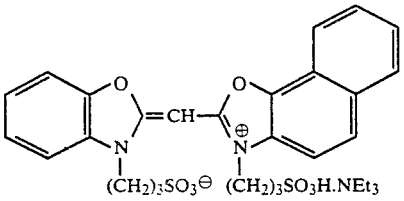
1-(7)
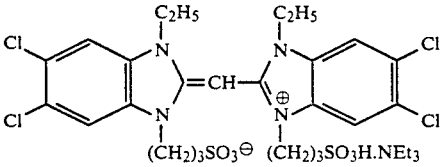
1-(8)
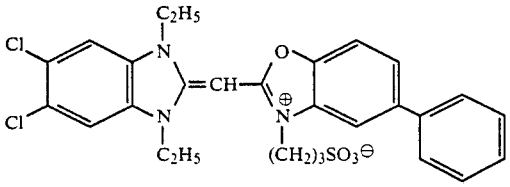
1-(9)
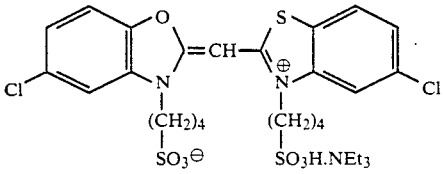
1-(10)
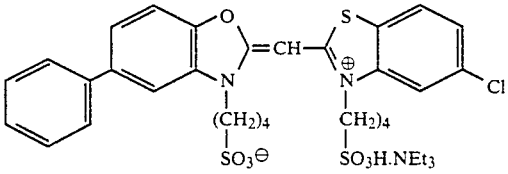
1-(11)
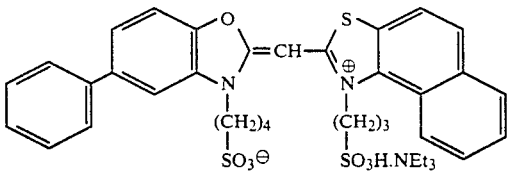
1-(12)
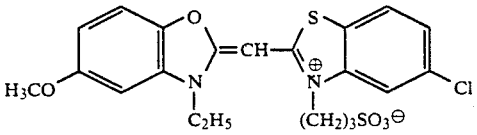
1-(13)
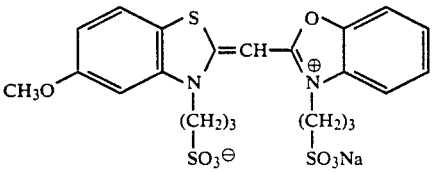
1-(14)
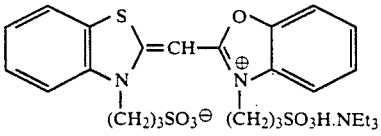
-continued
1. Blue-sensitive Silver Halide Emulsion Layer:
1-(15)
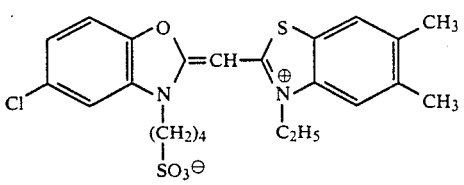
1-(16)
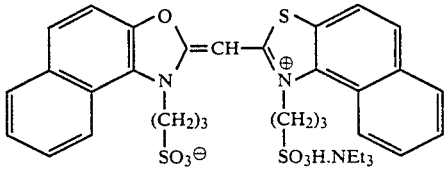
10(17)
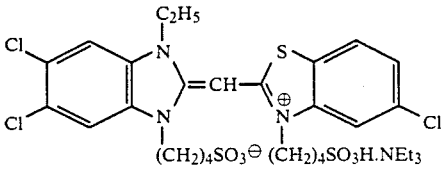
1-(18)
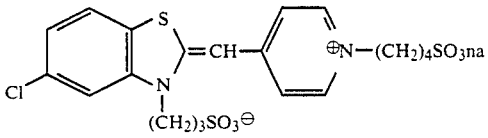
1-(19)
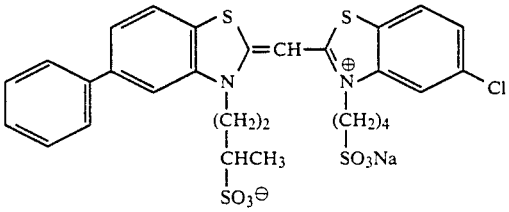
1-(20)
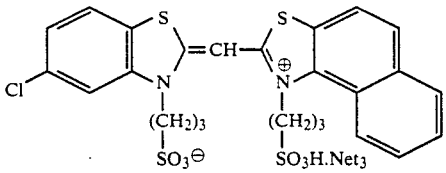
1-(21)
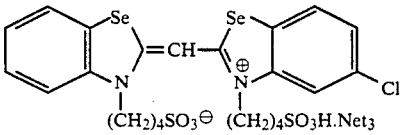
1-(22)
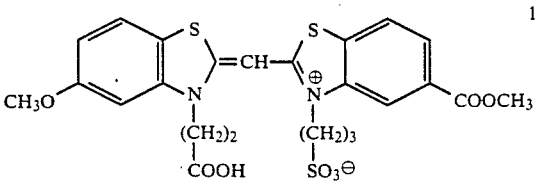
1-(23)
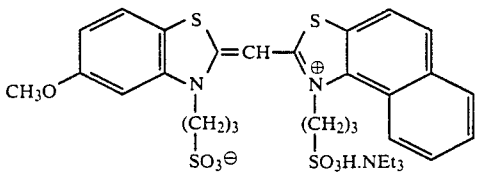

-continued
1. Blue-sensitive Silver Halide Emulsion Layer:
1-(24)
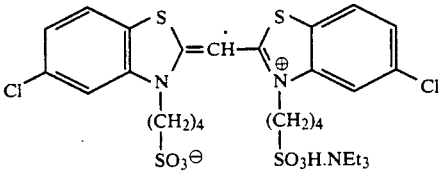
1-(25)
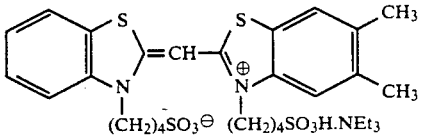
-continued
1. Blue-sensitive Silver Halide Emulsion Layer:
1-(26)
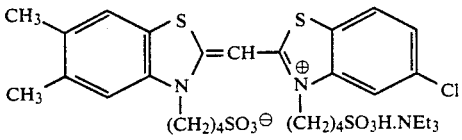
1-(27)
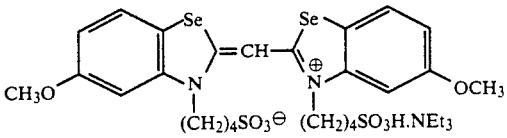
1-(28)
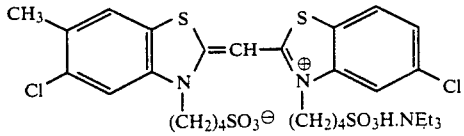
2. Green-sensitive Silver Halide Emulsion Layer:
2-(1)
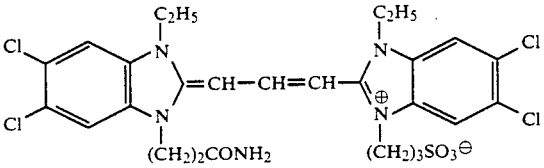
2-(2)
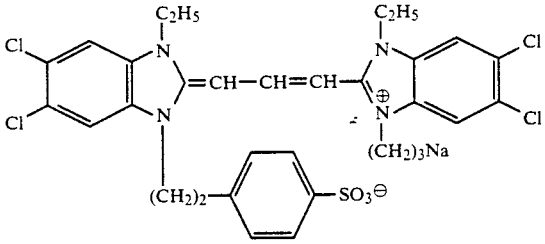
2-(3)
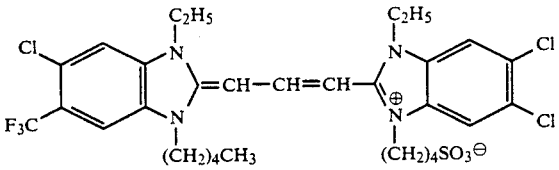
2-(4)
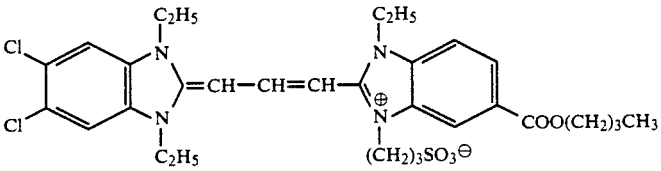
2-(5)
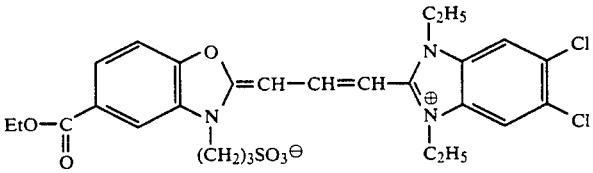

-continued
2. Green-sensitive Silver Halide Emulsion Layer:
2-(6)
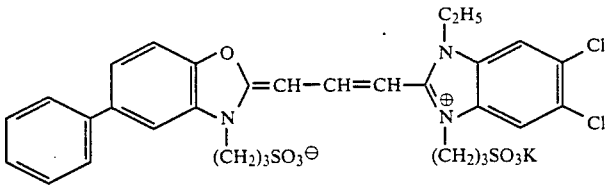
2-(7)
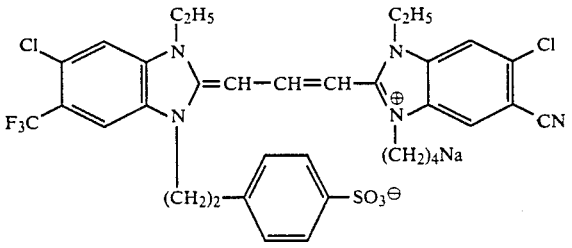
2-(8)
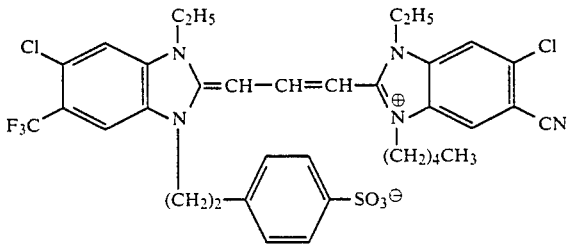
2-(9)
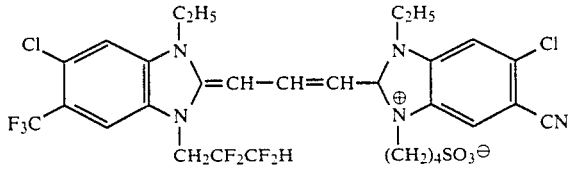
2-(10)
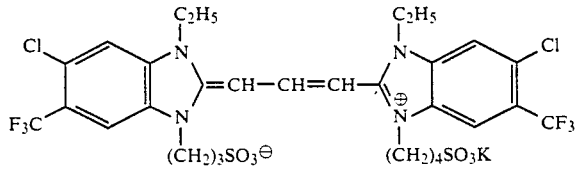
2-(11)
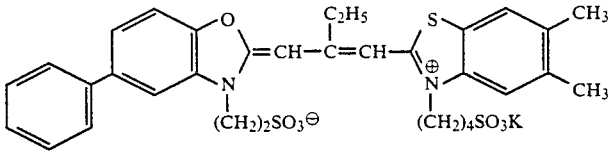
2-(12)
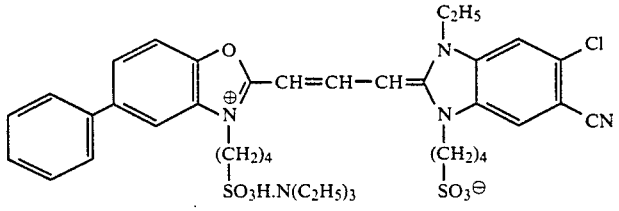
2-(13)
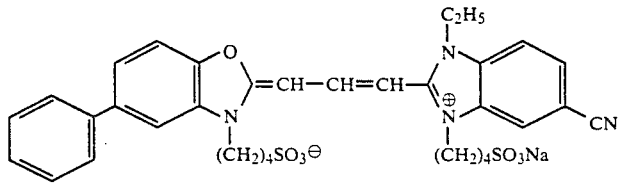

-continued
2. Green-sensitive Silver Halide Emulsion Layer:
2-(14)
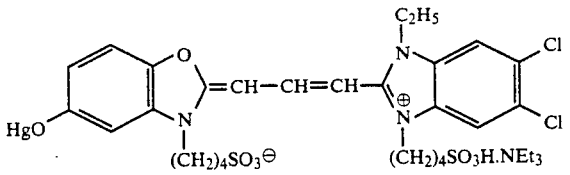
2-(15)
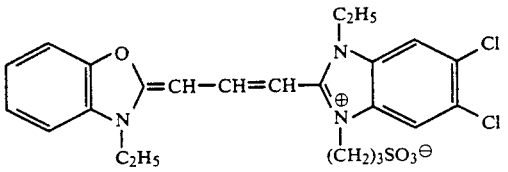
2-(16)
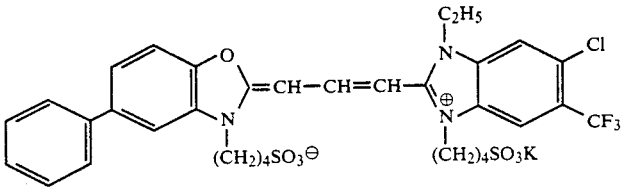
2-(17)
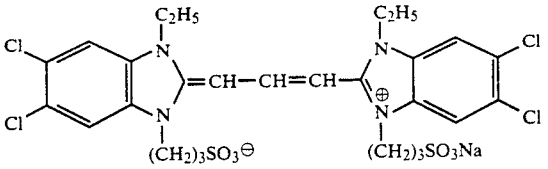
2-(18)
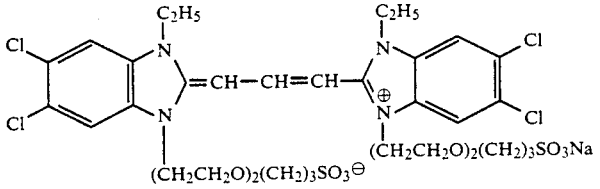
2-(19)
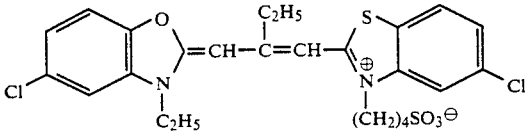
2-(20)
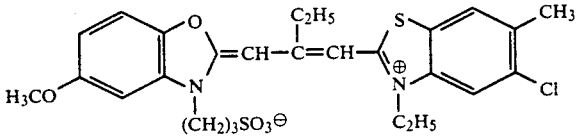
2-(21)
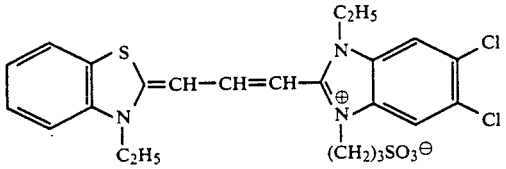
2-(22)
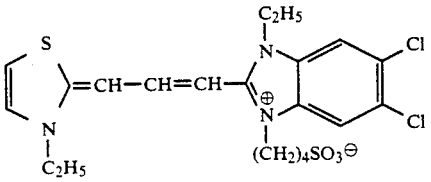

-continued
2. Green-sensitive Silver Halide Emulsion Layer:
2-(23)
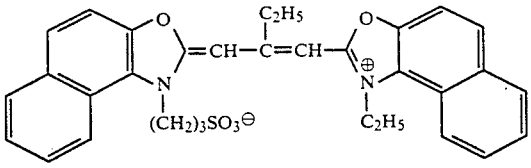
2-(24)
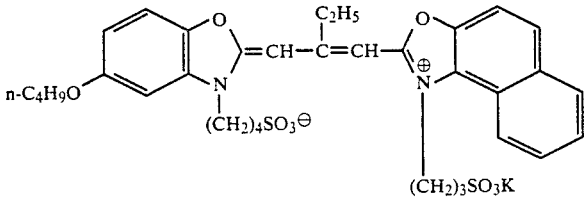
2-(25)
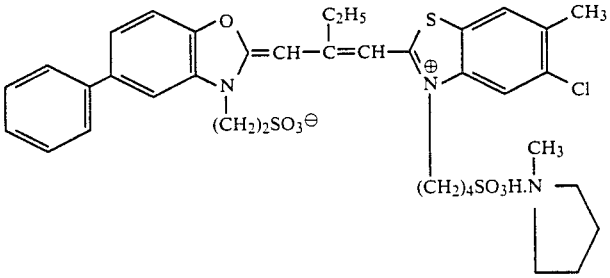
2-(26)
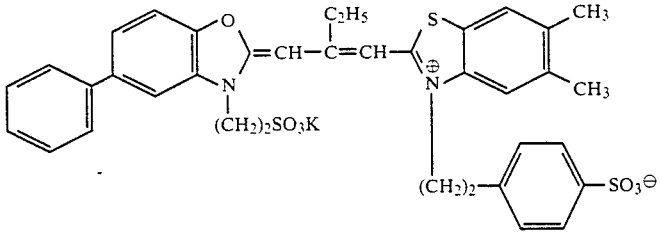
2-(27)
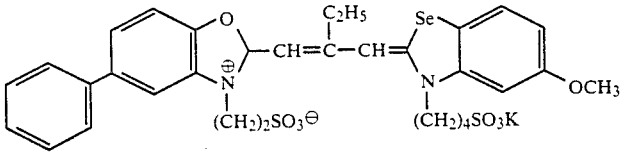
2-(28)
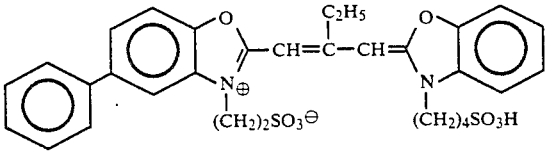
2-(29)
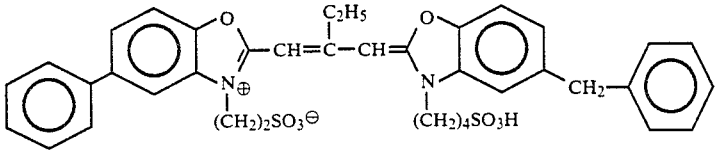
2-(30)
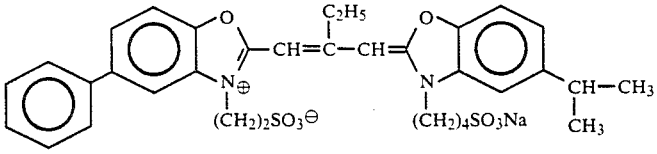

-continued
2. Green-sensitive Silver Halide Emulsion Layer:
2-(31)
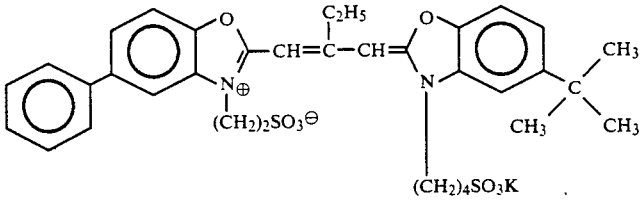
2-(32)
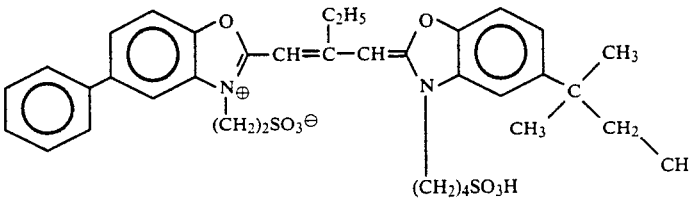
2-(33)
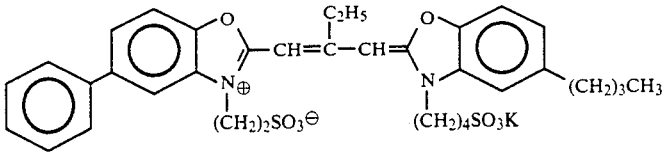
2-(34)
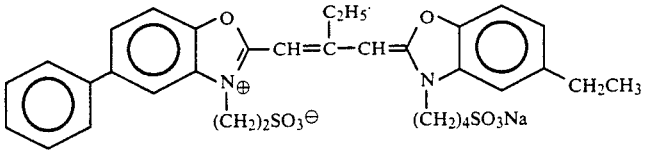
2-(35)
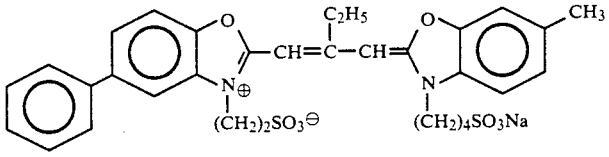
2-(36)
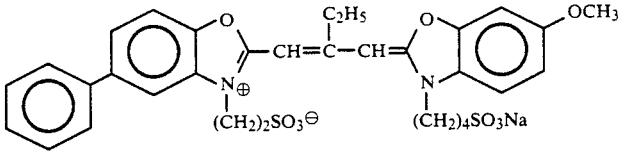
2-(37)
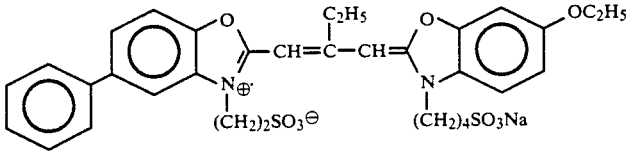
2-(38)
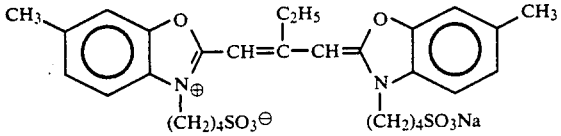
2-(39)
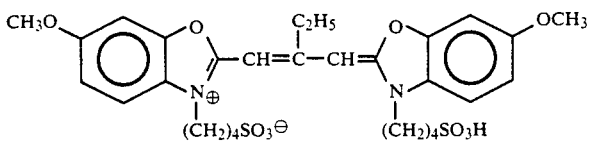

-continued
2. Green-sensitive Silver Halide Emulsion Layer:
2-(40)
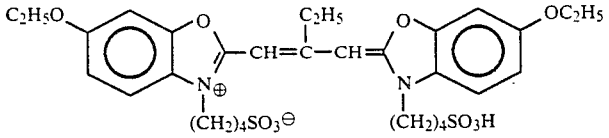
2-(41)
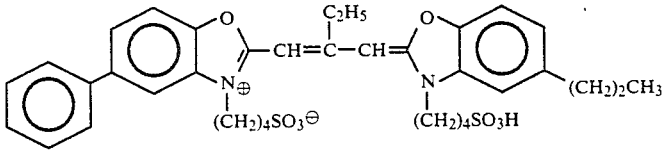
2-(42)
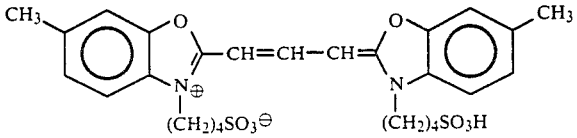
2-(43)
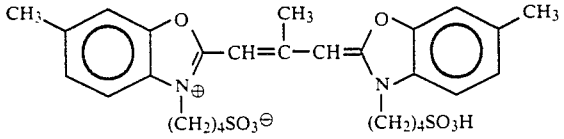
2-(44)
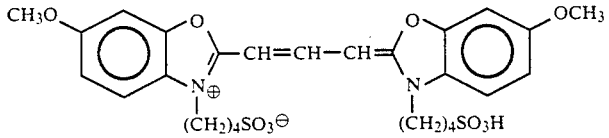
2-(45)
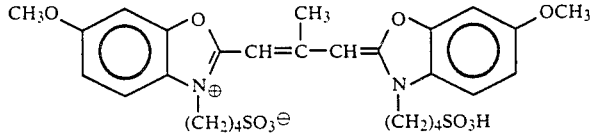
2-(46)
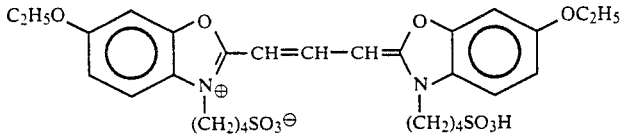
2-(47)
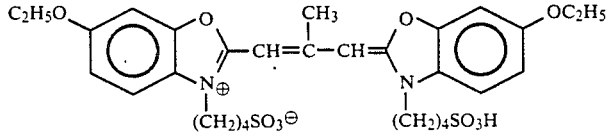
2-(48)
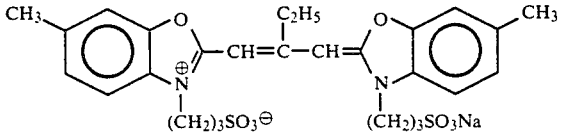
2-(49)
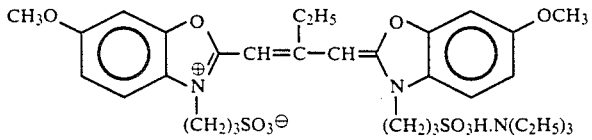

-continued
2. Green-sensitive Silver Halide Emulsion Layer:
2-(50)
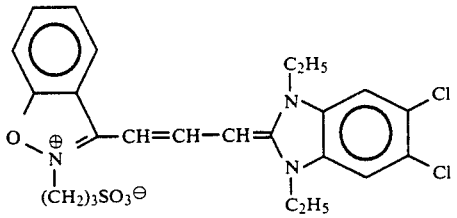
2-(51)
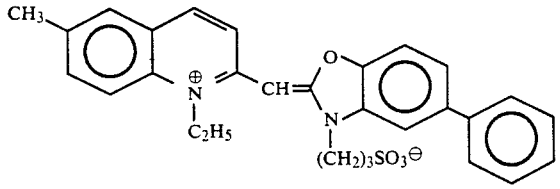
2-(52)
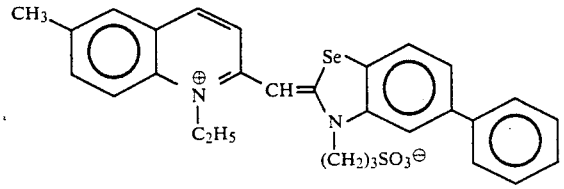
2-(53)
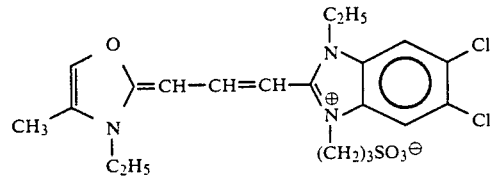
2-(54)
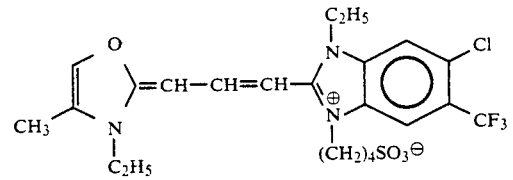
2-(55)
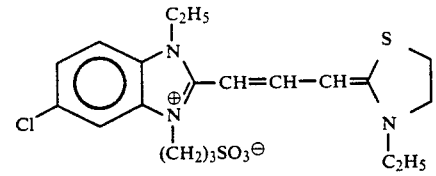
2-(56)
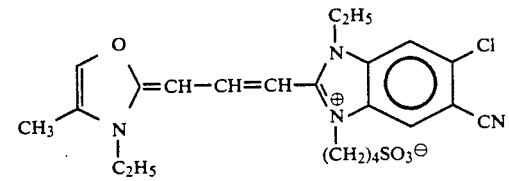
2-(57)
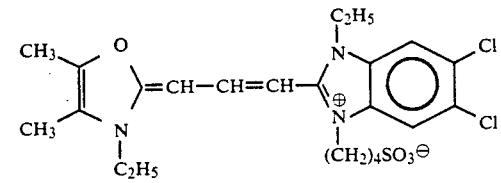

-continued
2. Green-sensitive Silver Halide Emulsion Layer:
2-(58)
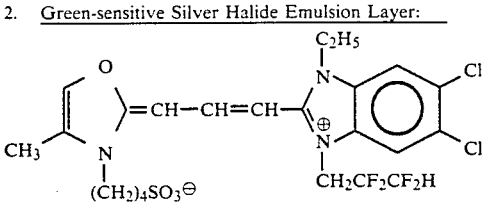
2-(59)
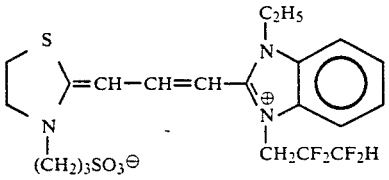
2-(60)
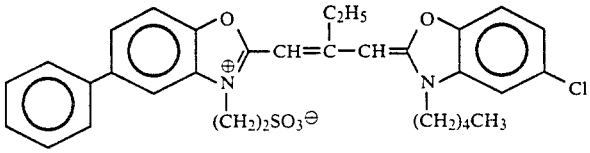
2-(61)
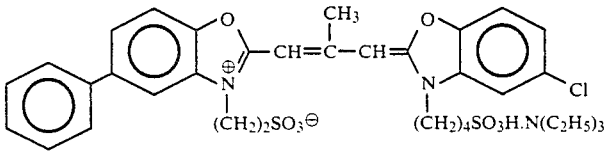
2-(62)
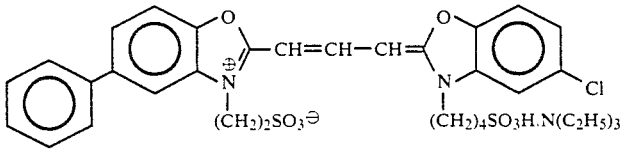
2-(63)
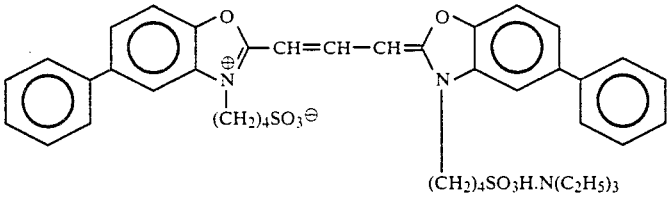
2-(64)
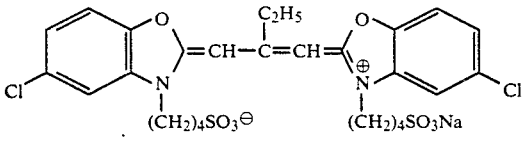
2-(65)
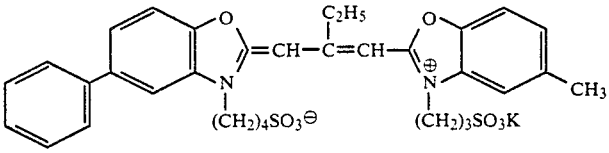
3. Red-sensitive Silver Halide Emulsion Layer:
3-(1)
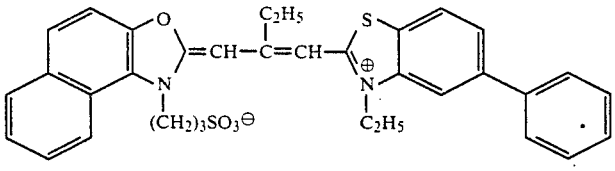

-continued
3. Red-sensitive Silver Halide Emulsion Layer:
3-(2)
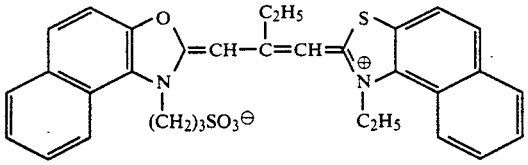
3-(3)
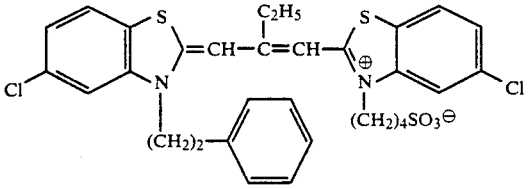
3-(4)
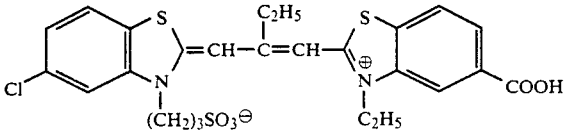
3-(5)
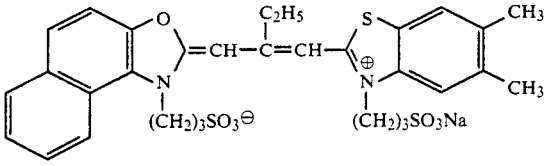
3-(6)
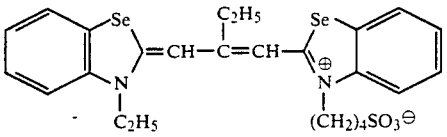
3-(7)
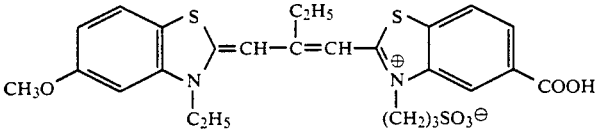
3-(8)
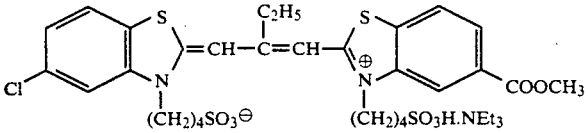
3-(9)
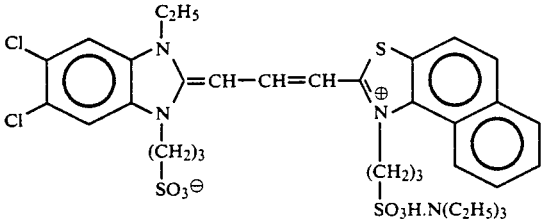
3-(10)
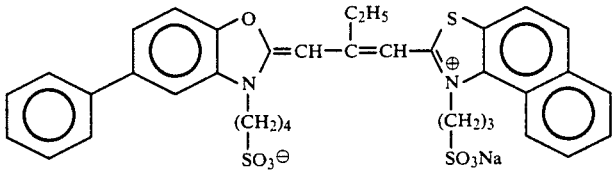

-continued
3. Red-sensitive Silver Halide Emulsion Layer:
3-(11)
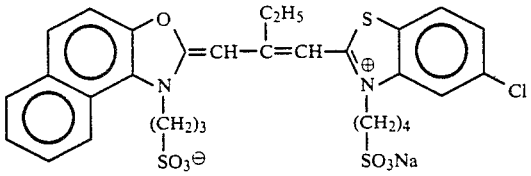
3-(12)
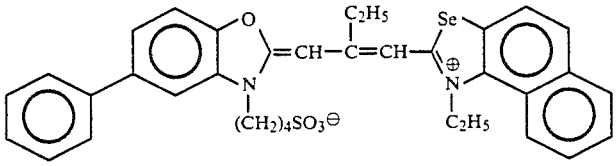
3-(13)
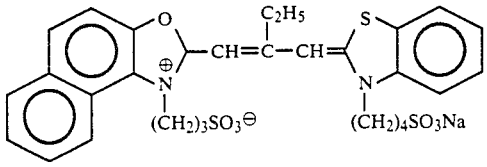
3-(14)
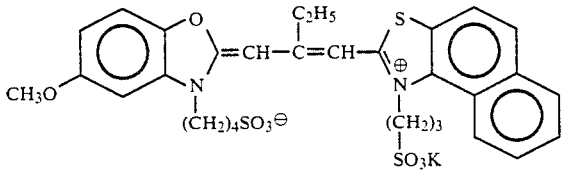
3-(15)
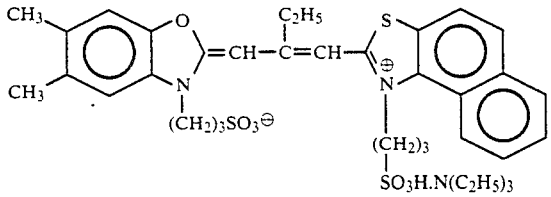
3-(16)
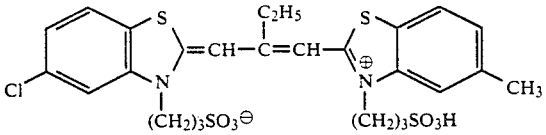
3-(17)
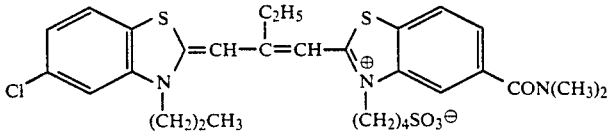
3-(18)
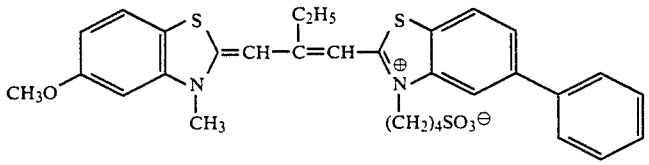
3-(19)
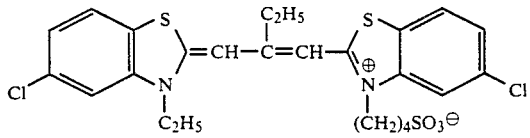

-continued
3. Red-sensitive Silver Halide Emulsion Layer:
3-(20)
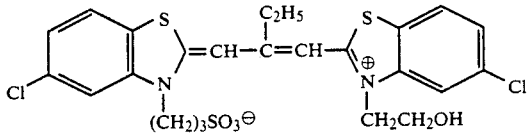
3-(21)
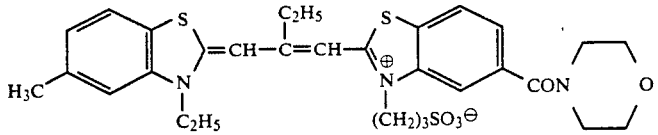
3-(22)
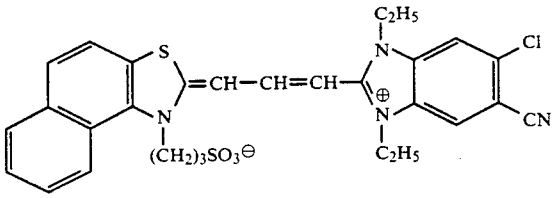
3-(23)
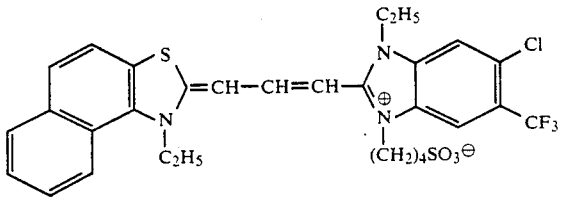
3-(24)
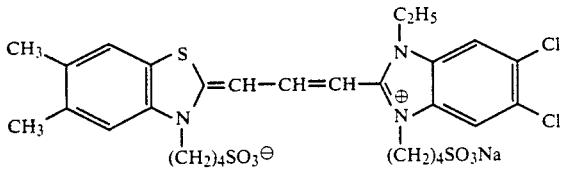
3-(25)
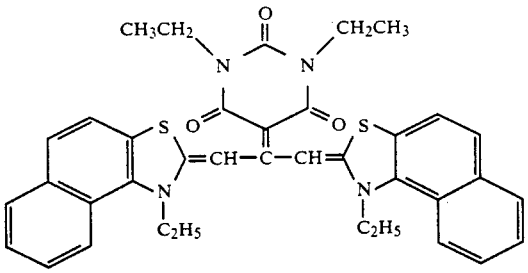
3-(26)
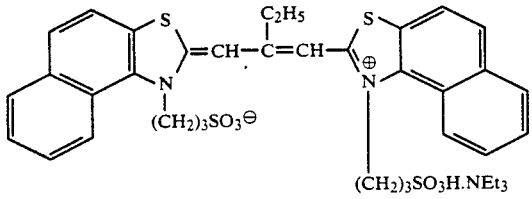
3-(27)
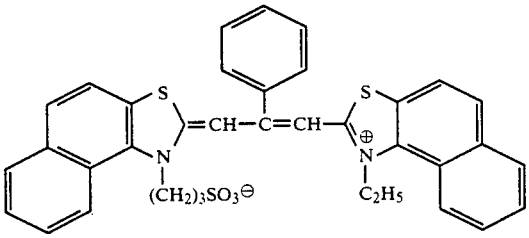

Other examples of sensitizing dyes which may be used in the present invention are described, for example, in Japanese Patent Application No. 175516/87, pages 22 to 84.

In the present invention, a photographic material package unit having an exposure means a container having therein a photographic material, said case having an exposure means comprising a fixed focus lens and a shutter means and optionally an outer package.

In another preferred embodiment of the present invention, the photographic material package unit of the present invention may be provided with an auxiliary lighting function which emits a flash synchronized with the shutter having a fixed predetormined shutter speed of for example, 1/100 second, so that the unit may be used anytime and anywhere, irrespective of outdoor or indoor subjects and also irrespective of day and night, to obtain photographs of high photographic quality.

For example, the auxiliary lighting source may be a flash bulb, but a "strobe" light is especially preferred. For example, the simple strobe described in Japanese Utility Model Application No. 87309/87 is preferred. As the electric source, a dry cell of R20P (LR6) or R14P type may be used, but a dry cell such as a plastic dry cell is preferred. The dry cell to be used for this purpose may have an electric capacity capable of giving flashes for the number of shots contained in the photographic material, for example, several tens of exposusres.

FIG. 1 shows one embodiment of the photographic material package unit of the present invention provided with an auxiliary flash. In FIG. 1, the strobe body (10) is combined, preferably by fusion, with the side surface of the photographic material package unit (50) at the hotshoe (59) via the leg (15) with the contact pieces (25 and 26). The contact pieces (25, 26) are connected with the shutter mechanism (not shown) in the package unit. As synchronizing with the signal from the shutter, a short circuit is applied to trigger the strobe circuit, so that a high voltage charge previously charged in the main condenser is thereby transferred to the discharge tube (18). Thus the tube provides auxiliary flash illumination. Immediately after emission, the electric current to the tube is cut off. When the charging switch (14) is cut off, the charging is stopped.

When the user judges that it is necessary to use the strobe light (for example, daytime synchronization under back light conditions), he may engage the charging switch for using the strobe light.

In FIG. 1, (13) is a lighting part, (54) is a photographing lens, (55*a*) is a finder aperture, (56) is a release button, (57) is a film counter, and (58) is a reeling up member. Charging of the high voltage charge is effected by pressing the charging switch (14), and sufficient charge is displayed by the lighting of a neon lamp positioned at the rear side of the strobe body (not shown). The flash time is generally from 1/500 to 1/10000 second, which is synchronized within the period that the shutter is open, for example, from 1/100 to 1/150 second.

Figure 2:
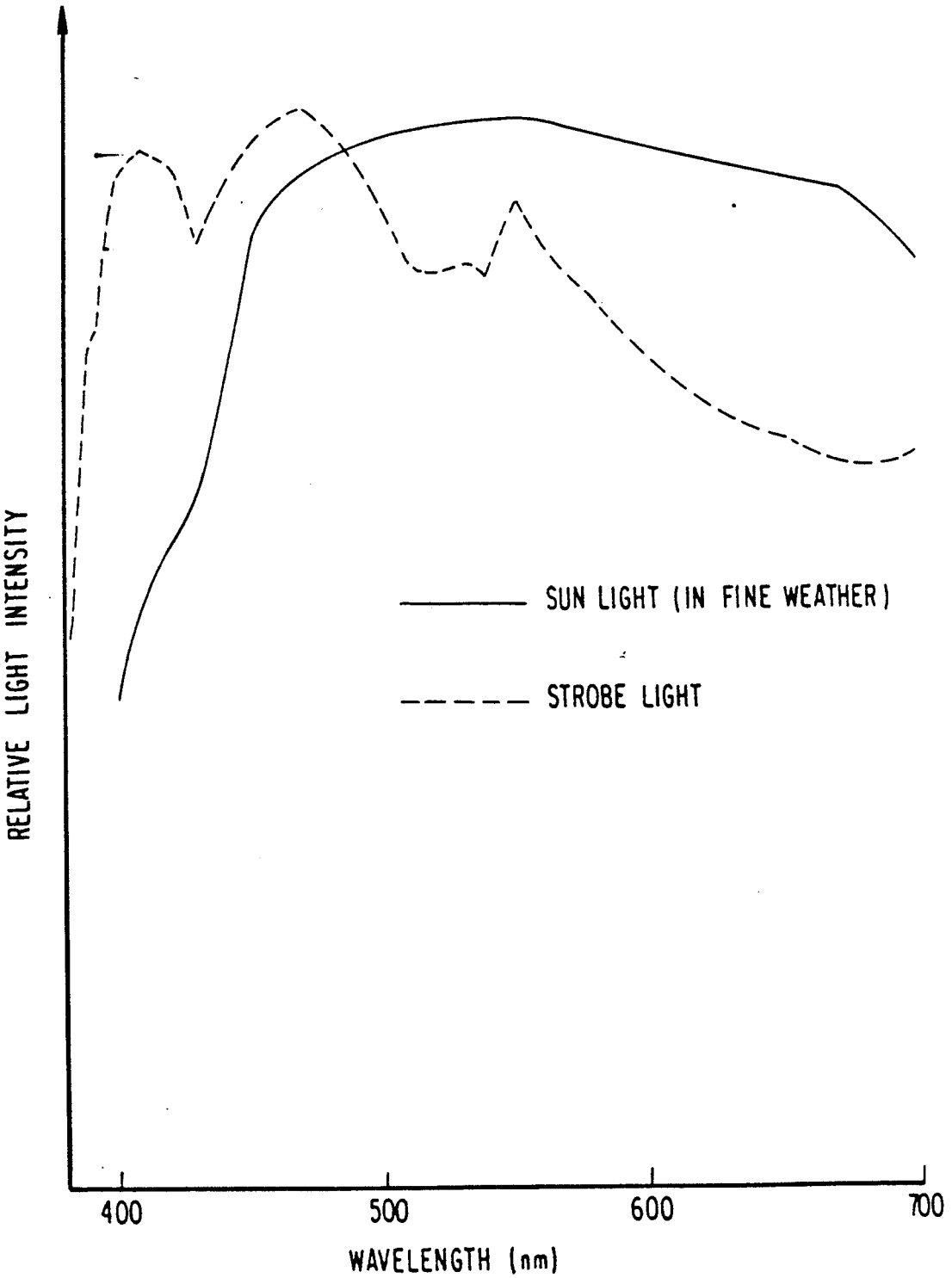
FIG. 2 shows the light intensity distribution of strobe (electric flash) light and natural light.

The flash mechanism for use in the present invention may use a flash bulb, but preferably, a xenon gas-filled discharge tube (18) is used. The spectral energy intensity in the visual lighting range of the strobe flash case is stronger in the green wavelength range (500 to 590 nm) and the blue wavelength range (390 to 500 nm) than in the red wavelength range (570 to 700 nm), for example as shown in FIG. 2. In order to improve the color reproducibility, although lowering the total auxiliary lighting strength, it is preferred to use a color-correcting filter (yellow to orange) so as to obtain natural light, or a color of about 5400° K. Because of the insertion of the color-correcting filter, the difference in color-reproduction between photographs taken under natural light and those taken with the aid of the auxiliary lighting unit is reduced. FIG. 2 shows the result of a visual test of the light intensity distribution of each of a strobe light and a natural light.

The photographic material package unit body of the present invention may be hermetically sealed with a moisture-proof material, for example, as so described in JP-A-U-62-186140 (The term "JP-A-U" as used herein means as "unexamined published Japanese utility model application") and JP-A-U-63-6435. Preferably, the unit is wrapped with a cover selected from a printable cardboard or a thin plastic sheet or aluminium sheet and then further packaged with a moisture-proof wrapping material, for example, an aluminium foil, a laminate paper composed of an aluminium foil and a plastic film or a sheet formed by processing the surface of the material to make it printable or hot-meltable.

As further preferable embodiment of the present invention, the interlayer effect between the respective light-sensitive layers of the photographic material of the present invention satisfies the following conditions (a) to (f).

(a) $-0.15 \leqq D_B/D_R \leqq +0.20$ (b) $-0.70 \leqq D_G/D_R \leqq +0.10$, preferably equal to or less than 0.00

(c) $-0.50 \leqq D_B/D_G \leqq +0.10$, preferably equal to or less than 0.00

(d) $-1.10 \leqq D_R/D_G - 0.10$ (e) $-0.45 \leqq D_G/D_B \leqq +0.05$ preferably equal to or less than $-0.05$ (g) $-0.20 \leqq D_R/D_B \leqq +0.35$ preferably equal to or greater less than $-0.05$ In these formulae, $D_B/D_R$ means the degree of the interlayer effect from RL to BL; $D_G/D_R$ means the degree of the interlayer effect from RL to GL; $D_B/D_G$ means the degree of the interlayer effect from GL to BL; $D_R/D_G$ means the degree of the interlayer effect from GL to RL; $D_G/D_B$ means the degree of the interlayer effect from BL to GL; and $D_R/D_B$ means the degree of the interlayer effect from BL to RL.

The interlayer effect as referred to herein is determined as follows. Regarding the interlayer effect from green-sensitive layer to red-sensitive layer ($D_R/D_G$), the photographic material is stepwise exposed with a green light (Fuji Filter: BPN-55) and then uniformly exposed with a red light (Fuji Filter: SC-60) to obtain the characteristic curve shown in FIG. 3. From the characteristic curve, the magenta density difference ($\Delta y$) between the fog density (A) and the density obtained by the exposure (Q), which is larger than the exposure (P) for giving the fog density by 1.5 (as log E unit), and the cyan density difference ($\Delta x$) between the cyan density obtained by the exposure (P) and that obtained by the exposure (Q) are obtained, and the value of ($\Delta x/\Delta y$) is defined as the degree of the interlayer effect ($D_R/D_G$) from the green-sensitive layer to the red-sensitive layer. In the same manner, the interlayer effect from the blue-sensitive layer to the red-sensitive layer can be obtained, using blue light (Fuji Filter: BPN 45).

A negative value $\Delta x$ means that the interlayer-inhibiting effect is great, and a relative interlayer effect is represented by a negative value. On the contrary, the positive value Δx means that the interlayer effect is not operating (or that is, the primary colors in the image tend to mix), and the degree of relative interlayer effect is represented by a positive value.

Recently, masking materials have been improved, and color turbidity because of unnecessary absorption in the long wavelength range of the color couplers for forming the respective colors can sufficiently be corrected. Accordingly, the degree of the interlayer effect as herein referred to is the value obtained after correction of the unnecessary absorption of the respective color-forming couplers.

In accordance with the present invention, the interlayer effect can be attained, for example, by the use of the compounds represented by formula (I) described in JP-A-63-17448:

$$A-(L_1)_a-Z_1 \quad (I)$$

wherein A represents a group capable of releasing $-(L_1)_a-Z_1$ by reaction with the oxidation product of a color developing agent; $L_1$ represents a timing group; $Z_1$ represents an active qroup having a development-inhibiting function; and a is 0 or 1.

Examples of such compounds are described in JP-A-63-17448, which can be used in the present invention, are described below, but the present invention is not to be construed as being limited thereto:

I-(1)

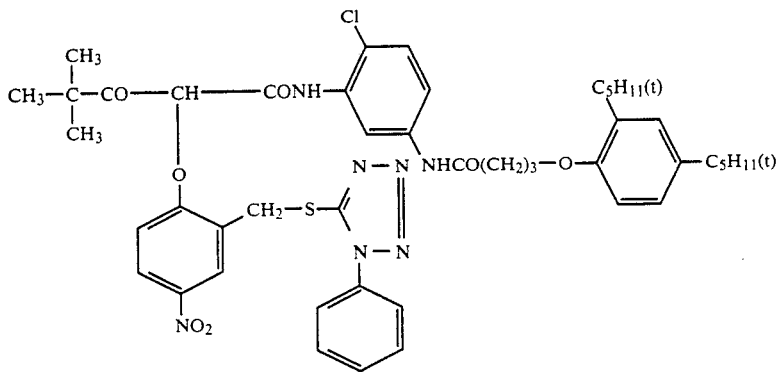

I-(2)

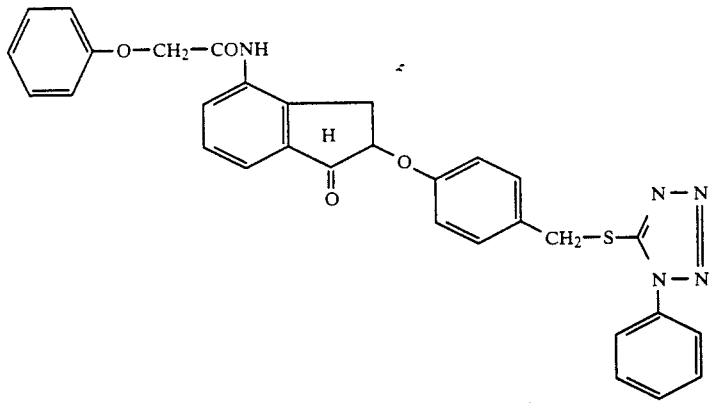

I-(3)

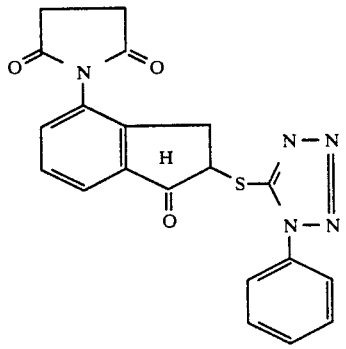

-continued
I-(4)
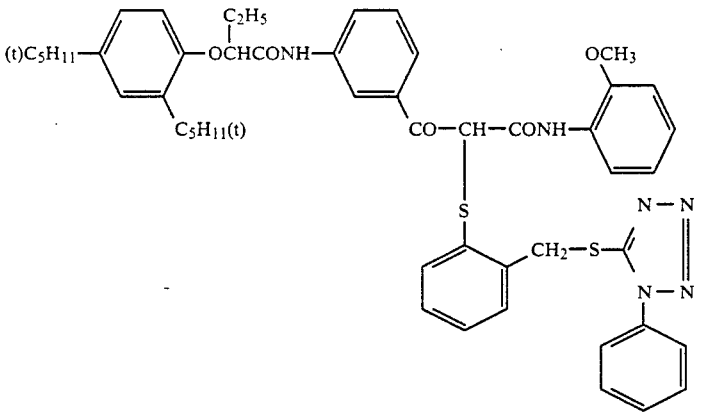
I-(5)
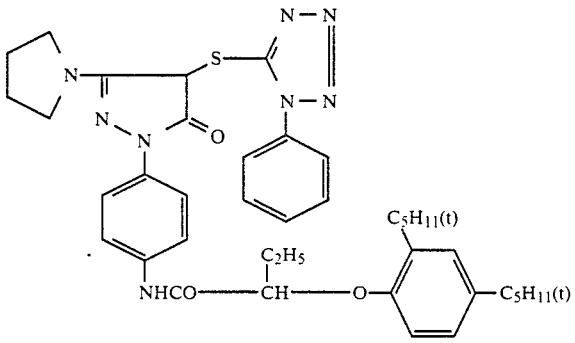
I-(6)
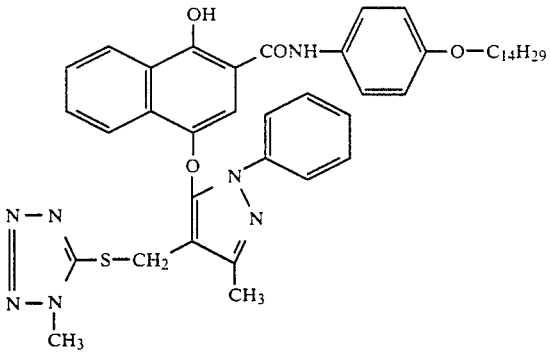
I-(7)
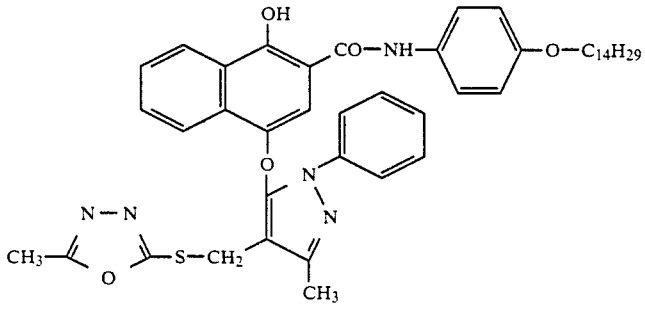

-continued
I-(8)
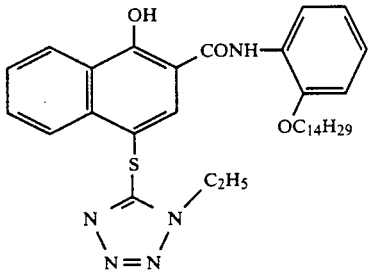
I-(9)
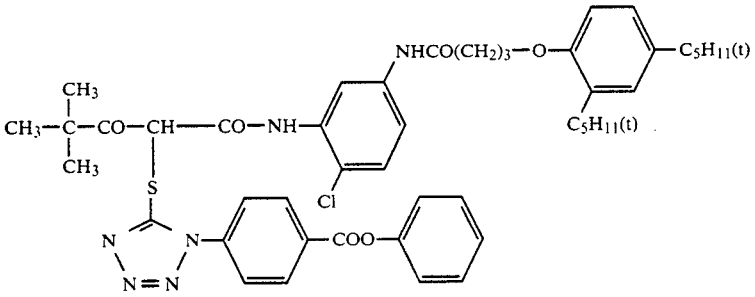
I-(10)
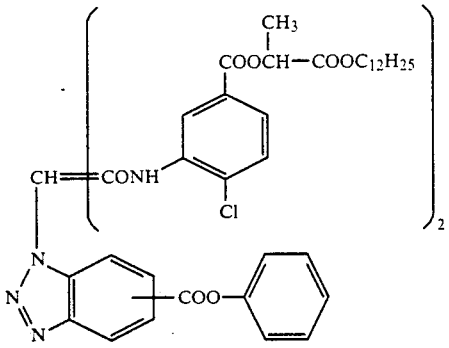
I-(11)
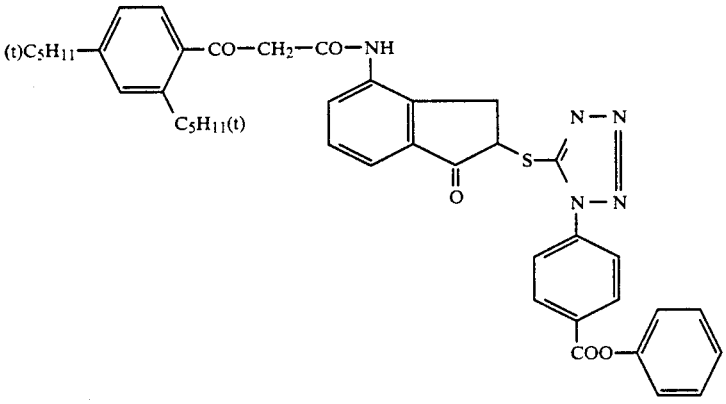

-continued

I-(12)

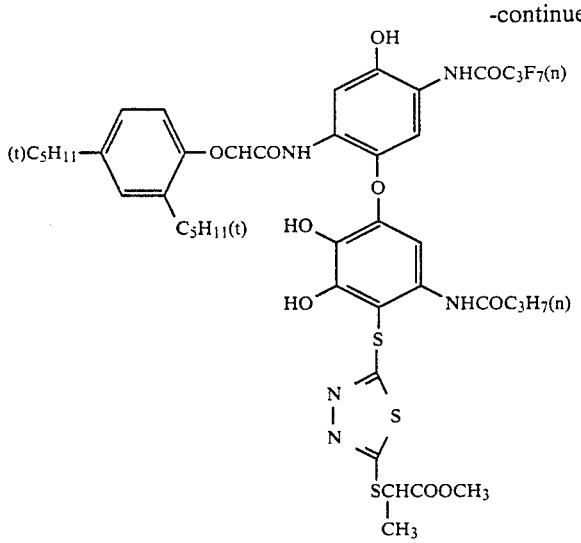

The interlayer effect varies in accordance with the activity of the development inhibitor released, the interlayer diffusibility of the component released and the amount of the component used. Specific examples of evaluation of interlayer effect are given below in the Examples. Accordingly, DIR compounds may be selected appropriately from the compounds of formula (I), and the interlayer effect with these compounds can be adjusted by varying the amount of the compound used.

The compound of formula (I) for use in the present invention can be added to a light-sensitive layer in any desired molar ratio to the color image-forming color coupler in the same layer in accordance with degree of the interlayer effect desired, and preferably is present in an amount of from 0.1 to 50 mol %, more preferably from 10 to 30 mol %, of the color coupler. The compound may be used together with a colored coupler for masking of color images formed, and a functional coupler such as a desilvering-accelerating agent-releasing coupler. The compound of formula (I) may be added to an interlayer or a functional light-sensitive layer, singly or in combination, in an amount of from 0.001 to 5 $g/m^2$, preferably from about 0.01 to 0.5 $g/m^2$ of the area of the photographic material. In addition, the compound may also be used together with light-insensitive silver halide grains.

If the interlayer effect between the respective layers is too large, the color reproduction range would be narrowed so that color gradation would be lost. On the contrary, if it is too small, the chroma would be extremely degraded. A functional light-sensitive layer (hereinafter referred to as FL), for example, as described in JP-A-61-34541 and JP-A-63-89850 and Japanese Patent Application No. 25287/87 may be provided in the photographic materials so as to broaden the range of the spectral sensitivity distribution and the condition of defining the interlayer effect and also to avoid the above-mentioned defects.

When the photographic material for use in the present invention is a color negative photographic material, it is preferred, depending on the characteristics of the color print photographic material with which the color negative film photographed is to be printed, that the color mixing degree (described in Japanese Patent Application No. 150320/87) is lowered and that the effective spectral sensitivity distribution of each of BL, GL and RL is independent of each other. For this, it is desired to select the yellow coupler, magenta coupler and cyan coupler for use in the photographic material of the present invention in order that the overlapping of the spectral absorption of the colored compounds from the respective couplers with each other is as small as possible.

Various kinds of color couplers may be used in the present invention, and specific examples thereof are described in the patent publications referred to in *Research Disclosure* (RD) No. 17643, VII-C through G. As the dye-forming couplers, those capable of forming three primary colors by the subtractive color process (that is, yellow, magenta and cyan) by color development are important, and specific examples of non-diffusible 4-equivalent or 2-equivalent couplers which may be used in the present invention are described in the patent publications referred to in RD 17643, VII-C and D. In addition, the couplers mentioned below are preferably used in the present invention.

As yellow couplers for use in the present invention, ballast group-containing hydrophobic acylacetamide couplers are typical. Specific examples of the couplers are described in U.S. Pat. Nos. 2,407,210, 2,875,057 and 3,265,506. 2-Equivalent yellow couplers are preferably used in the present invention, and specific examples of the couplers include the oxygen atom-releasing type yellow couplers described in U.S. Pat. Nos. 3,403,194, 3,447,928, 3,933,501 and 4,022,620, and the nitrogen atom-releasing type yellow couplers described in JP-B-58-10739 (the term "JP-B" as used herein means an "examined Japanese patent publication"), U.S. Pat. Nos. 4,401,752 and 4,326,024, RD 18053 (April, 1979), British Patent 1,425,020, West German Patent Application (OLS) Nos. 2,219,917, 2,261,361, 2,329,587 and 2,433,812. α-Pivaoloylacetanilide couplers are excellent in the fastness of the colored dyes, especially in the light-fastness thereof, while α-benzoyl-acetanilide couplers give a high color density.

As magenta couplers which may be used in the present invention, there are ballast group-containing hydrophobic indazolone or cyanoacetyl couplers, preferably 5-pyrazolone and pyrazoloazole couplers. Regarding 5-pyrazolone couplers, those where the 3-position is substituted by an arylamino group or an acylamino group are preferred in view of the hue and the color density of the dyes formed, and specific examples of the couplers are described in U.S. Pat. Nos. 2,311,082, 2,343,703, 2,600,788, 2,908,573, 3,062,653, 3,152,896 and 3,936,015. As the releasing groups for 2-equivalent 5-pyrazolone couplers, the nitrogen atom-releasing groups described in U.S. Pat. No. 4,310,619 and the arylthio groups described in U.S. Pat. No. 4,351,897 are especially preferred. The ballast group-containing 5-pyrazolone couplers described in European Patent 73,636 give a high color density. As pyrazoloazole couplers, there are the pyrazolobenzimidazoles described in U.S. Pat. No. 3,061,432, preferably the pyrazolo[5,1-c][1,2,4]triazoles described in U.S. Pat. No. 3,725,067, the pyrazolotetrazoles described in RD 24200 (June, 1984) and JP-A-60-33552, and the pyrazolopyrazoles described in RD 24230 (June, 1984) and JP-A-60-43659. The imidazo[1,2-b]pyrazoles described in U.S. Pat. No. 4,500,630 are preferred because of the small yellow side-absorption and the high light-fastness of the dyes formed, and the pyrazolo[1,5-b][1,2,4]triazoles described in U.S. Pat. No. 4,540,654 are especially preferred.

As the cyan couplers which may be used in the present invention, there are hydrophobic and non-diffusible naphthol couplers and phenol couplers, and specific examples of the couplers include the naphthol couplers described in U.S. Pat. No. 2,474,293, preferably the oxygen atom-releasing type 2-equivalent naphthol couplers described in U.S. Pat. Nos. 4,052,212, 4,146,396, 4,228,233 and 4,296,200. Examples of phenol couplers are described in U.S. Pat. Nos. 2,369,929, 2,801,171, 2,772,162 and 2,895,826. Couplers forming cyan dyes which are fast to high humidity and temperature are preferably used in the present invention, and as specific examples of such couplers, there are the phenol cyan couplers having an alkyl group with 2 or more carbon atoms at the meta-position of the phenol nucleus described in U.S. Pat. No. 3,772,002, the 2,5-diacylamino-substituted phenol couplers described in U.S. Pat. Nos. 2,772,162, 3,758,308, 4,126,396, 4,334,011 and 4,327,173, West German Patent Application (OLS) No. 3,329,729 and European Patent 121,365, and the phenol couplers having a phenylureido group at the 2-position and an acylamino group at the 5-position described in U.S. Pat. Nos. 3,446,622, 4,333,999, 4,451,559 and 4,427,767. The naphthol cyan couplers having a sulfonamido group or an amido group substituted at the 5-position of the naphthol skeleton described in European Patent 161,626A are also excellent in the fastness of the color images formed, and these may preferably be used in the present invention.

In order to correct the unnecessary absorption of the dyes colored, a colored coupler is preferably incorporated in color photographic materials for picture-taking, for the purpose of masking. Typical examples of colored couplers for the purpose include the yellow-colored magenta couplers described in U.S. Pat. No. 4,163,670 and JP-B-57-39413 and the magenta-colored cyan couplers described in U.S. Pat. Nos. 4,004,929 and 4,138,258 and British Patent 1,146,368. Other colored couplers which may also be used in the present invention are described in RD 17643, VII-G. In addition, the compounds having a group capable of being colored coordinated with a metal as a releasing group described in U.S. Pat. Nos. 4,555,477 and 4,555,478 may also be used in the present invention. The couplers are different from the above-mentioned colored couplers. These are colorless before coupling with the oxidation product of a developing agent. However, after development, the released metal ligand is washed out in the exposed part, and the part is then colored in the hue of the dye formed by coupling; while the metal ligand fixed to the coupler is coordinated with a metal ion (e.g., Fe(II)) in the processing solution in the non-exposed part and the part is correspondingly colored. Accordingly, the lowering of the sensitivity may be suppressed because of the filter effect of the colored coupler. Colored couplers of this type are preferably used in the present invention. The photographic materials containing the coupler may be processed in accordance with a conventional development procedure, or alternatively, these may also be processed with a processing procedure having a particular bath containing an additional metal ion. The metal ions for the purpose include Fe(II), Co(II), Cu(I), Cu(II) and Ru(II), and Fe(II) is especially preferably used.

In accordance with the present invention, couplers capable of forming dyes having appropriate diffusibility may be incorporated into the photographic materials so as to improve the graininess of the materials. As examples of such couplers, U.S. Pat. No. 4,366,237 and British Patent 2,125,570 mention examples of magenta couplers, and European Patent 96,570 and West German Patent Application (OLS) No. 3,234,533 mention examples of yellow couplers, magenta couplers and cyan couplers.

The dye-forming couplers and the above-mentioned particular couplers for use in the present invention may be in the form of dimers or higher polymers. Specific examples of polymerized dye-forming couplers are described in U.S. Pat. Nos. 3,451,820 and 4,080,211. Specific examples of polymerized magenta couplers are described in British Patent 2,102,173 and U.S. Pat. No. 4,367,282.

Couplers which may release a photographically useful group by coupling may also preferably be used in the present invention. As DIR couplers of releasing a development inhibitor for use in the present invention, the couplers described in the patent publications referred to in RD 17643, VII-F are useful.

Examples of DIR couplers which are preferably used in combination with the present invention include the developer-deactivating type DIR couplers described in JP-A-57-151944, the timing type DIR couplers described in U.S. Pat. No. 4,248,962 and JP-A-57-154234, and the reactive type DIR couplers described in JP-A-60-184248; and the developer-deactivating type DIR couplers described in JP-A-57-151944, JP-A-58-217932, JP-A-60-218644, JP-A-60-225156 and JP-A-60-233650, and the reactive type DIR couplers described in JP-A-60-184248 are especially preferred.

Among the magenta couplers for use in the present invention, those represented by formula (V) are especially preferred. The pyrazoloazole couplers for use in the present invention are 2-equivalent couplers, and these may be used in a smaller amount as compared with the amount of the silver halide used. In addition, these are advantageous as having a small side-absorption, especially in the short wavelength region. Accordingly, not only the amount of the colored magenta coupler may be small but also the interlayer effect from the blue-sensitive layer or the interlayer effect to the red-sensitive layer may easily be attained by the use of these couplers. In addition, these are advantageous for satisfying the spectral sensitivity distribution that the value of $D_G/D_B$ or $D_R/D_G$ is negative, for improving the color reproducibility of photographic materials.

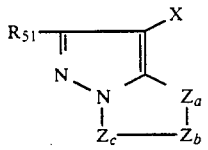

(V)

in which $R_{51}$ represents hydrogen or a substituent, preferably an alkyl group (e.g., methyl, ethyl, butyl), a branched alkyl group (e.g., isopropyl, isobutyl, tert-butyl), a substituted alkyl group (inclusive of a branched group), an alkoxy group (e.g., methoxy, ethoxy, butoxy), a substituted alkoxy group (e.g., ethoxyethoxy, phenoxyethoxy), an aryloxy group (e.g., phenoxy) or a ureido group, especially preferably a branched alkyl group or an alkoxy group. X represents hydrogen or a group capable of being released by a coupling reaction with the oxidation product of an aromatic primary amine color developing agent, including a halogen atom (e.g., chlorine, bromine), an arylthio group (e.g., 2-butoxy-5-tert-octylphenylthio, 2-propoxy-5-tert-hexylphenylthio), a nitrogen-containing heterocyclic group (e.g., imidazole, 4-chloroimidazole), and an aryloxy group (e.g., p-methylphenoxy, 2,4-dimethylphenoxy, 2,4-dimethyl-tert-phenoxy). Among them, a halogen atom and an arylthio group are especially preferred. Za, Zb and Zc, which may be the same or different, each represents a methine group, a substituted methine group, =N— or —NH—; provided that one of the Za-Zb bond and the Zb-Zc bond is a double bond and the other is a single bond. When Za-Zb is a carbon-carbon double bond, this may be a part of an aromatic ring. The compounds of the formula (V) may be in the form of dimers or higher polymers at the position of $R_{51}$ or X. When Za, Zb or Zc represents a substituted methine group, the compounds of the formula (V) may also form a dimer or a higher polymer via the substituted methine group. When Za, Zb or Zc represents a substituted methine group, the substituent for the group is preferably a substituted alkyl group, especially preferably a branched substituted alkyl group (e.g., substituted isopropyl, substituted tert-butyl).

Examples of pyrazoloazole couplers for use in the present invention are described below, but the present invention is not to be construed as being limited thereto.

V-(1)

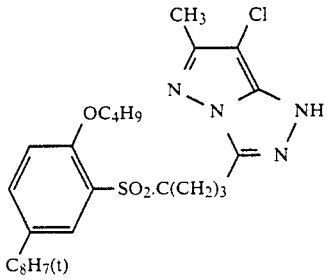

V-(2)

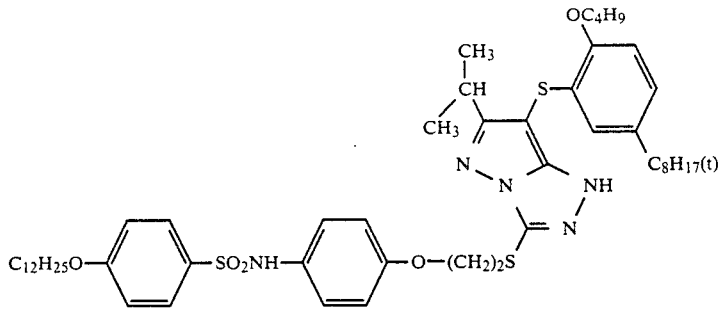

V-(3)

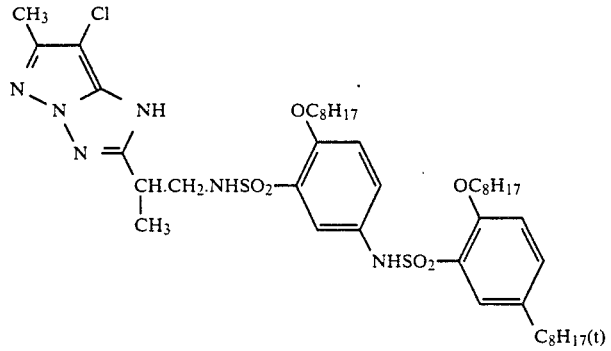

-continued

V-(4)

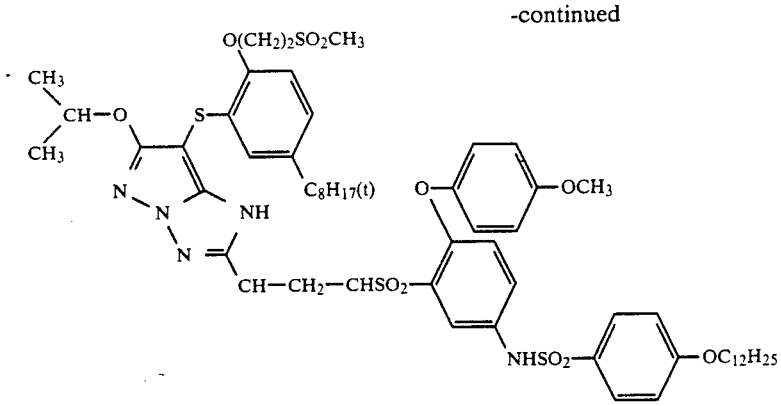

V-(5)

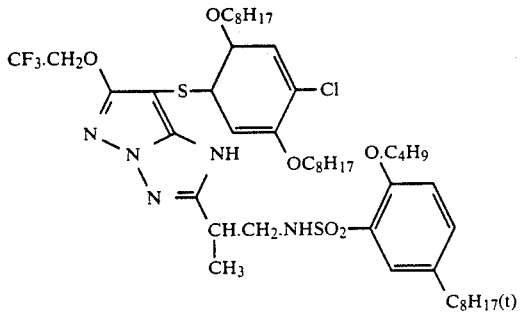

Any silver halide of silver bromide, silver iodobromide, silver iodochlorobromide, silver chlorobromide and silver chloride may be used in the photographic emulsion layers in the photographic material for use in the present invention. Preferred is silver iodobromide or silver iodochlorobromide containing about 30 mol % or less of silver iodide, as a silver halide for use in the present invention. Especially preferred is silver iodobromide containing from about 2 mol % to about 25 mol % of silver iodide.

The silver halide grains in the photographic emulsion may be regular grains having a regular crystalline form such as a cubic, octahedral or tetradecahedral crystalline form, and may also be irregular grains having a spherical or similar irregular crystalline form, tabular grains, grains having a twin plane or other crystal defect or composite grains having different phase structures.

Regarding the grain size of the silver halide grains, the grains may be fine grains having a grain size of about 0.1 μm or less or may also be large grains having a projected area diameter of up to about 10 μm. The emulsion may be a monodisperse emulsion having a narrow grain size distribution or a polydisperse emulsion having a broad grain size distribution.

The silver halide emulsion for use in the present invention may be prepared by known methods, for example, in accordance with the methods described in RD 17643 (December, 1978), pages 22 to 23, "I. Emulsion Preparation and Types", and RD 18716 (November, 1979), page 648.

Further, the photographic emulsion for use in the present invention may also be prepared by the methods described in P. Glafkides, *Chimie et Physique Photographique* (published by Paul Montel, 1967), G. F. Duffin, *Photographic Emulsion Chemistry* (published by focal Press, 1966) and V. L. Zelikman et al, *Making and Coating Photographic Emulsion* (published by Focal Press, 1964). For example, any of an acid method, a neutralization method and an ammonia method may be employed. As a method of reacting a soluble silver salt and soluble halide(s), a single jet method, a double jet method or a combination thereof may be used. A reverse mixing method capable of forming silver halide grains in the presence of excess silver ions can also be employed. As one system of the double jet method, a controlled double jet method of keeping a constant pAg in the liquid phase for forming silver halide grains can also be employed. According to this method, a silver halide emulsion containing silver halide grains having a regular crystal form and almost uniform grain sizes can be obtained.

Two or more different silver halide emulsions individually prepared may be blended and the resulting blend may also be used in the present invention.

The above-mentioned regular-grains silver halide emulsion may be obtained by properly controlling the pAg and pH values in the formation of the grains, as described in Photographic Science and Engineering, Vol. 6, pages 159 to 165 (1962), *Journal of Photographic Science*, Vol. 12, pages 242 to 251 (1964), U.S. Pat. No. 3,655,394 and British Patent 1,413,748.

As a monodisperse emulsion, an emulsion which contains silver halide grains having a larger mean grain size of about 0.1 μm and in which at least about 95% by weight of the total grains have a grain size falling within the range of the mean grain size ±40% is typical. A monodisperse emulsion containing silver halide grains having a mean grain size of from about 0.25 to about 2 μm and in which at least about 95% by weight or by number of the total grains have a grain size falling within the range of the mean grain size ±20% can be used in the present invention. Methods for preparing such emulsions are described in U.S. Pat. Nos. 3,574,628 and 3,655,394 and British Patent 1,413,748. In addition, the monodisperse emulsions described in JP-A-48-8600, JP-A-51-39027, JP-A-51-83097, JP-A-53-137133, JP-A-

54-48521, JP-A-54-99419, JP-A-58-37635 and JP-A-58-49938 may be used in the present invention.

Further, tabular grains having an aspect ratio of about 5 or more may also be used in the present invention. Tabular grains may easily be prepared by the methods described in Gutoff, *Photographic Science and Engineering*, Vol. 14, pages 248 to 257 (1970), U.S. Pat. Nos. 4,434,226, 4,414,310, 4,433,048 and 4,439,520 and British Patent 2,112,157. Use of tabular grains is advantageous for the improvement of the color-sensitizing efficiency by sensitizing dyes, the improvement of the graininess of emulsion and the increase of the sharpness of photographic material, as described in detail in U.S. Pat. No. 4,434,226.

The crystal structure of the silver halide grains for use in the present invention may be uniform, or the inside part and the outside part of the grains may have different halogen compositions, or the grains may have a layered structure. Silver halide grains of various crystal structures which may used in the photographic emulsions are illustrated in British Patent 1,027,146, U.S. Pat. Nos. 3,505,068 and 4,444,877 and JP-A-60-143331. In addition, sliver halide grains having different compositions by epitaxial junction or silver halide grains containing other compounds than silver halides, such as silver thiocyanate or lead oxide, linked by junction may also be used in the present invention. These grains are illustrated in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067 and JP-A-59-162540.

A mixture of grains having various crystalline forms may also be used in the present invention.

The emulsion for use in the present invention is generally subjected to physical ripening, chemical ripening and spectral sensitization before use. Additives which may be used in these steps are described in RD 17643 and RD 18716, and the relevant parts relating to the additives are summarized in the Table below.

In addition, known photographic additives which may be used in the present invention are also described in these two *Research Disclosures*, and as shown in the same Table.

| Kinds of additives | RD 17643 | RD 18716 |
|---|---|---|
| 1. Chemical Sensitizer | p. 23 | p. 648, right column |
| 2. Sensitivity-enhancer | | " |
| 3. Spectral Sensitizer<br>Supersensitizer | pp. 23–24 | from p. 648, right column to p. 649, right column |
| 4. Whitening Agent | p. 24 | |
| 5. Antifoggant<br>Stabilizer | pp. 24–25 | p. 649, right column |
| 6. Light Absorbent<br>Filter Dye<br>UV Absorbent | pp. 25–26 | from p. 649, right column to p. 650, left column |
| 7. Stain Inhibitor | p. 25, right column | p. 650, from left to right column |
| 8. Color Image Stabilizer | p. 25 | |
| 9. Hardening Agent | p. 26 | p. 651, left column |
| 10. Binder | p. 26 | " |
| 11. Plasticizer<br>Lubricant | p. 27 | p. 650, right column |
| 12. Coating Aid<br>Surfactant | pp. 26–27 | " |
| 13. Antistatic Agent | p. 27 | " |

The silver halide emulsion for use in the present invention preferably contains (a) corner-developing type silver halide grains (CDG) and/or (b) edge-developing type silver halide grains (EDG) in a proportion of at least 50% by number of the total silver halide grains in the emulsion which are started to be developed with the following typical color developer or with a practical color developer. The corner-developing type grains (CDG) as used herein means silver halide grains which are so controlled as to be developed from the corner of the edges of the grain or near the corner, when these are developed with the following typical color developer or with a commercial color developer; and the edge-developing type grains (DEG) as used herein means silver halide grains which are so controlled as to be developed from the edges of the grain or near the edges, when these are developed with the same developer. The CDG- and/or EDG-containing emulsion has a rapid development-proceeding property that the gradation may rapidly be finished and then its sensitometric curve tends to shift toward higher sensitivity in parallel and, additionally, with small variation from the desired reciprocity law characteristics for the sensitivity, to provide a stable final quality in the images formed, and accordingly, the emulsion of the type has extremely advantageous photographic properties for the present invention.

Specifically, the term "corner-developing type grains" (CDG) as used in the present invention means silver halide grains which are so controlled that may be developed from the corner of the grain and/or from the part near the corner thereof when a photographic material formed by coating an emulsion which contains the grains on a support is developed.

Also, the term "edge-developing type grains" (EDG) as used in the present invention means silver halide grains which are so controlled that may be developed from the edges of the grain and/or from the part near the edges thereof when a photographic material formed by coating an emulsion which contains the grains on a support is developed.

The grains at the beginning of development have a development-starting point at the corner of the grain, at the edges of the grain and/or at the part near the corner or the edges of the grain, in a proportion of 50% by number or more, especially preferably 80% by number or more, of the total grains at the beginning of development.

For determination of the development-starting point in silver halide grains, the following method may be used. A photographic emulsion containing silver halide grains to be tested is coated on a support to prepare a photographic material. This is developed with a developer under a determined condition to obtain a characteristic curve of the emulsion. An exposure corresponding to the value of (maximum density - minimum density)×¾ of the silver image formed is obtained. The photographic material is then exposed with a light for the thus obtained exposure or with a light for 100 times of the said exposure.

The thus exposed materials are initially developed with a developer having substantially the same liquid composition and then stopped with an aqueous 5% glacial acid solution. After the development, the silver halide grains are observed with an electromicroscope thereby to specify the development-starting point in the silver halide grains observed.

The corner of silver halide grains and the part near the corner thereof as well as the edges of silver halide grains and the part near the edges thereof means the parts which are crystallographically determined to be substantially the corner or edges of the grains or the parts near the said corner or edges of the grains, irrespective of the normal crystals (octahedral, tetradecahedral or tetracosahedral crystals), twin plane crystals, tabular multi-layered twin crystals, roundish grains or conjugated grains. The "part near the corner or edges of grains" means the area of a square formed by four edges and angles where length of one edge corresponds to about ⅓, preferably ¼, of the diameter of the circle of the projected area of the grain and the angle corresponds to the corner of the grain, or means the area of a rectangle as surrounded with the edge and additional lines each having a length which corresponds to the length of about ⅓, preferably ¼, of the diameter of the circle of the projected area of the grain. More preferably, the length of one edge for the former or of one line for the latter is about 1/5 of the diameter of the circle of the projected area of the grain.

The developer to be used for observation of the development-starting point is preferably one which may substantially be applied to the photographic material having CDG or EDG grains or one which has the same liquid composition as the substantially applicable developer. If desired, the developer may be diluted to about 50 times, before use, so as to facilitate the observation. The developing temperature is preferably a temperature which is substantially same as that in practical development. As the developer which may be used for the observation, the developer having the following composition may be used. That is, the following developer may be used for determination of CDG or EDG grains.

| For Color Photographic Materials: | |
|---|---|
| Diethylenetriamine-pentaacetic Acid | 1.0 g |
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 3-Methyl-4-amino-N-ethyl-N-β-hydroxyethylaniline Sulfate | 4.5 g |
| Water to make | 1.0 liter |
| | pH 10.05 |
| For Black-and-white Photographic Materials: | |
| Metol | 2.0 g |
| Sodium Sulfite | 100 g |
| Hydroquinone | 5.0 g |
| Borax $5H_2O$ | 1.53 g |
| Water to make | 1000 ml |
| | pH 8.60 |

In CDG emulsion (CDG-containing emulsion) or EDG emulsion (EDG-containing emulsion), corner development and edge development may predominantly proceed, or corner development may predominantly proceed. The essential characteristic of the CDG emulsion or EDG emulsion is that the formation of the silver halide crystals (for example, by growth, ripening or halogen conversion) in the emulsion and the chemical ripening thereof are so controlled that the development-starting point may be selectively centralized in a particular site on the surface of the silver halide grain and additionally so controlled that the development-starting point of the silver halide grains as contained in the emulsions of the same manufacture lot number may be selectively centralized in particular sites such as corner and/or edges of the grains.

The first factor associated with the controlling of the development-starting point in the CDG emulsion or EDG emulsion for use in the present invention is the crystal habit of the silver halide grains in the emulsion. The shape of the silver halide grains is not an important factor. However, generally easily obtainable grains are substantially normal crystal grains (e.g., octahedral, tetradecahedral grains), tabular grains, multi-layered twin plane tabular grains and tabular grains grown by junction. The second factor is the halogen composition of the silver halide grains and the structure of the grains. The third factor is that the formation of the surfaces of the silver halide grains and the site for chemical sensitization in the grains are controlled by introducing a CR-compound on the surface of silver halide grains whereby the site and the number of the light-sensitive nuclei are accordingly controlled. The fourth factor is the developer to be used and the development conditions.

The term "CR-compound" as used herein means, as described in Japanese Patent Application Nos. 311131/86, 86163/87 and 152330/87, a compound which is adsorbed to silver halide grains during or before chemical sensitization of the grains so as to inhibit halogen conversion or chemical sensitization, whereby the number or the site of the latent image or development center are centralized and controlled in corner, edges or other particular sites.

Although varying in accordance with the halogen composition of silver halide grains as well as the halogen ion concentration, the ion electroconductivity and the pH value in the silver halide grain-containing emulsion, the CR-compound may be selected, for example, from azoles, such as benzothiazolium salts, nitroindazoles, triazoles, benzotriazoles, benzimidazoles (especially nitro- or halogen-substituted derivatives); heterocyclic mercapto compounds, such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; the above-mentioned heterocyclic mercapto compounds having a water-soluble group such as a carboxyl group or a sulfone group; thioketo compounds such as oxazolinethiones; azaindenes such as tetrazaindenes (especially 4-hydroxy substituted (1,3,3a,7)tetrazaindenes); benzenethiosulfonic acids; and benzenesulfinic acids.

As preferred natural substances, there are nucleic acid and their derivatives and adenines. Further, the sensitizing dyes of the formulae (II), (III) and (IV) may also be used as CR-compounds. These are added to the photographic emulsion before chemical sensitization of the emulsion, whereupon the amount to be added is properly controlled.

The photographic materials for use in the present invention may have various additives which are generally added to conventional photographic materials. For example, the additives usable in the invention are described in U.S. Pat. Nos. 4,540,654, 4,599,301, 4,607,002, 4,327,173 and 4,430,423 and JP-A-63-17448 and JP-A-63-118157 and publications as referred to in these patent specifications. For instance, a color image-stabilizer, a color mixing preventing agent, ultraviolet absorbent, stain inhibitor, color-fogging inhibitor, dye, color development accelerator, inhibitor for initiation of conversion of crystal planes (CR-compound), whitening agent, surfactant, mordant agent, binder (e.g., lime-processed gelatin, acid-processed gelatin or water-soluble polymer) and similar additives may be added to light-sensitive emulsion layers, anti-halation layer (AH), backing layer (BL), interlayer (ML), as well as functional light-sensitive layer (FL) as described in JP-A-61-201245 and Japanese Patent Application No. 25287/87, filter layer (YF) and protective layer (PL).

Examples of the layer constitution of photographic materials are described, for example, in JP-B-49-15495, JP-B-55-34932, JP-B-53-37017, JP-B-53-37018, JP-A-59-177551, JP-A-59-160135, JP-A-59-177552, JP-A-59-180555, JP-A-59-180556, JP-A-59-182451, JP-A-59-204038, U.S. Pat. Nos. 4,184,876, 4,129,446, 4,186,016, 4,186,011, 4,267,264, 4,173,479, 4,157,917, 4,165,236, British Patents 1,560,965, 2,138,962, 2,137,372 and JP-A-63-89850.

A protective layer is provided on the photographic material for use in the present invention, which has a thickness of preferably from 0.5 μm to 5 μm. Especially preferably, the following element (1) and either or both of the following elements (2) and (3) are incorporated into the protective layer of the invention.

(1) A hardening agent having formula (VII) is added so as to harden the protective layer itself or an other layer.

(2) A dispersion of a water-insoluble and organic solvent-soluble polymer is used so as to incorporate an ultraviolet absorbent, an image-stabilizer or a mordanting agent into the protective layer.

(3) Vinyl polymer latex grains or fine inorganic grains are incorporated in the protective layer. Preferably, two or more grains having different mean grain sizes are incorporated together. As a fine inorganic powder, silica gel powder is preferred.

The hardening agent for use in the present invention is preferably selected from the compounds represented by formula (VII). In addition, active halogen compounds (e.g., 2,4-dichloro-6-hydroxy-1,3,5-triazine) may be used.

$$CH_2{=}CHSO_2{-}\left(\begin{matrix}R_1\\|\\CH\end{matrix}\right)_m{-}Z{-}\left(\begin{matrix}R_2\\|\\CH\end{matrix}\right)_n{-}SO_2{-}CH{=}CH_2 \quad \text{(VII)}$$

in which $R_1$ and $R_2$, which may be same or different, each represents hydrogen, a hydroxyl group or a substituted or unsubstituted alkyl group (e.g., methyl, ethyl, isopropyl, hydroxyethyl); Z represents a bond or a divalent group, such as a non-metallic atom (e.g., oxygen, sulfur), a substituted or unsubstituted divalent amino group or an alkylene group containing the same (e.g., ethylenedioxy); and n and m, which may be same or different, each is an integer of from 1 to 8.

For example, the compounds described in Examples 1 to 6 in JP-B-47-24259, Synthesis Examples in JP-B-49-13563 and of Examples compounds in JP-B-57-24902 may be used.

Flexible supports which are usable in the present invention include for example, semi-synthetic or synthetic films of cellulose nitrate, cellulose acetate, cellulose acetate butyrate, polystyrene, polyvinyl chloride, polyethylene terephthalate or polycarbonate. The support may be colored with a dye or pigment. This may be blackened for the purpose of light-shielding. The surface of the support is generally coated with a subbing layer so as to improve adhesion with photographic emulsion layers to be provided thereon. Before or after coating with a subbing layer, the surface of the support may be treated by glow discharge, corona discharge, ultraviolet irradiation or flame treatment.

The color developer to be used for development of the photographic material of the present invention is an aqueous alkaline solution consisting mainly of an aromatic primary amine color developing agent. As the aromatic primary amine color developing agent, aminophenol compounds are usable, but in general, p-phenylenediamine compounds are suitable. Examples of the compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates, p-toluenesulfonates, tetraphenylborates and p-(t-octyl)benzenesulfonates.

Compounds which have an especially high developing speed and have a small variation of the developing activity even when used for development procedure with a small amount of replenishment are preferably used for the photographic material of the present invention for simple and rapid color development. Specifically, the developing agents represented by formula (VI) are preferred. 3-methyl-4-amino-N-ethyl-N-β-hydroxyethylaniline is one typical example of the agents.

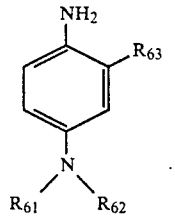

(VI)

In formula (VI), $R_{61}$ represents hydrogen, an alkyl group (preferably having from 1 to 6 carbon atoms) or $R_{62}$; $R_{62}$ represents $-(R_{64}O)_m-(R_{65}O)_n-R_{66}$; $R_{64}$ and $R_{65}$, which may be same or different, each represents an alkylene group (preferably having from 1 to 4 carbon atoms); m and n each is 0 or an integer of from 1 to 4, provided that at least one of m and n is an integer of from 1 to 4. $R_{66}$ represents hydrogen, an aryl group (preferably having from 6 to 8 carbon atoms) or an alkyl group (preferably having from 1 to 6 carbon atoms).

$R_{63}$ represents hydrogen, a halogen atom, an alkyl group, a hydroxyl group, an alkoxy group, an alkylsulfonamido group, an acylamido group or an amino group. $R_{63}$ preferably has from 1 to 4 carbon atoms.

The color developing agent mentioned above is generally used in an amount of from 1 g to 30 g, preferably from 2 g to 20 g, especially preferably from 3 g to 10 g, per liter of the color developer.

The compounds of formula (VI) and other color developing agents are used singly in most cases, but if desired, these may be used in combination optionally together with any other color developing agents of different kinds. The color developer preferably contains a pH buffer such as alkali metal carbonates, borates or phosphates; a development inhibitor or an antifoggant such as chlorides, bromides, iodides, benzimidazoles, benzothiazoles or mercapto compounds; a preservative such as hydroxylamine, diethylhydroxylamine, triethanolamine, the compounds described in West German Patent Application (OLS) No. 2,622,950, the compounds described in EP-A-266797, sulfites or bisulfites; and the restoring agent or trapping agent for the oxidation product of the color developing agent in the developer described in JP-A-63-113537. In addition, the color developer may also contain an organic solvent such as diethylene glycol; a development accelerator such as benzyl alcohol, polyethylene glycol, quaternary ammonium salts, amines, thiocyanates, 3,6-thiaoctane-1,8-diol; a competing coupler; an auxiliary developing agent such as 1-phenyl-3-pyrazolidone; a tackifier; and a chelating agent such as ethylenediaminetetraacetic acid, nitrilo-triacetic acid, cyclohexadiaminetetraacetic acid, imino-diacetic acid, hydroxyethyliminodiacetic acid, N-hydroxymethylethylenediamine-triacetic acid, diethylenetriamine-pentaacetic acid, triethylenetetramine-hexaacetic acid, as well as aminopolycarboxylic acids (e.g., the compounds described in JP-A-58-195845), 1-hydroxyethylidene-1,1'-diphosphonic acid, the organic phosphonic acids described in RD 18170 (May, 1979), aminophosphonic acids (e.g., amino-tris(methylenephosphonic acid)ethylenediamine-N,N,N',N'-tetramethylenephosphonic acid, and the phosphonocarboxylic acids described in JP-A-52-102726, JP-A-53-42730, JP-A-54-121127, JP-A-55-4024, JP-A-55-4025, JP-A-55-126341, JP-A-55-65955, JP-A-55-65956 and RD 18710 (May, 1979).

The color developer generally has a pH value of from 8 to 13, preferably from 9 to 12, especially preferably from 9.5 to 11.5. The temperature range for color development is generally from 25° to 50° C., preferably from 30° to 50° C., especially preferably from 35° to 45° C., in view of rapid development.

For processing the photographic material of the present invention, the color developer preferably contains a water-soluble chloride in an amount of from $1\times10^{-3}$ mol/liter to $2\times10^{-1}$ mol/liter, especially preferably from $5\times10^{-3}$ mol/liter to $5\times10^{-2}$ mol/liter. As the water-soluble chloride to be used for the purpose, potassium chloride or sodium chloride is preferred.

When the photographic material of the present invention is processed continuously, the color developer may be used continuously by adding a replenisher thereto. The amount of the replenisher is preferably from 1 to 10 ml per 100 $cm^2$ of the photographic material processed. In addition, the developer may also preferably contain a water-soluble bromide in an amount of from $3\times10^{-3}$ mol/liter to $3\times10^{-2}$ mol/liter for the purpose of prevention of fogging. As examples of the water-soluble bromide for the purpose, potassium bromide and sodium bromide are preferred.

For processing the photographic material of the present invention, a color developer which does not substantially contain an iodide ion is preferably used. The color developer "which does not substantially contain an iodide ion" means that the content of iodide ion in the developer is 1.0 mg/liter or less.

The color developer for use in the present invention preferably contains no sulfite, provided that the aerial oxdation of the developer may be prevented and the preservation of the developer may be maintained. In the developer, the content of sulfurous acid anhydride is preferably 4 g or less, more preferably 2 g or less, especially preferably 1 g or less, per liter of the developer, whereby the color density of images formed may be improved.

The processing time with the color developer mentioned above may be from 10 seconds to 3 minutes, preferably from 10 seconds to 2 minutes, especially preferably from 20 seconds to 1 minute and 30 seconds.

The photographic material of the present invention after color-development is, desilvered. For desilvering, any of a method of using two baths of a bleaching solution and a fixing solution, the method of using two baths of a bleaching solution and a bleach-fixing solution described in JP-A-61-75352, the method of using two baths of a fixing solution and a bleach-fixing solution described in JP-A-61-51143 and a method of using one bleach-fixing solution bath may be employed. However, in view of simple and rapid processing, the photographic material of the present invention is preferably processed in a single bath or plural baths of a bleach-fixing solution.

As the bleaching agent to be used in the bleaching solution or bleach-fixing solution, there may be mentioned ferric salts, persulfates, bichromates, bromates, red prussiate and aminopolycarboxylic acid/ferric complex salts. In particular, aminopolycarboxylic acid/ferric complex salts are preferred for the photographic material of the present invention.

The concentration of the aminopolycarboxylic acid/ferric complex salt in the bleaching solution or bleach-fixing solution for use in the present invention is from 0.05 to 1 mol/liter, preferably from 0.1 to 1 mol/liter, especially preferably from 0.1 to 0.5 mol/liter.

The bleaching solution or bleach-fixing solution may contain a bleaching accelerator, if desired. Specific examples of useful bleaching accelerators include the mercapto group- or disulfide group-containing compounds described in U.S. Pat. No. 3,893,858, West German Patents 1,290,812, 2,059,988, JP-A-53-32736, JP-A-53-57831, JP-A-53-37418, JP A-53-65732, JP-A-53-72623, JP-A-53-95630, JP-A-53-95631, JP-A-53-104232, JP-A-53-124424, JP-A-53-141623, JP-A-53-28426, RD 17129 (July, 1978) as well as a rehalogenating agent such as bromides (e.g., potassium bromide, sodium bromide, ammonium bromide), chlorides (e.g., potassium chloride, sodium chloride, ammonium chloride) or iodides (e.g., ammonium iodide). In addition, the solution may further contain, if desired, one or more inorganic acids, organic acids and alkali metal or ammonium salts of these acids, such as boric acid, borax, sodium metaborate, acetic acid, sodium acetate, sodium carbonate, potassium carbonate, phosphorous acid, phosphoric acid, sodium phosphate, citric acid, sodium citrate or tartaric acid, as well as a corrosion inhibitor such as ammonium nitrate or guanidine.

The fixing agent to be used in the bleach-fixing solution or fixing solution for use in the present invention may be selected from known fixing agents. For example, usable fixing agents are water-soluble silver halide-solubilizers, which include thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol, or thioureas. Specifically, the thiazolidine derivatives described in JP-A-50-140129; the thiourea derivatives described in JP-B-45-8506, JP-A-52-20832 and JP-A-53-32735 and U.S. Pat. No. 3,706,561; the iodides described in West German Patent 1,127,715 and JP-A-58-16235; the polyethyleneoxides described in West German Patents 966,410 and 2,748,430; the polyamine compounds described in JP-B-45-8836; the compounds described in JP-A-49-42434, JP-A-49-59644, JP-A-53-94927, JP-A-54-35727, JP-A-55-26506 and JP-A-58-163940, as well as iodide ions and bromide ions can be used as the fixing agent. Above all, mercapto group- or disulfide group-containing compounds are especially preferred, as having a large development-accelerating capacity. In particular, the compounds described in U.S. Pat. No. 3,893,858, West German Patent 1,290,812 and JP-A-53-95630 are especially preferred.

In addition, the bleaching solution or bleach-fixing solution may contain one or more bromides (e.g., potassium bromide, sodium bromide), singly or in combination. In the present invention, thiosulfates (especially ammonium thiosulfate) are preferably used.

The amount of the fixing agent is preferably from 0.3 to 2 mols, especially preferably from 0.8 to 1.5 mols, per liter of the solution.

The pH range of the bleach-fixing solution or fixing solution is preferably from 3 to 10, especially preferably from 5 to 9. If the pH value of the solution is lower than this limit, the solution would rapidly be deteriorated thereby to accelerate the formation of leuco dyes from cyan dyes, although the desilvering property of the solution could be improved. If the pH value is higher than this limit, the desilvering speed would be lowered so that the material processed would easily be stained. The pH value of the bleaching solution is generally from 4 to 7, preferably from 4.5 to 6.5. If the pH value of the solution is lower than 4, cyan dyes would be converted into leuco dyes, but if the pH value thereof is more than 7, the desilvering speed would be lowered.

The bleach-fixing solution or fixing solution contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite) or the like. The content of this compound in the solution is preferably from about 0.02 to about 0.50 mol/liter, more preferably from 0.04 to 0.40 mol/liter, as sulfite ion.

As the preservative, addition of a sulfite is general, but ascorbic acid, carbonyl-bisulfite adducts or carbonyl compounds may also be used.

The temperature in the desilvering step is preferably as high as possible, provided that the gelatin film of the photographic material being processed would not be undesirably softened or the processing solution would not be deteriorated. Specifically, the temperature which generally falls within the range of from 30° to 50° C. The time for the desilvering step is, although somewhat varying in accordance with the desilvering method employed, generally 4 minutes or less, preferably form 30 seconds to 3 minutes.

The photographic material of the present invention is, after being desilvered by fixation or bleach-fixation, generally rinsed and/or stabilized.

The amount of the rinsing water in the rinsing step may be determined in a broad range, in accordance with the properties (e.g., couplers and other materials used) or use of the photographic material being processed, the temperature of the rinsing water, the number of the rinsing tanks (rinsing stages), the replenishment system (normal current or countercurrent) and other various conditions. Among them, the relation between the number of the rinsing tanks and the amount of the rinsing water in a multi-stage countercurrent rinsing system may be obtained by the method described in *Journal of the Society of Motion Picture and Television Engineers*, Vol. 64, pages 248 to 253 (May, 1955). In general, the number of the rinsing stages in a multi-stage countercurrent system is from 2 to 6, preferably from 2 to 4.

In accordance with the multi-stage countercurrent rinsing system, the amount of the rinsing water to be used may noticeably be reduced, and for example, the amount may be from 0.5 liter to one liter or less per $m^2$ of the photographic material as being processed. However, bacteria would propapage because of the increased residence time of the rinsing water in the rinsing tank, and the floating substances formed from the thus-propagated bacteria would undesirably adhere to the photographic material being processed. In order to avoid this problem, the method of reducing the content of calcium and magnesium in the rinsing water described in JP-A-62-288838 may effectively be used for processing the color photographic material of the present invention. In addition, the isothiazolone compounds and thiabendazoles described in JP-A-57-8542; the chlorine bactericides described in JP-A-61-120145 (e.g., sodium chloroisocyanurate); the benzotriazoles described in JP-A-61-267761; and the bactericides and fungicides described in H. Horiguchi, Chemistry of Bactericides and Fungicides, and Bactericidal and Fungicidal techniques to Microorganisms, edited by Association of Sanitary Technique, Japan, and Encyclopeadia of Bactercidial and Fungicidal Agents, edited by Nippon Bactericide and Fungicide Association can also be used.

In addition, a surfactant, as a water-cutting agent, as well as a chelating agent such as EDTA, as a water softener, can also be added to the rinsing water.

The pH value of the rinsing water to be used for processing the photographic material of the present invention is from 4 to 9, preferably from 5 to 8. The temperature of the rinsing water and the rinsing time can also be set variously in accordance with the properties of the photographic material being processed and the use thereof, and in general, the temperature is from 15° to 45° C. and the time is from 20 seconds to 10 minutes, and preferably, the temperature is from 25° to 40° C. and the time is from 30 seconds to 5 minutes.

Following the rinsing step, the material can be processed with a stabilizer solution, or alternatively, the material can directly be processed with a stabilizer solution without the rinsing step. To the stabilizer solution can be added a compound having an image stabilizing function. For example, aldehyde compounds such as formalin, buffers for adjusting to the film pH value suitable for image stabilization as well as ammonium compounds can be added to the stabilizer solution. In addition, the above-mentioned various bactericides and fungicides can also be added to the stabilizer solution so as to prevent the propagation of bacteria in the solution or to impart a fungicidal capacity to the photographic material after processed.

Further, a surfactant, a brightening agent and a hardener can also be added to the stabilizer solution. For processing the photographic material of the present invention, when the stabilization step is directly carried out without the water-rinsing step, any known method, for example, the methods described in JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749 can be utilized.

In addition, a chelating agent such as 1-hydroxyethylidene-1,1-diphosphonic acid or ethylenediaminetetramethylene-phosphonic acid, as well as a bismuth compound can also be preferably used.

The solution used in the water-rinsing and/or stabilization step(s) can be used again in the previous step. As an example, there may be mentioned a process in which the overflow of the rinsing water, the amount of which has been reduced in the multi-stage countercurrent system, is fed to the previous bleach-fixing bath and a fresh concentrated solution is replenished into the bleach-fixing bath so as to decrease the amount of the resulting waste drainage.

For processing the photographic material of the present invention, a processing replenisher is replenished to the processing bath so as to replenish the components of the processing solution consumed by processing and to remove any possible drawbacks caused by the components dissolved out from the photographic material being processed. In addition, it is also desired to correct the variation of the composition of the developer by aerial oxidation, because of the addition of the developer replenisher. It is possible to reduce the amount of the replenisher so as to reduce the amount of the resulting waste drainage. In particular, the overflow solution from the water-rinsing step or stabilization step is preferably fed to the previous bath, as mentioned above, and further, the overflow solution from the developer bath may also be utilized in the bleach-fixing bath.

The development-processing time for the photographic material of the present invention may be about one to 5 minutes, from the initiation of development to the completion of drying. Preferably, the time is 1 to 3.5 minutes, more preferably within 120 seconds.

The preferred embodiments of the present invention are shown below.

1. A photographic material package unit comprising a container sealed to ambient light containing a silver halide color light-sensitive film, said container having a shutter means for admitting a predetermined amount of light to said container and a lens for forming an image on said film using said light admitted by said shutter means; said color film comprising a support having thereon:

(a) at least one blue-sensitive silver halide emulsion layer containing a yellow coupler and having a spectral sensitivity distribution with a maximum spectral sensitivity of from 406 nm to 480 nm, the ditribution within 80% of the maximum value being in a range of from 400 nm to 500 nm;

(b) at least one green-sensitive silver halide emulsion layer containing a magenta coupler and having a spectral sensitivity distribution with a maximum spectral sensitivity of from 527 nm to 580 nm, at least 80% of the maximum value being in a range of from 500 nm to 600 nm;

(c) at least one red-sensitive silver halide emulsion layer containing a cyan coupler and having a spectral sensitivity distribution with a maximum spectral sensitivity of from 595 nm to 640 nm, at least 80% of the maximum value being in a range of from 575 nm to 650 nm; and (d) at least one protective layer.

2. The photographic material package unit according to the embodiment 1, wherein the degree of the interlayer effect from said blue-sensitive emulsion layer to said red-sensitive emulsion layer is from −0.15 to +0.20; the degree of the interlayer effect from said green-sensitive emulsion layer to said red-sensitive emulsion layer is from −0.70 to +0.10; the degree of the interlayer effect from said blue-sensitive emulsion layer to said green-sensitive emulsion layer is from −0.50 to +0.10; the degree of the interlayer effect from said red-sensitive emulsion layer to said green-sensitive emulsion layer is from −1.10 to −0.10; the degree of the interlayer effect from said green-sensitive emulsion layer to said blue-sensitive emulsion layer is from −0.45 to +0.05; and the degree of the interlayer effect from said red-sensitive layer to said blue-sensitive layer is from −0.20 to +0.35.

3. The photographic material package unit according to the embodiment 2, wherein the degree of the interlayer effect from said green-sensitive emulsion layer to said red-sensitive emulsion layer is from −0.70 to 0.00; the degree of the interlayer effect from said blue-sensitive emulsion layer to said green-sensitive emulsion layer is from −0.50 to 0.00; the degree of the interlayer effect from said green-sensitive emulsion layer to said blue-sensitive emulsion layer is from −0.45 to −0.05; the degree of the interlayer effect from said red-sensitive emulsion layer to said blue-sensitive emulsion layer is from −0.05 to +0.35.

4. The photographic material package unit according to the embodiment 1, wherein said lens is a plastic lens having a fixed focal length.

5. The photographic material packaqe unit according to the embodiment 1, wherein said shutter means is a shutter having a fixed shutter speed.

6. The photographic material package unit according to the embodiment 1, wherein said photographic material package unit further comprises an auxiliary flash unit comprising means for providing flash illumination; means for providing electric current to said means for providing flash illumination; and means for synchronizing said flash illumination with said shutter.

7. The photographic material package unit according to the embodiment 6, wherein said means for providing flash illumination is xenon-gas-filled discharge tube, said auxiliary flash unit further comprising a yellow-to-orange filter means for correcting the color of said flash illumination provided by said xenon-gas-filled discharge tube.

EXPERIMENTAL EXAMPLE

A method of evaluation of the interlayer diffusibility of development inhibitors, which may be used for selection of DIR compounds for use in the present invention from the the compounds of the aforesaid formula (I), is now described.

The following two layers were coated on a transparent support to prepare a two-layered photographic material sample (Sample B).

First Layer: Red-sensitive Silver Halide Emulsion Layer

A gelatin-containing coating liquid containing a silver iodobromide emulsion (silver iodide 5 mol %, mean grain size 0.4 μm), which had been red-sensitized with $6\times10^{-5}$ mol per mol of silver of Sensitizing Dye I as described in Example 1 below, and 0.0015 mol per mol of silver of Coupler X was coated in an amount of 1.8 g/m² as silver. The film thickness was 2 μm.

Coupler X:

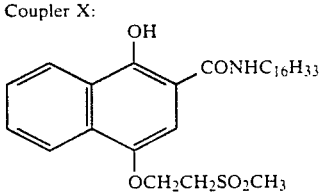

Second Layer

This was a gelatin layer containing the same silver iodobromide emulsion as used in the first layer (but not red-sensitized) and polymethyl methacrylate grains (diameter about 1.5 μm).

In addition to the above-mentioned composition, a gelatin hardening agent and a surfactant were added to each layer.

In the same manner as the preparation of Sample B, Sample A was prepared, which did not contain the silver iodobromide emulsion in the second layer.

Each of the thus prepared Samples A and B was wedgewise exposed with a red light and then processed in the same manner as in Example 1 below, whereupon the development time was 2 minutes and 10 seconds. A development inhibitor was added to the developer until the density of Sample A became ½ of the density thereof as developed with the same developer containing no development inhibitor. The degree of the decrease of the density of Sample B when developed with the development inhibitor-containing developer was measured, and the interlayer diffusibility of the development inhibitor through the silver halide emulsion film was thereby evaluated. The results obtained are shown in Table 1 below.

TABLE 1

| Development Inhibitor | Diffusibility of Development Inhibitor: Amount added in Developer (M) | Decrease (%) of Density: Sample (A) | Decrease (%) of Density: Sample (B) | Diffusibility (= B/A) |
|---|---|---|---|---|
| 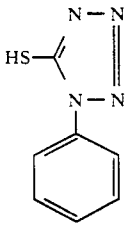 | $0.75\times10^{-4}$ | 50 | 10 | 0.2 |
| 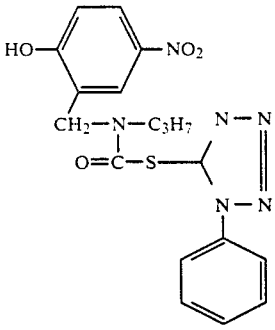 | $1\times10^{-4}$ | 50 | 25 | 0.5 |
| 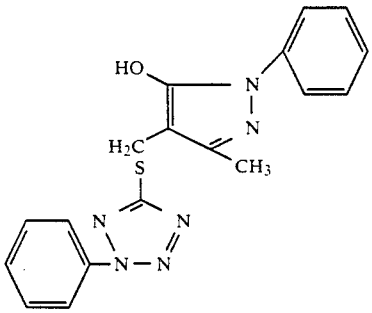 | $0.8\times10^{-4}$ | 48 | 20 | 0.42 |

TABLE 1-continued

| Development Inhibitor | Diffusibility of Development Inhibitor: Amount added in Developer (M) | Decrease (%) of Density: Sample (A) | Decrease (%) of Density: Sample (B) | Diffusibility (= B/A) |
|---|---|---|---|---|
| 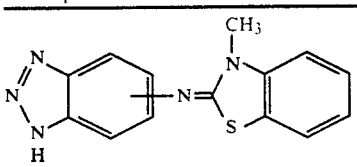 | $0.5 \times 10^{-4}$ | 50 | 15 | 0.3 |
| 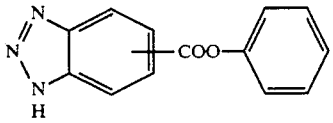 | $2 \times 10^{-4}$ | 52 | 37 | 0.74 |
| 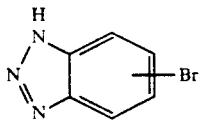 | $2.5 \times 10^{-4}$ | 51 | 45 | 0.9 |

The following specific examples are provided to illustrate the present invention in. greater detail, but are not to be construed as limiting the scope of the present invention. Unless otherwise indicated, all parts, persents and ratios are by weight.

EXAMPLE 1

The following layers were coated on a cellulose triacetate support to prepare a color photographic material sample (Sample No. 101).

The amount of silver halide coated is in units of g/m$^2$ as silver. The amount of gelatin and that of coupler-dispersing oil coated each are in units of g/m$^2$. The amount of sensitizing dye and that of coupler each are in units of mol per mol of the silver halide in the same layer.

First Layer: Antihalation Layer

| | |
|---|---|
| Black Colloidal Silver (average diameter: 0.10 μm) | 0.18 |
| Gelatin | 0.40 |

Second Layer: Gelatin-containing Interlayer

| | |
|---|---|
| Gelatin | 1.2 |

Third Layer: First Red-sensitive Emulsion Layer

| | |
|---|---|
| Silver Iodobromide Emulsion (silver iodide 5 mol %; mean grain size 0.5 μm) | 1.6 |
| Sensitizing Dye I | $3.2 \times 10^{-4}$ |
| Sensitizing Dye II | $4.4 \times 10^{-5}$ |
| Coupler C-1 | 0.09 |
| Coupler I-(10) as described above | 0.0014 |
| Coupler Y-1 | 0.0010 |
| Gelatin | 1.2 |

(Couplers C-1, I-(10) and Y-1 were dissolved in a mixed solvent of tricresyl phosphate and ethyl acetate and then blended with a gelatin solution containing sodium di-(2-ethylhexyl)-α-solfosuccinate and dispersed by emulsification by mechanical rapid stirring.)

Fourth Layer: Second Red-sensitive Emulsion Layer

| | |
|---|---|
| Silver Iodobromide Emulsion (silver iodide 8 mol %; mean grain size 0.7 μm) | 1.9 |
| Sensitizing Dye I | $1.0 \times 10^{-4}$ |
| Sensitizing Dye II | $2.0 \times 10^{-5}$ |
| Coupler C-1 | 0.036 |
| Coupler C-2 | 0.0064 |
| Gelatin | 1.3 |

(Couplers C-1 and C-2 were dispersed by emulsification in the same manner as for the preparation of the dispersion for the first red-sensitive emulsion layer.)

Fifth Layer: Interlayer (Gelatin Layer)

| | |
|---|---|
| Gelatin | 0.9 |

Sixth Layer: First Green-sensitive Emulsion Layer

| | |
|---|---|
| Silver Iodobromide Emulsion (silver iodide 5 mol %, mean grain size 0.4 μm) | 0.8 |
| Sensitizing Dye III | $2.5 \times 10^{-4}$ |
| Sensitizing Dye IV | $1.8 \times 10^{-4}$ |
| Coupler M-1 | 0.071 |
| Coupler M-2 | 0.015 |
| Coupler I-(10) | 0.009 |
| Gelatin | 0.5 |

(Couplers M-1, M-2 and I-(10) were dissolved in a mixed solvent of tricresyl phosphate, dibutyl phthalate and ethyl acetate and then blended with a gelatin solution containing sodium dodecylbenzenesulfonate and dispersed by emulsification by mechanical rapid stirring.)

Seventh Layer: Second Green-sensitive Emulsion Layer

| | |
|---|---|
| Silver Iodobromide Emulsion (silver iodide 7 mol %, | 1.6 |

-continued

| | |
|---|---|
| mean grain size 0.75 μm) | |
| Sensitizing Dye III | $1.8 \times 10^{-4}$ |
| Sensitizing Dye IV | $9.5 \times 10^{-5}$ |
| Coupler M-1 | 0.020 |
| Coupler M-2 | 0.002 |
| Gelatin | 1.8 |

(Couplers M-1 and M-2 were dispersed by emulsification in the same manner as for the preparation of the dispersion for the first green-sensitive emulsion layer.)

Eighth Layer: Yellow Filter Layer (Yellow colloidal silver (average diameter: 0.01 μm and 2,5-di-t-pentadecylhydroquinone were dispersed by emulsification in an aqueous gelatin solution and the resulting dispersion was coated to form a gelatin layer.)

| | |
|---|---|
| Gelatin | 0.9 |

Ninth Layer: First Blue-sensitive Emulsion Layer

| | |
|---|---|
| Silver Iodobromide Emulsion (silver iodide 6 mol %, mean grain size 0.6 μm) | 0.4 |
| Sensitizing Dye V | $5.5 \times 10^{-5}$ |
| Coupler Y-1 | 0.27 |
| Coupler I-(10) | 0.005 |
| Coupler C-1 | 0.007 |
| Gelatin | 1.3 |

(Couplers Y-1, I-(10) and C-1 were dissolved in a mixed solvent of tricresyl phosphate and ethyl acetate and then blended with a gelatin solution containing sodium dodecylbenzenesulfonate and dispersed by emulsification by mechanical rapid stirring.)

Tenth Layer: Second Blue-sensitive Emulsion Layer

| | |
|---|---|
| Silver Iodobromide Emulsion (silver iodide 9 mol %, mean grain size 0.85 μm) | 0.75 |
| Sensitizing Dye V | $4.0 \times 10^{-5}$ |
| Coupler Y-1 | 0.056 |
| Gelatin | 0.9 |

(Coupler Y-1 was dispersed by emulsification in the same manner as the couplers in the first blue-sensitive emulsion layer.)

Eleventh Layer: First Protective Layer (Gelatin Layer)

| | |
|---|---|
| Gelatin | 0.7 |

Twelfth Layer: Second Protective Layer

This was a gelatin layer containing silver iodobromide (silver iodide 1 mol %; mean grain size 0.07 μm) and polymethyl methacrylate grains (diameter 1.5 μm).

| | |
|---|---|
| Gelatin | 0.8 |

In addition to the above-mentioned compositions, Gelatin Hardening Agent (H-1) and a surfactant were added to each layer.

The sample thus prepared was called Sample No. 101.

The compounds used for preparation of the sample were as follows:

Sensitizing Dyes:

I

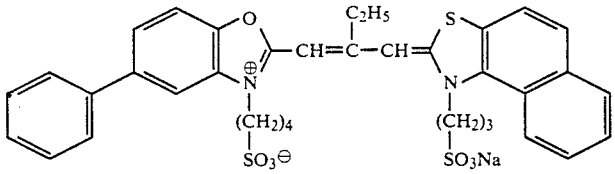

II

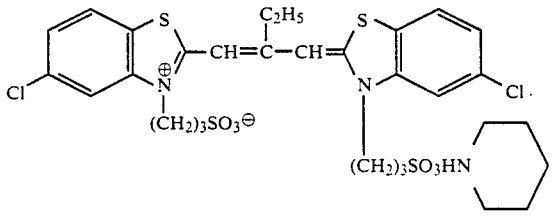

III

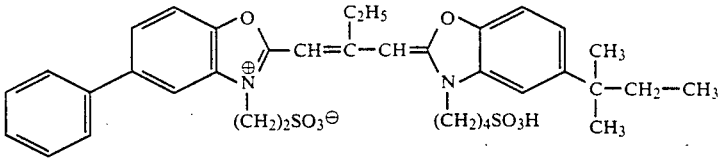

-continued
IV
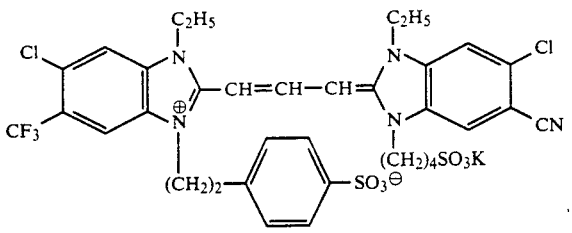
V
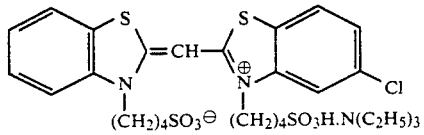
VI
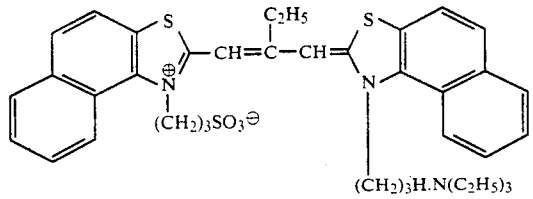
VII
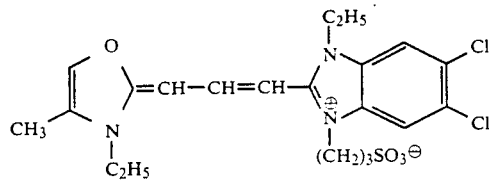
Couplers:
C-1
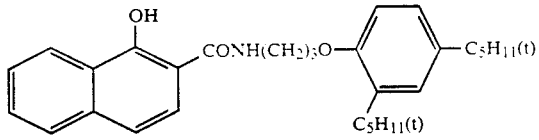
C-2
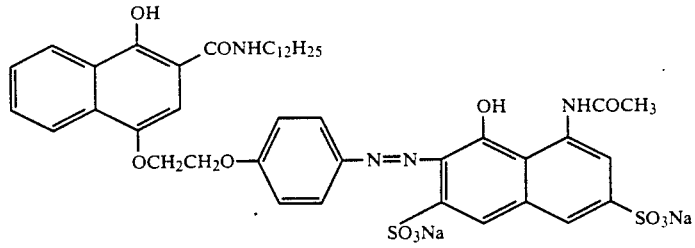
M-1
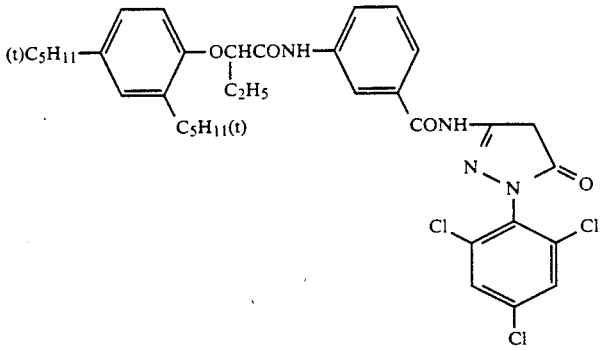

-continued

M-2

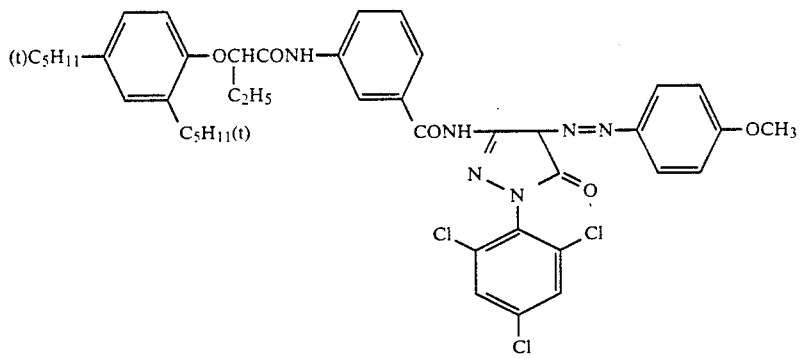

Y-1

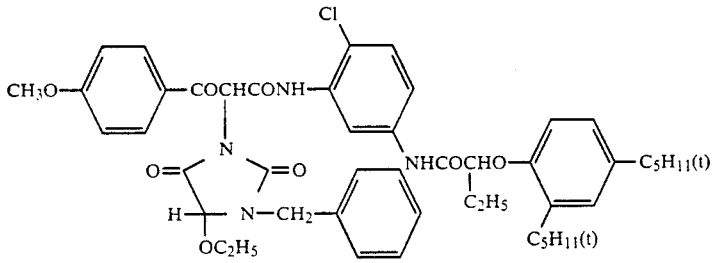

$(CH_2{=}CHSO_2CH_2CONHCH_2)_2$H-1

Preparation of Sample No. 102

Sample No. 102 was prepared in the same manner as the preparation of Sample No. 101, except for the following changes. In the third and fourth layers, Sensitizing Dye I was decreased to 0.7 times the previous amount, and Sensitizing Dye II was increased to 3 times the previous amount. In the sixth and seventh layers, Sensitizing Dye III was decreased to 0.8 times the previous amount and Sensitizing Dye IV was increased to 1.3 times the previous amount. In the ninth layer, Sensitizing Dye V was decreased to 0.8 times the previous amount and Sensitizing Dye VII was added in an amount of $1.0\times10^{-5}$ mol per mol of silver. In the tenth layer, Sensitizing Dye V was decreased to 0.8 times the previous amount and Sensitizing Dye VII was added in an amount of $8.0\times10^{-5}$ mol per mol of silver.

Preparation of Sample No. 103

Sample No. 103 was prepared in the same manner as the preparation of Sample No. 101, except for the following changes. In the third layer, Sensitizing Dye I was decreased to 0.2 times the previous amount, Sensitizing dye II was increased to 7 times the previous amount, and Sensitizing Dye VI was added in an amount of $2.1\times10^{-5}$ mol per mol of silver. In the fourth layer, Sensitizing Dye I was decreased to 0.2 times the previous amount, Sensitizing Dye II was increased to 7 times the previous amount, and Sensitizing Dye VI was added in an amount of $1.0\times10^{-5}$ mol per mol of silver.

Preparation of Sample No. 104

Sample No 104 was prepared in the same manner as the preparation of Sample No. 101, except for the following changes. In the sixth layer and seventh layer, Sensitizing Dye III was decreased to 0.4 times the previous amount and Sensitizing Dye IV was increased to 1.6 times the previous amount.

Preparation of Sample No. 105

Sample No. 105 was prepared in the same manner as the preparation of Sample No. 101 except for the following changes. In the ninth layer, Sensitizing Dye V was decreased to 0.4 times the previous amount, and Sensitizing Dye VII was added in an amount of $4.1\times10^{-5}$ mol per mol of silver. In the tenth layer, Sensitizing Dye V was decreased to 0.4 times the previous amount, and Sensitizing Dye VII was added in an amount of $3.0\times10^{-5}$ mol per mol of silver.

Preparation of Sample No. 106

Sample No. 106 was prepared in the same manner as the preparation of Sample No. 101 except for the following changes. In the third layer, Coupler I-(10) was increased to 1.5 times the previous amount, Coupler M-1 was added in an amount of 0.013 mol per mol of silver, and the amount of silver coated was increased to 1.1 times the previous amount. In the ninth layer, Coupler Y-1 was increased to 1.15 times the previous amount. In the tenth layer, Coupler Y-1 was increased to 1.1 times the previous amount.

Preparation of Sample No. 107

Sample No. 107 was prepared in the same manner as the preparation of Sample No. 101 except for the following changes. In the ninth layer, Coupler C-1 was omitted, and Coupler I-(10) was increased to 1.20 times the previous amount. In the third layer, Coupler C-1 was increased to 1.20 times the previous amount. In the fourth layer, Coupler C-1 was increased to 1.10 times the previous amount.

Preparation of Sample No. 108

Sample No. 108 was prepared in the same manner as the preparation of Sample No. 101 except for the following changes. In the ninth layer, Coupler C-1 was increased to 0.050 mol per mol of silver. In the third layer, Coupler C-1 was decreased to 0.08 mol per mol of silver. In the fourth layer, Coupler C-1 was decreased to 0.032 mol per mol of silver.

Each of the thus prepared Samples Nos. 101 through 108 was wedgewise exposed with a white light (4800° K.) and then color developed in accordance with the procedure described below. As a result, almost same sensitivity and gradation were obtained in all samples.

Figure 4:
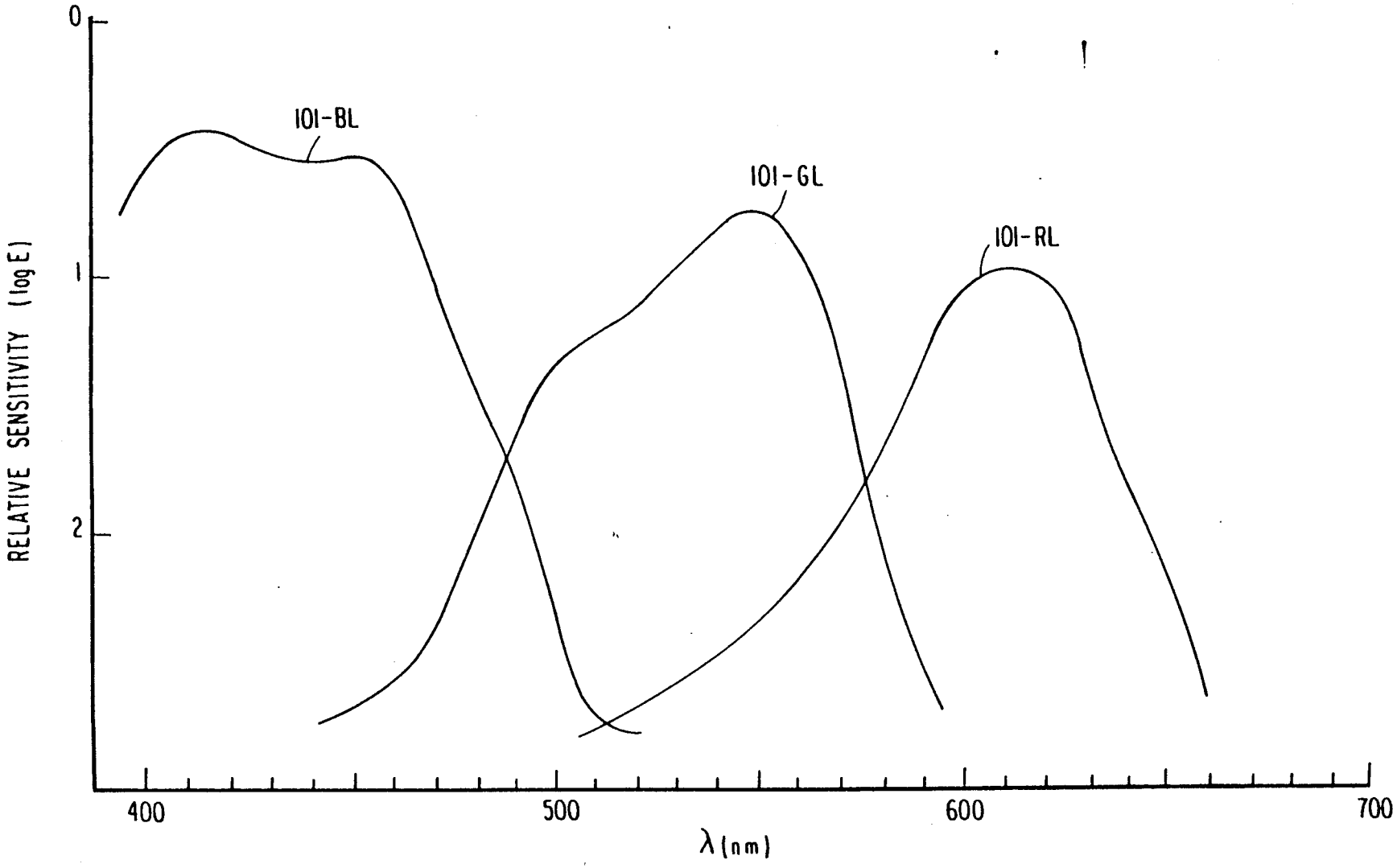
FIGS. 4 through 6, 8 and 9 each shows spectral sensitivity distribution curves of samples used in the examples and comparative examples.
Figure 5:
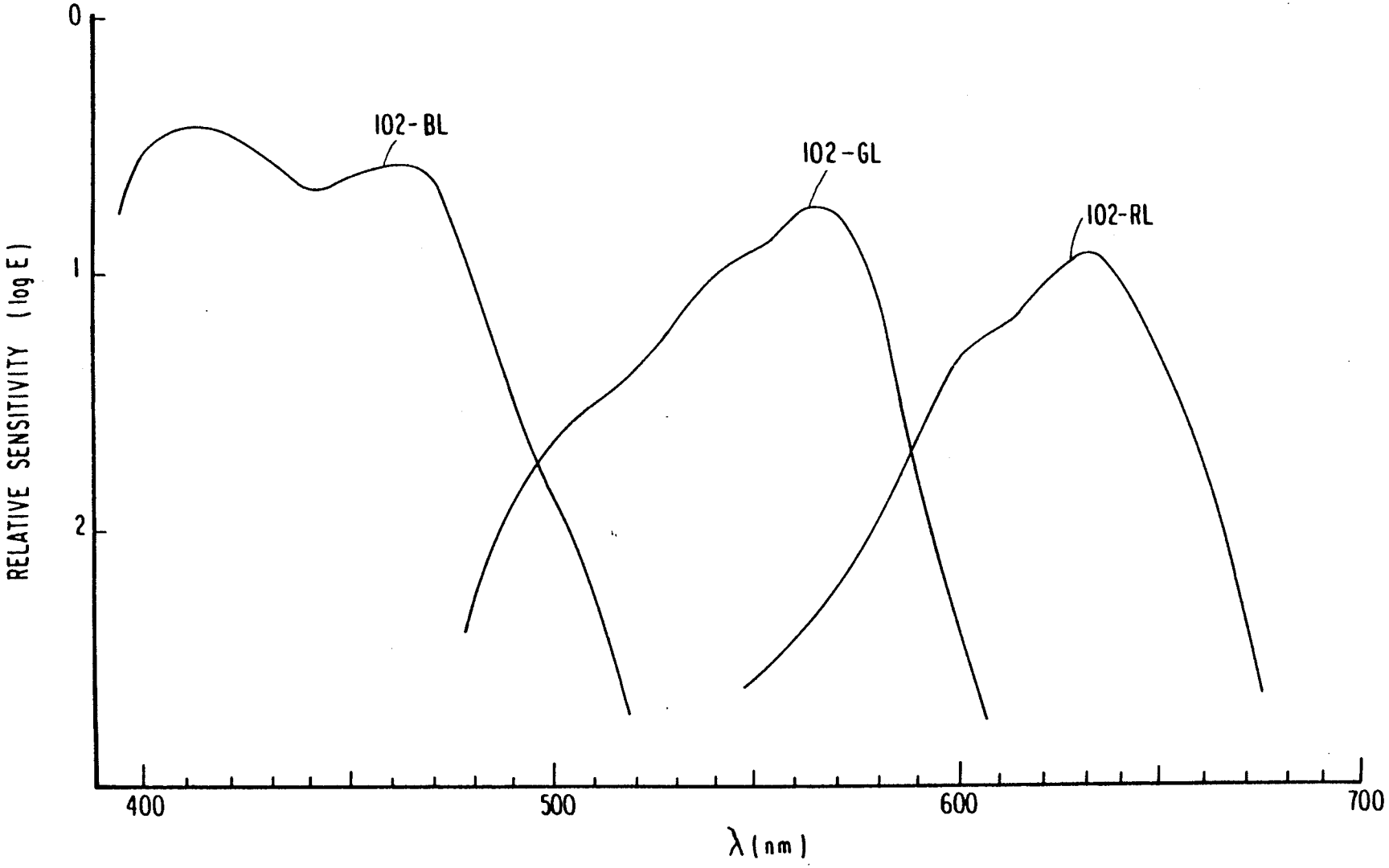
Figure 6:
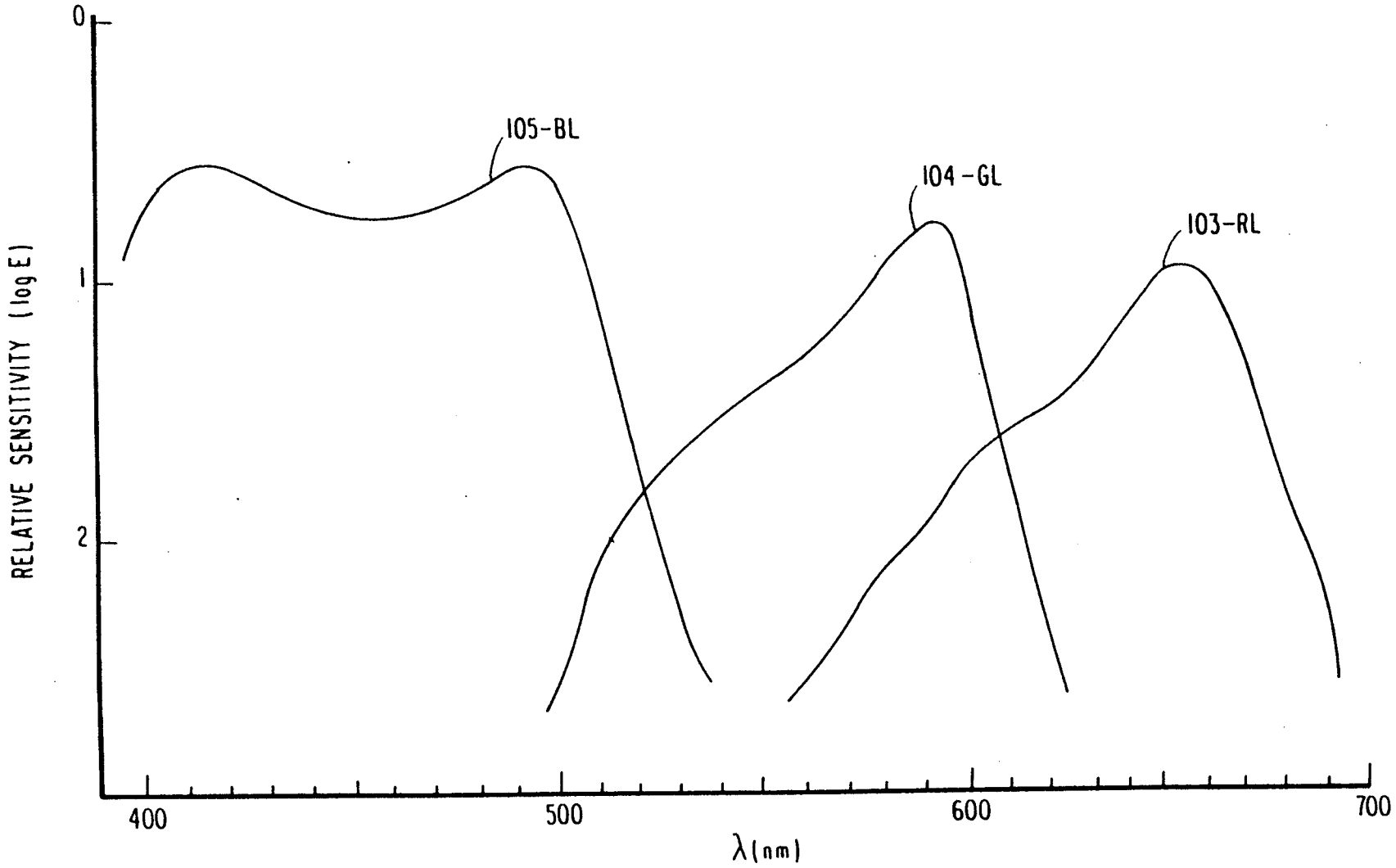

Next, the samples were exposed for evaluation of the interlayer effect, as mentioned above, and then color developed in accordance with the procedure described below. The results obtained are shown in Table 2, and the spectral sensitivity distribution is shown in FIGS. 4 through 6. (In these drawings, Log E means to represent a logarithmic axis of the exposure (E) in each wavelength range having the same energy distribution.)

In addition, the wavelength giving the maximum value ($\lambda^{max}$) and the wavelength giving 80% of the maximum value ($\lambda^{80}$) in the spectral sensitivity distribution of each light-sensitive layer in the Sample Nos. 101 to 105 are shown in Table 2 below.

TABLE 2

| | BL nm | | GL nm | | RL nm | |
|---|---|---|---|---|---|---|
| | $\lambda_B^{max}$ | $\lambda_B^{80}$ | $\lambda_G^{max}$ | $\lambda_G^{80}$ | $\lambda_R^{max}$ | $\lambda_R^{80}$ |
| Sample No. 101 (The Invention) | 412 | 402, 455 | 548 | 540, 560 | 612 | 600, 623 |
| 102 (The Invention) | 412 | 400, 428 | 567 | 556, 574 | 630 | 620, 640 |
| 103 (Comparison) | | | | | 655* | 647, 664* |
| 104 (Comparison) | | | 594* | 586, 598 | | |
| 105 (Comparison) | 493* | 477, 502* | | | | |

The value with an asterisk (*) is outside the claimed scope of the invention.

The processing procedure applied to the above-mentioned samples included the following steps.

| | |
|---|---|
| 1. Color Development | 3 min 15 sec (38° C.) |
| 2. Bleaching | 6 min 30 sec |
| 3. Rinsing in Water | 3 min 15 sec |
| 4. Fixation | 6 min 30 sec |
| 5. Rinsing in Water | 3 min 15 sec |
| 6. Stabilization | 3 min 15 sec |

The processing solutions used in the above steps had the following compositions.

| | |
|---|---|
| Color Developer: | |
| Nitrilotriacetic Acid Sodium Salt | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N-ethyl-N-β-hydroxylethylamino)-2-methyl-aniline Sulfate | 4.5 g |
| Water to make | 1 liter |
| Bleaching Solution: | |
| Ammonium Bromide | 160.0 g |
| Aqueous Ammonia (28%) | 25.0 ml |
| Ethylenediamine-tetraacetic Acid Sodium Iron Complex | 130 g |
| Glacial Acetic Acid | 14 ml |
| Water to make | 1 liter |
| Fixing Solution: | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |
| Stabilizing Solution | |
| Formalin | 8.0 ml |
| Water to make | 1.0 liter |

Figure 3:
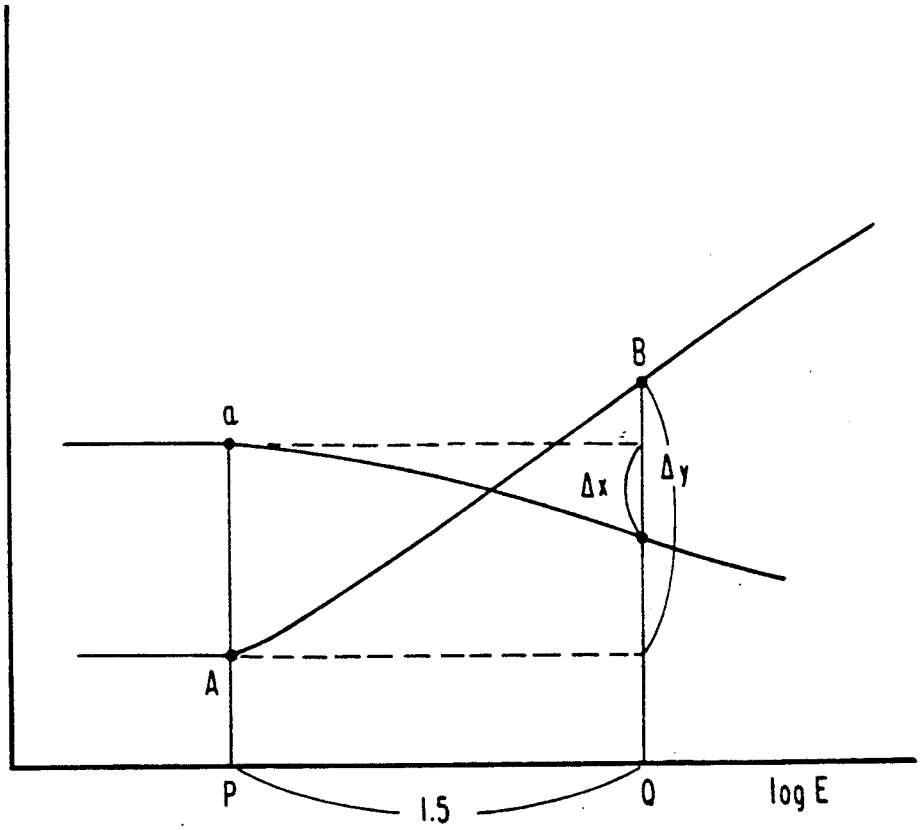
FIG. 3 shows a characteristic curve for obtaining an interlayer effect.

The red transmission density and the green transmission density of the thus processed Samples Nos. 101 through 108 were measured with a filter corresponding to the spectral sensitivity distribution of Fuji Color Paper AGL#653-258, and magenta and cyan images were obtained which had the characteristic curve shown in FIG. 3.

In FIG. 3, Δx means the degree of the interlayer effect by which the uniformly fogged cyan emulsion layer is inhibited when the green-sensitive emulsion layer is developed from the non-exposure area (A point) to the exposure area (B point). That is, in FIG. 3 the Curve A-B represents the characteristic curve on the magenta image of the green-sensitive layer, and the curve a-b represents a cyan image density of the red-sensitive layer as uniformly exposed with a red light. P represents a fogged area of the magenta image; and Q represents an exposure (P+1.5) giving the magenta image density with (fog density+Δy).

The difference between the cyan image density (a) with the exposure (P) and the cyan image density (b) with the exposure (Q) was obtained, which was represented by Δx. The conversion (Δx/Δy) of the cyan image density corresponding to the conversion of the magenta color image density was a criterion of the interlayer effect ($D_R/D_G$) from the green-sensitive layer to the red-sensitive layer. When the value Δx is negative, the interlayer inhibiting effect is great and the degree of the effect is represented by the negative value. On the contrary, if the value Δx is positive, the interlayer inhibiting effect is weak (that is, the color formed is turbid) and the degree is represented by the positive value.

In the same manner, the interlayer effect from the blue-sensitive layer to the red-sensitive layer, that from the green-sensitive layer to the blue-sensitive layer, that from the green-sensitive layer to the red-sensitive layer, that from the red-sensitive layer to the blue-sensitive layer and that from the red-sensitive layer to the green-sensitive layer were obtained in each of the Samples Nos. 101, 106, 107 and 108.

The results obtained were shown in Table 3 below.

TABLE 3

| | Sample No. 101 | Sample No. 106 | Sample No. 107 | Sample No. 108 |
|---|---|---|---|---|
| $D_B/D_R$ | +0.02 | −0.22 | +0.05 | −0.0 |
| $D_G/D_R$ | −0.35 | −0.35 | −0.32 | −0.35 |
| $D_B/D_G$ | −0.30 | −0.25 | −0.30 | −0.31 |
| $D_R/D_G$ | −0.44 | −0.45 | −0.41 | −0.45 |
| $D_G/D_B$ | −0.25 | −0.25 | −0.33 | −0.30 |
| $D_R/D_B$ | +0.10 | +0.12 | −0.22* | +0.40* |

The value with asterisk (*) is outside the claimed scope of the invention.

In the same manner as for Sample 101, the other samples were subjected to sensitometry and almost same sensitivity and gradation were obtained. The sensitivity was nearly ISO 100 in every case.

Each of Samples Nos. 101 through 108 was cut into a 135-size and introduced into the package unit shown in FIG. 1 to prepare a photographic material package unit sample. The unit had a single-lens (F value, 11), a shutter (1/100 second) and a strobe mechanism (guide value, about 10).

Using each of the thus-prepared photographic material package units with the samples Nos. 101 through 108, Macbeth Color Charts (18 kinds and Gray Charts of 4 kinds) were photographed with an object distance of about 3.6 m, with outdoor natural light in slightly cloudy weather (without strobe). In addition, the same objects were photographed with the same samples in a semi-dark room by the aid of the strobe flash. The thus exposed samples were color-developed in accordance with the processing procedure mentioned above, to obtain color negative films.

Each of the thus obtained negative films was printed on (82.5 mm×120 mm) size color printing paper (Fuji Film Super HR Color Paper) in a conventional manner, whereupon the gray color of the prints was made to correspond to each other. Thus the respective prints were obtained.

The prints obtained from the negative films as photographed in a semi-dark room without the use of strobe were quite under-exposurd, and only an image indicating the existence of the color chart could be seen extremely unclearly.

Next, the color reproducibility of each sample was tested by means of the color differentiating method described in David Eastwood, *Farbe,* Vol. 24, No. 1, pages 97 et seq., comparing the colors by visual observation. In the thus obtained 18-color U*V*W* color specification system, the difference between the chromaticity point of the original film and that of the corresponding print from the film was obtained on the basis of the mean color difference ΔEuv as defined by the following formula. This was the criterion for the evaluation by visual observation. The acceptable limit of the color gap was determined to be ΔEuv=12 (preferably 10). The results are shown in Table 4 below.

$$\Delta Euv = \frac{\sum_{i=1}^{n}}{n} [(Upi^* - Uoi^*)^2 + (Vpi^* - Voi^*)^2 + (Wpi^* - Woi^*)^2]^{\frac{1}{2}}$$

Where Upi, Vpi and Wpi each represents the value of the i'th U*, V* and W*, respectively, of the Macbeth Chart on the color print; and Uoi, Voi and Woi each represents the value of the i'th U*, V* and W* respectively, of the Macbeth Chart on the original film.

TABLE 4

| | | Evaluation of Color Gap*1 | | ΔEuv | | |
|---|---|---|---|---|---|---|
| | | With Outdoor Natural Light in Slightly Cloudy Weather | Strobe Light Source (with filter) | With Outdoor Natural Light in Slightly Cloudy Weather | Strobe Light Source (with filter) Used | Strobe Light Source (with filter) Not Used |
| Sample No. | 101 (The Invention) | ○ | ○ (◎) | 7 | 8(6) | Evaluation Impossible |
| | 102 (The Invention) | ○ | ○ (◎) | 8 | 9(7) | Evaluation Impossible |
| | 103 (Comparison) | X | X (X) | 13 | 17(16) | Evaluation Impossible |
| | 104 (Comparison) | X | X (X) | 14 | 17(16) | Evaluation Impossible |
| | 105 (Comparison) | X | X (X) | 13 | 15(14) | Evaluation Impossible |
| | 106 (The Invention) | Δ | Δ (○) | 11 | 12(10) | Evaluation Impossible |
| | 107 (The Invention) | ○ | ○ (◎) | 10 | 10(8) | Evaluation Impossible |
| | 108 (The Invention) | Δ | Δ (○) | 11 | 11(10) | Evaluation Impossible |

*1 ◎: Excellent (corresponding to ΔEuv of 6 or 7)
○: Good (corresponding to ΔEuv of each of 8 to 10)
Δ: Fair (corresponding to ΔEuv of 11 or 12)
X: Bad (corresponding to ΔEuv of each of 15 to 17)

Figure 7:
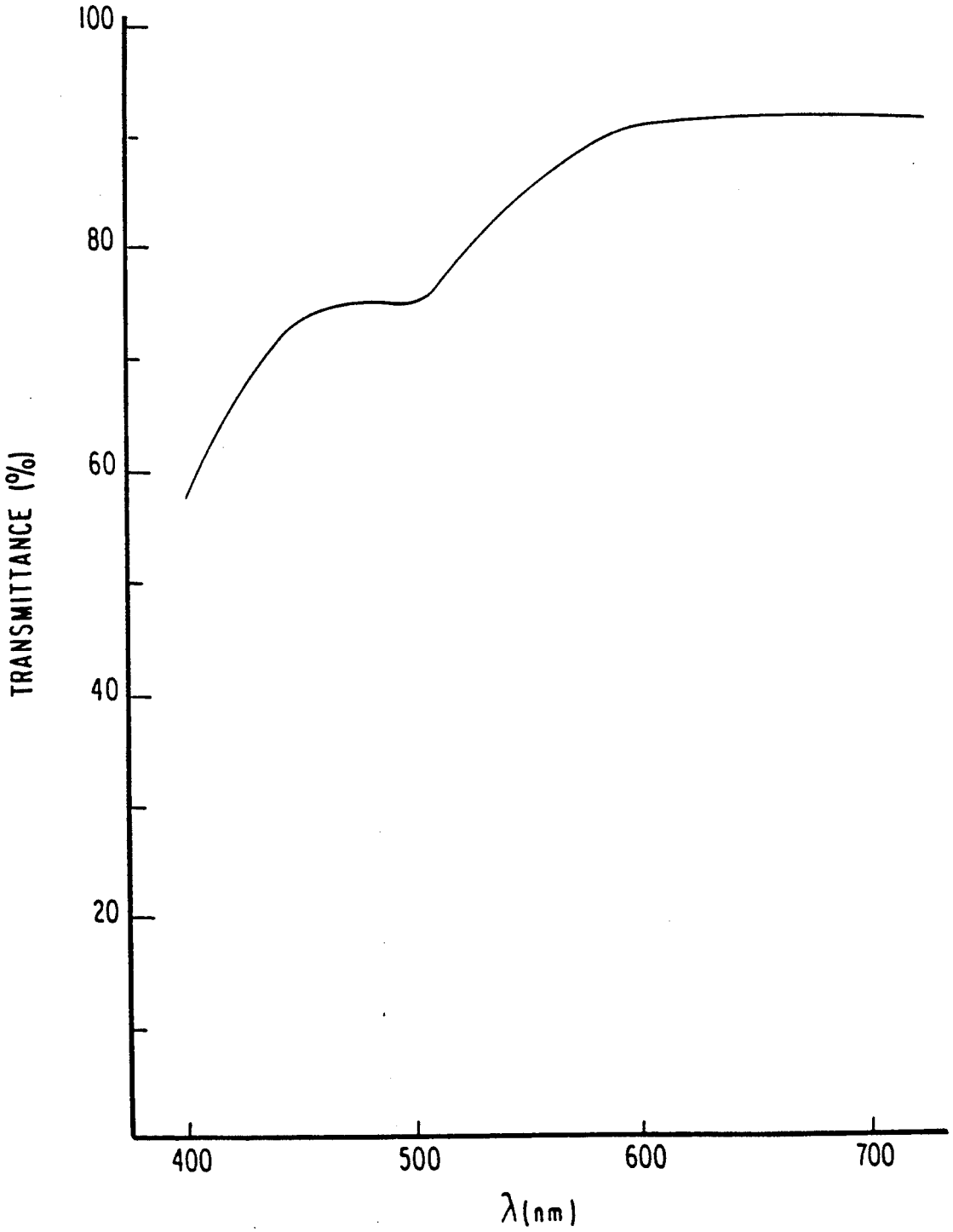
FIG. 7 shows the spectral transmittance of a filter which may be applied to the strobe.

A filter having the spectral transmittance shown in FIG. 7 (corresponding to LA A20 manufactured by Hoya Glass Co.) was provided in front of the light-emitting surface of the strobe, and the samples were photographed in the same manner. The results obtained are shown in Table 4 above, as the values parenthesized. These values parenthesized indicate that the provision of the filter was effective for correcting the color gap in color reproduction.

EXAMPLE 2

Sample No. 110 was prepared in the same manner as the preparation of Sample No. 102 in Example 1, except for the following changes. An edge-developing type tabular silver iodobromide grain-containing emulsion, where the grains had an aspect ratio of about 8, was used as the silver iodobromide emulsion in the fourth layer. Sensitizing Dye I was added to the emulsion before chemical sensitization thereof. In the sixth layer, Coupler M-1 was replaced by 0.08 g/m$^2$ of pyrazoloazole coupler V-(1), and the amount of M-2 was changed to 0.01 g/m$^2$. In the sixth layer, a corner-developing type octahedral silver iodobromide grain-containing emulsion, to which 0.8 times of Dye III had been added prior to chemical sensitization, was used as the silver iodobromide emulsion. In the seventh layer, a mixture of 0.03 g/m$^2$ of pyrazoloazole coupler (1) and 0.04 g/m$^2$ of Coupler M-1 was used in place of Coupler M-1, and the amount of Coupler M-2 was changed to 0.01 g/m². In the seventh layer, a corner-developing type tabular silver iodobromide grain-containing emulsion (where the grains had an aspect ratio of about 8 and a mean grain size of 0.9 μm), to which 0.8 times of Dye III had been added during the step of formation of the grains prior to chemical sensitization thereof, was used as the silver iodobromide emulsion. In the ninth layer, 0.007 g/m² of Coupler C-3 was used in place of Coupler C-1.

Coupler C-3:

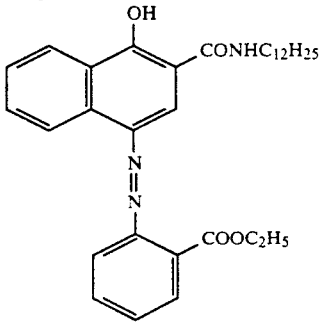

The thus-prepared Sample No. 110 was subjected to sensitometry in the same manner as in Example 1. As a result, it was found that Sample No. 110 was about 10% more sensitive than Sample No. 102. Sample No. 110 was tested in the same manner as in Example 1, and the results as shown in Table 5 below were obtained.

TABLE 5

| Sample No. | Evaluation of Color Gap | ΔEuv Natural Light | ΔEuv Auxiliary Light (with filter) |
|---|---|---|---|
| 102 | ○ | 8 | 9 (8) |
| 110 | ○ | 6 | 8 (7) |

Figure 8:
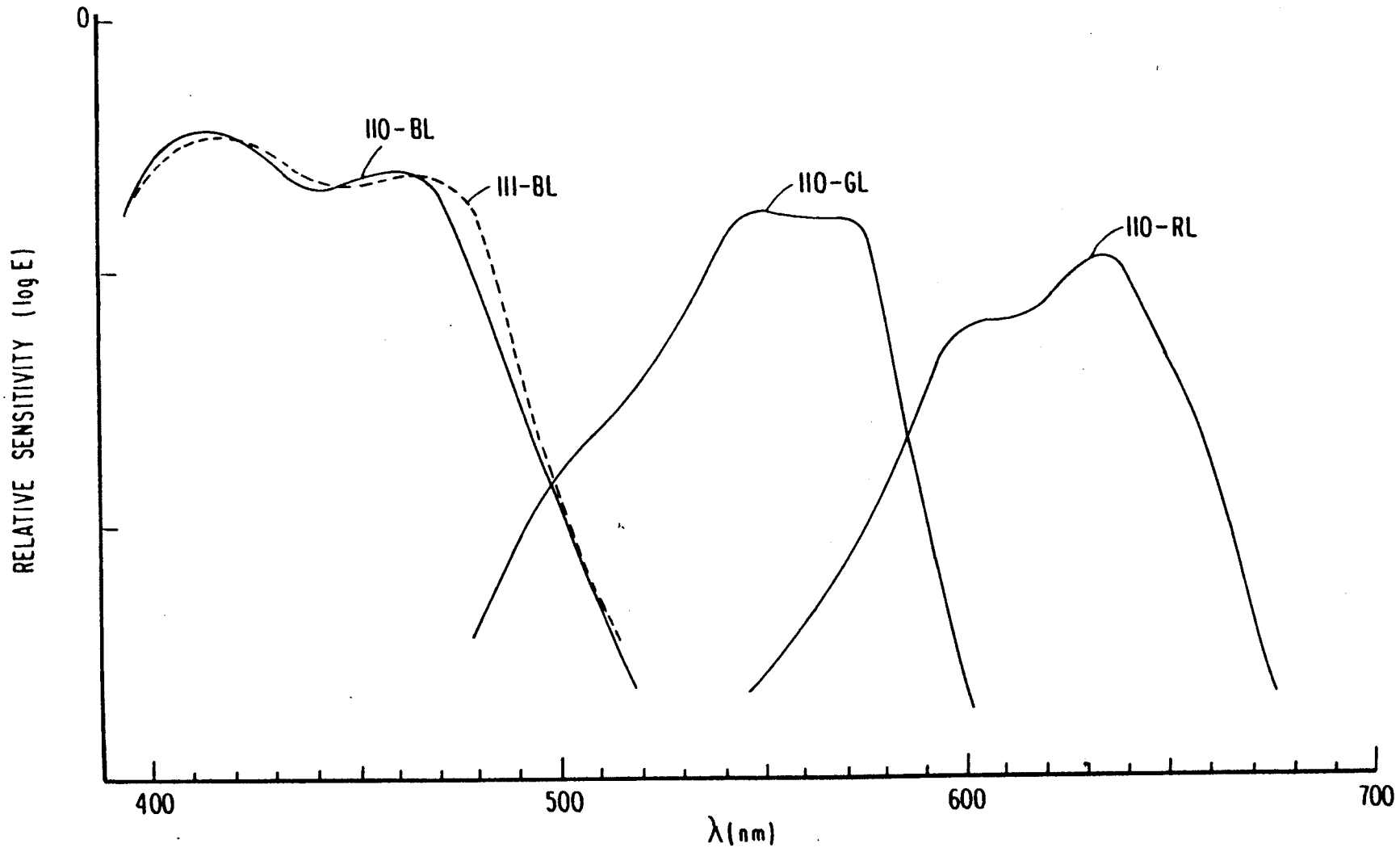

The spectral sensitivity distribution of Sample No. 110 is shown in FIG. 8.

In Sample No. 110, the following Sensitizing Dye VIII or IX was used in place of Sensitizing Dye V, and the same results were obtained.

Sensitizing Dye VIII:

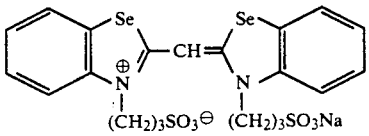

Sensitizing Dye IX:

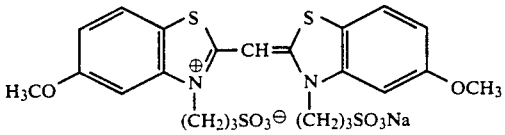

Sample No. 111 was prepared in the same manner as the preparation of Sample No. 110 except that Sensitizing Dye VIII was used. The spectral sensitivity distribution of BL of Sample No. 111 is shown in FIG. 8 (dot line).

The values of $\lambda^{max}$ and $\lambda^{80}$ of each of these samples are shown in Table 6 below.

TABLE 6

| Sample No. | Bl nm $\lambda_B^{max}$ | Bl nm $\lambda_B^{80}$ | GL nm $\lambda_G^{max}$ | GL nm $\lambda_G^{80}$ | RL nm $\lambda_R^{max}$ | RL nm $\lambda_R^{80}$ |
|---|---|---|---|---|---|---|
| 102 | 412 | 400 428 | 567 | 556 574 | 630 | 620 640 |
| 110 | 414 | 402 428 | 550 | 540 576 | 635 | 623 642 |
| 111 | 416 | 402 487 | | | | |

EXAMPLE 3

The following layers were coated on cellulose triacetate film support with a subbing layer to prepare a multi-layer color photographic material sample (Sample No. 112).

In the composition of each layer, the amount of the respective component is in units of g/m². The silver halide content is the weight of silver coated. The amount of the sensitizing dye coated is in units of mol per mol of the silver halide in the same layer.

Structure of Sample No. 112

First Layer: Anti-halation Layer

| | |
|---|---|
| Black Colloidal Silver (average diameter: 0.10 μm) | 0.18 |
| Gelatin | 0.40 |

Second Layer: Interlayer

| | |
|---|---|
| 2,5-Di-t-pentadecylhydroquinone | 0.18 |
| M-2 as described in Example 1 | 0.07 |
| C-2 as described in Example 1 | 0.02 |
| Dye XVI | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |

Third Layer: First Red-sensitive Emulsion Layer

| | |
|---|---|
| Monodisperse Silver Iodobromide Emulsion (silver iodide 6 mol %, mean grain size 0.6 μm; fluctuation coefficient on grain size 0.15) | 0.55 |
| Sensitizing Dye II as described in Example 1 | $3.1 \times 10^{-4}$ |
| Sensitizing Dye VI as described in Example 1 | $0.8 \times 10^{-5}$ |
| Sensitizing Dye X | $7.9 \times 10^{-5}$ |
| Sensitizing Dye XI | $4.0 \times 10^{-5}$ |
| C-4 | 0.350 |
| HBS-1 | 0.005 |
| I-(12) as described above | 0.020 |
| Gelatin | 1.20 |

Fourth Layer: Second Red-sensitive Emulsion Layer

| | |
|---|---|
| Tabular Silver Iodobromide Emulsion (silver iodide 10 mol %; mean grain size 0.7 μm; mean aspect ratio 5.5; mean thickness 0.2 μm) | 1.0 |
| Sensitizing Dye II | $2.3 \times 10^{-4}$ |
| Sensitizing Dye VI | $0.6 \times 10^{-5}$ |
| Sensitizing Dye X | $5.9 \times 10^{-5}$ |
| Sensitizing Dye XI | $3.0 \times 10^{-5}$ |
| C-4 | 0.400 |
| C-2 | 0.050 |
| I-(12) | 0.015 |

-continued

| | |
|---|---|
| Gelatin | 1.30 |

Fifth Layer: Third Red-sensitive Emulsion Layer

| | |
|---|---|
| Silver Iodobromide Emulsion (silver iodide 16 mol %, mean grain size 1.1 μm) | 1.60 |
| Sensitizing Dye I as described in Example 1 | $6.2 \times 10^{-5}$ |
| Sensitizing Dye II | $2.4 \times 10^{-4}$ |
| Sensitizing Dye VI | $0.6 \times 10^{-5}$ |
| Sensitizing Dye XI | $3.1 \times 10^{-5}$ |
| C-2 | 0.240 |
| C-5 | 0.120 |
| HBS-1 | 0.22 |
| HBS-2 | 0.10 |
| Gelatin | 1.63 |

Sixth Layer: Interlayer

| | |
|---|---|
| EX-1 | 0.040 |
| HBS-1 | 0.020 |
| Sensitizing Dye XVI | 0.004 |
| Gelatin | 0.80 |

Seventh Layer: First Green-sensitive Emulsion Layer

| | |
|---|---|
| Tabular Silver Iodobromide Emulsion (silver iodide 6 mol %, mean grain size 0.6 μm; mean aspect ratio 6.0; mean thickness 0.15 μm) | 0.40 |
| Sensitizing Dye XII | $3.0 \times 10^{-5}$ |
| Sensitizing Dye XIII | $1.0 \times 10^{-4}$ |
| Sensitizing Dye XIV | $3.8 \times 10^{-4}$ |
| M-2 | 0.021 |
| M-3 | 0.260 |
| M-4 | 0.030 |
| I-(12) | 0.025 |
| HBS-1 | 0.100 |
| HBS-4 | 0.010 |
| Gelatin | 0.75 |

Eighth Layer: Second Green-sensitive Emulsion Layer

| | |
|---|---|
| Monodisperse Silver Iodobromide Emulsion (silver iodide 9 mol %; mean grain size 0.7 μm; fluctuation coefficient of grain size 0.18) | 0.80 |
| Sensitizing Dye XII | $2.1 \times 10^{-5}$ |
| Sensitizing Dye XIII | $7.0 \times 10^{-5}$ |
| Sensitizing Dye XIV | $2.6 \times 10^{-4}$ |
| I-(10) | 0.010 |
| M-2 | 0.008 |
| M-3 | 0.180 |
| M-4 | 0.012 |
| HBS-1 | 0.160 |
| HBS-4 | 0.008 |
| Gelatin | 1.10 |

Ninth Layer: Third Green-sensitive Emulsion Layer

| | |
|---|---|
| Silver Iodobromide Emulsion (silver iodide 12 mol %; mean grain size 1.0 μm) | 1.2 |
| Sensitizing Dye XII | $3.5 \times 10^{-5}$ |
| Sensitizing Dye XIII | $8.0 \times 10^{-5}$ |
| Sensitizing Dye XIV | $3.0 \times 10^{-4}$ |
| M-1 | 0.030 |
| M-2 | 0.025 |
| M-3 | 0.065 |

-continued

| | |
|---|---|
| HBS-1 | 0.25 |
| HBS-2 | 0.10 |
| Gelatin | 1.74 |

Tenth Layer: Yellow Filter Layer

| | |
|---|---|
| Yellow Colloidal Silver (average diameter: 0.01 μm) | 0.05 |
| EX-1 | 0.08 |
| HBS-3 | 0.03 |
| Gelatin | 0.95 |

Eleventh Layer: First Blue-sensitive Emulsion Layer

| | |
|---|---|
| Tabular Silver Iodobromide Emulsion (silver iodide 6 mol %, mean grain size 0.6 μm; mean aspect ratio 5.7; mean thickness 0.15 μm) | 0.24 |
| Sensitizing Dye XV | $3.5 \times 10^{-4}$ |
| Y-2 | 0.85 |
| I-(10) | 0.12 |
| HBS-1 | 0.28 |
| Gelatin | 1.28 |

Twelfth Layer: Second Blue-sensitive Emulsion Layer

| | |
|---|---|
| Monodisperse Silver Iodobromide Emulsion (silver iodide 10 mol %; mean grain size 0.8 μm fluctuation coefficient of grain size 0.16) | 0.45 |
| Sensitizing Dye XV | $2.1 \times 10^{-4}$ |
| Y-2 | 0.20 |
| I-(12) | 0.015 |
| HBS-1 | 0.03 |
| Gelatin | 0.46 |

Thirteenth Layer: Third Blue-sensitive Emulsion Layer

| | |
|---|---|
| Silver Iodobromide Emulsion (silver iodide emulsion 14 mol %, mean grain size 1.3 μm) | 0.77 |
| Sensitizing Dye XV | $2.2 \times 10^{-4}$ |
| Y-2 | 0.20 |
| HBS-1 | 0.07 |
| Gelatin | 0.69 |

Fourteenth Layer: First Protective Layer

| | |
|---|---|
| Silver Iodobromide Emulsion (silver iodide 1 mol %, mean grain size 0.07 μm) | 0.5 |
| U-4 | 0.11 |
| U-5 | 0.17 |
| HBS-1 | 0.90 |
| Gelatin | 1.00 |

Fifteenth Layer: Second Protective Layer

| | |
|---|---|
| Polymethyl Methacrylate Grains (diameter about 1.5 μm) | 0.54 |
| S-1 | 0.15 |
| S-2 | 0.05 |
| Gelatin | 0.72 |

In addition to the above-mentioned compositions, Gelatine Hardening Agent (H-1) and a surfactant were added to each layer.
The compounds used in the layers were as follows.
Sensitizing Dyes:
X
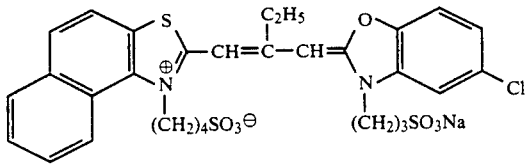
XI
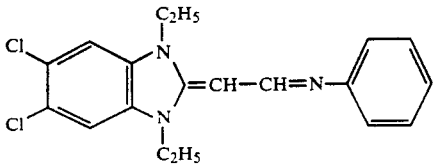
XII
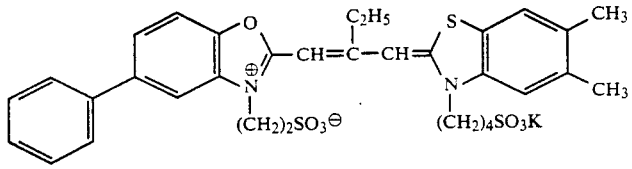
XIII
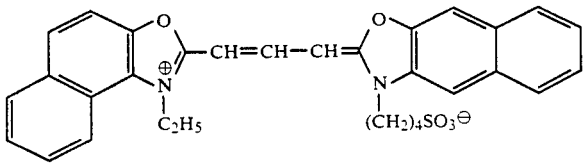
XIV
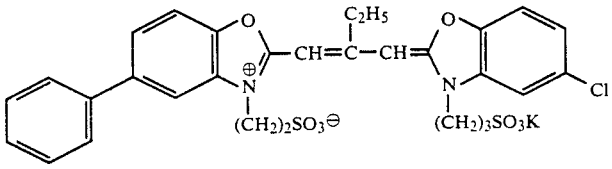
XV
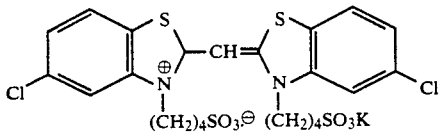
XVI
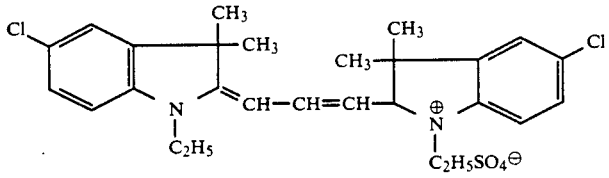
C-4
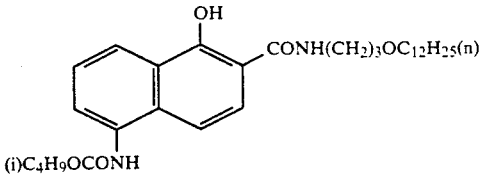

-continued
C-5
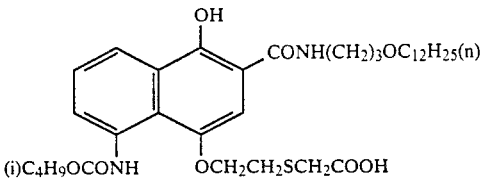
M-3
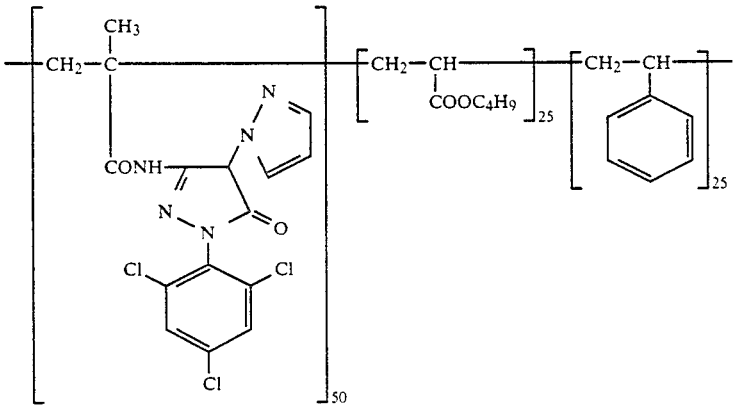
(mean molecular weight 30,000)
M-4
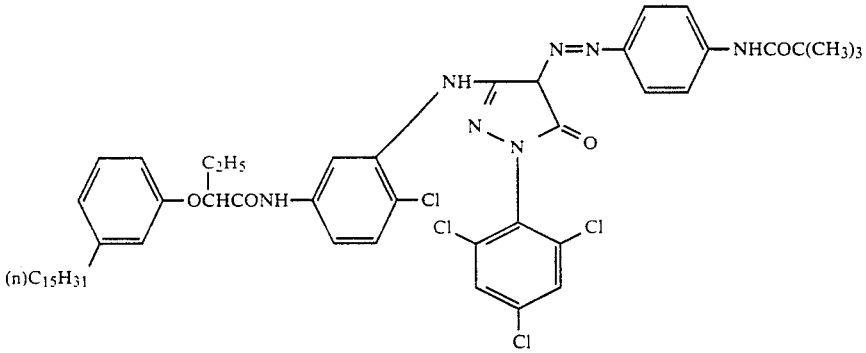
Y-2
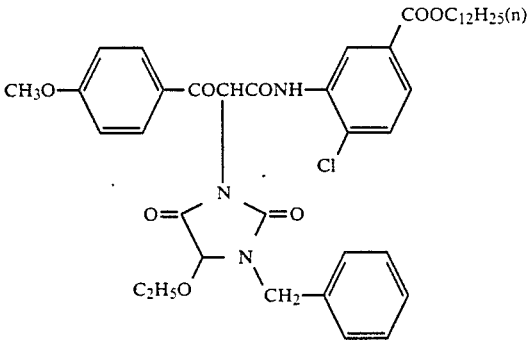
EX-1
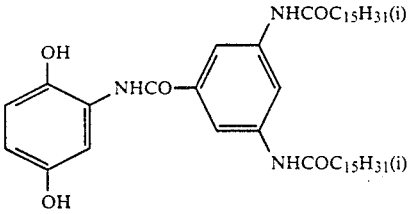

-continued
S-1
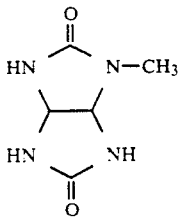
S-2
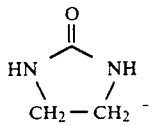
Tricresyl Phosphate HBS-1
Dibutyl Phthalate HBS-2
Bis(2-ethylhexyl) Phthalate HBS-3
HBS-4
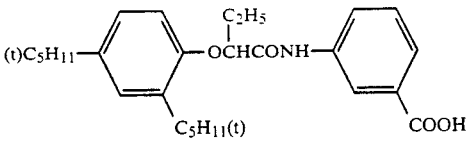
U-1
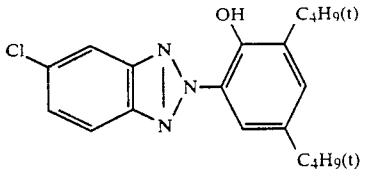
U-2
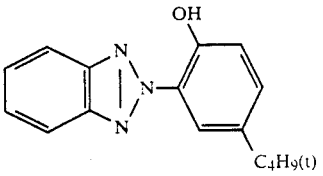
U-3
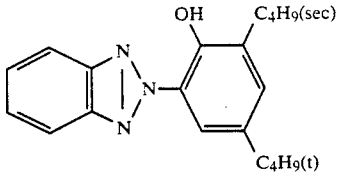
U-4
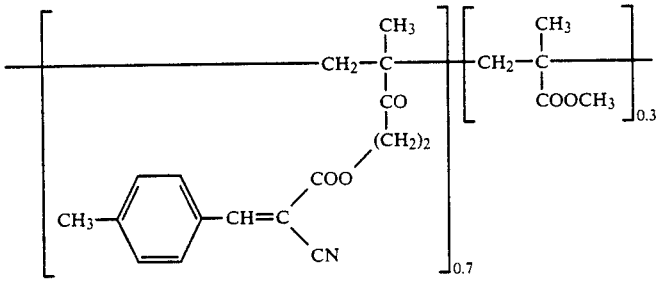
(molecular weight: 25,000)
U-5
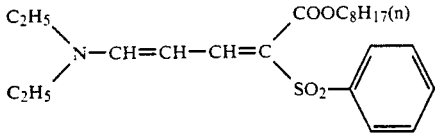

The thus prepared Sample No. 112 was cut into 135-size and put in the package unit shown in FIG. 1 to prepare a film-with-lens unit.

Figure 9:
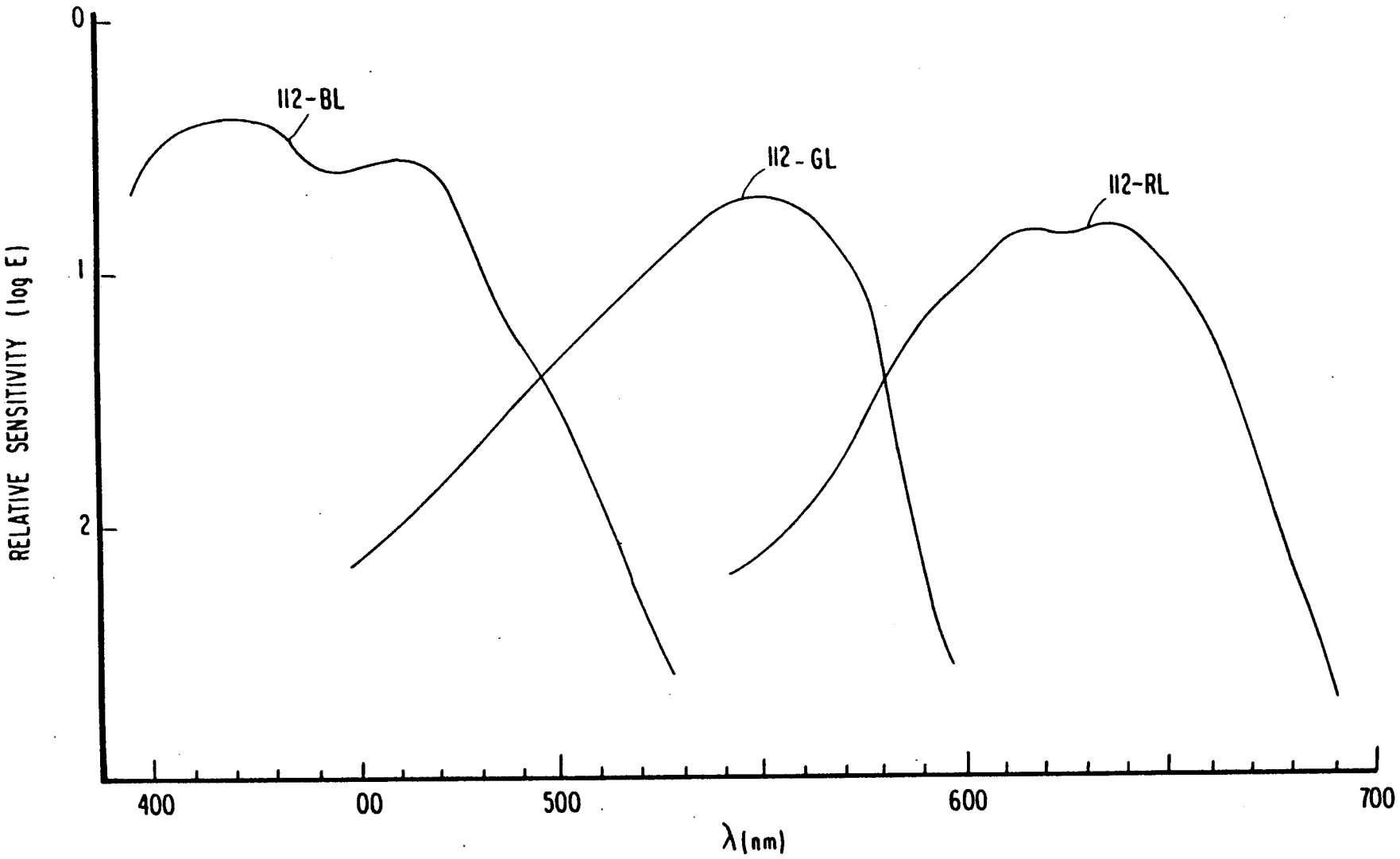

The unit was wedgewise exposed with a light source having the color temperature of 4,800° K. and then subjected to development processing shown in Example 1 for sensitometery. The sensitivity of Sample No. 112 was measured to be about ISO 400. The spectral sensitivity distribution S(λ) of the respective light-sensitive layers of Sample No. 102 are shown in FIG. 9. The values of $\lambda^{mas}$ and $\lambda^{80}$ of each layer and the degree of the interlayer effect between the respective layers are shown in Table 7 and Table 8 below.

TABLE 7

| | BL | | GL | | RL | |
|---|---|---|---|---|---|---|
| | $\lambda_B^{max}$ | $\lambda_B^{80}$ | $\lambda_G^{max}$ | $\lambda_G^{80}$ | $\lambda_R^{max}$ | $\lambda_R^{80}$ |
| Sample No. 112 | 420 | 402, 437 | 550 | 535, 564 | 635 | 611, 647 |

TABLE 8

| | $D_B/D_R$ | $D_G/D_R$ | $D_B/D_G$ | $D_R/D_G$ | $D_G/D_B$ | $D_R/D_B$ |
|---|---|---|---|---|---|---|
| Sample No. 112 | +0.06 | −0.14 | −0.12 | −0.20 | −0.18 | −0.14 |

Using the film-with-lens unit which had Sample No. 112 incorporated therein, persons and plants (including chrysanthemum flowers and white rose flowers) were photographed with an object distance of about 3.6 m, under outdoor direct natural sunlight, outdoor sunlight shielded and indoors with no direct sunlight, by a combination of auxiliary flash lighting and the surrounding natural light. Then the thus-photographed films were developed to obtain color negative films.

The thus obtained color negative films were printed on printing papers (Super HR Color Paper manufactured by Fuji Photo Film Co., Ltd. 82.5 mm×120 mm) to obtain color photographs. All of them were found to have an uniform color image quality by visual observation. The same objects were photographed with a commercial Utsurundesu-Hi (manufactured by Fuji Photo Film Co.) under the same conditions (without using flash lighting) for comparison. The photographs obtained by photographing indoor were found to be of underexposure by 1.5 apertures or so, and these photographs did not have good chroma and gradation.

As described in detail in the above description, the present invention provides a photographic material package unit providing good color reproducibility. In particular, the film package unit of the present invention may be used for photographing anywhere indoors and outdoors, and the exposed film package unit can be brought into a developing shop. Using the film package unit of the present invention, a excellent photograph can be obtained visually having a uniform and natural color image.

While the invention has been described in detail and with reference to specific embodiments thereof, it will be apparent to one skilled in the art that various changes and modifications can be made therein without departing from the spirit and scope thereof.

What is claimed is:

1. A photographic material package unit having a built-in photographic material, which is composed of a yellow coupler-containing blue-sensitive emulsion layer (BL), a magenta coupler-containing green-sensitive emulsion layer (GL) and cyan coupler-containing red-sensitive emulsion layer (RL) and additionally a protective layer as provided on a support, and having an exposing function, characterized in that the spectral sensitivity distribution (S(λ)) of the respective light-sensitive layers of the photographic material satisfies the following conditions (A) through (C):

(A) in BL, the wavelength ($\lambda_B^{max}$) of imparting the maximum value of the S(λ) falls within a wavelength range of from 406 nm to 480 nm, and the wavelength ($\lambda_B^{80}$) of imparting 80% of the maximum value of the S(λ) falls within a wavelength range of from 400 nm to 500 nm;

(B) in GL, the wavelength ($\lambda_G^{max}$) of imparting the maximum value of the S(λ) falls within a wavelength range of from 527 nm to 580 nm, and the wavelength ($\lambda_G^{max}$) of imparting 80% of the maximum value of the S(λ) falls within a wavelength range of from 500 nm to 600 nm; and (C) in RL, the wavelength ($\lambda_R^{max}$) of imparting the maximum value of the S(λ) falls within a wavelength range of from 595 nm to 640 nm, the wavelength ($\lambda_R^{80}$) of imparting 80% of the maximum value of the S(λ) falls within a wavelength range of from 575 to 650 nm and the value $\lambda_R^{80}$ which is in the longest wavelength range among the wavelength ($\lambda_R^{80}$) of imparting 80% of the maximum value of the spectral sensitivity distribution S(λ) is within a wavelength range of from 610 nm to 650 nm and the value $\lambda_R^{80}$ which is in the shortest wavelength range among the said wavelength ($\lambda_R^{80}$) if imparting 80% of the maximum value of the spectral sensitivity distribution S(λ) is within a wavelength range of from 575 nm to 610 nm.

2. A photographic material package unit as in claim 1, wherein in the blue-sensitive layer (BL) in the photographic material the value $\lambda_B^{80}$ which is in the longenst wavelength range among the wavelength $\lambda_B^{80}$ of imparting 80% of the maximum value of the spectral sensitivity distribution S(λ) is within a wavelength raange of from 455 nm to 500 nm.

3. A photographic material package unit as in claim 1, which further has a built-in auxiliary lighting function for flash emission as associated with synchrosignal by shutter operation.

4. A photographic material package unit as in claim 3, wherein the auxiliary lighting function is further provided with an optical filter having a higher spectral transmittance at 595 to 640 nm than the spectral transmittance at 406 to 408 nm.

5. A photographic material package unit as in claim 1, wherein the degree of the interlayer effect between the respective light-sensitive layers of the photographic material satisfies the following conditions (a) to (f).

(a) $-0.15 \leqq D_B/D_R \leqq +0.20$ (b) $-0.70 \leqq D_G/D_R \leqq +0.10$ (c) $-0.50 \leqq D_B/D_G \leqq +0.10$ (d) $-1.10 \leqq D_R/D_G \leqq -0.10$ (e) $-0.45 \leqq D_G/D_B \leqq +0.05$ (f) $-0.20 \leqq D_R/D_B \leqq +0.35$ where $D_B/D_R$ means the degree of the interlayer effect from RL to BL; $D_G/D_R$ means the degree of the interlayer effect from RL to GL; $D_B/D_G$ means the degree of the interlayer effect from GL to BL; $D_R/D_G$ means the degree of the interlayer effect from GL to RL; $D_G/D_B$ means the degree of the interlayer effect from BL to GL; and $D_R/D_B$ means the degree of the interlayer effect from BL to RL.

6. A photographic material package unit as in claim 5, wherein the photographic material contains a compound represented by formula (I) so as to impart the interlayer effect to the material.

$$A-(L_1)_a-Z_1 \qquad (I)$$

where A represents a group capable of releasing $-(L_1)_a-Z_1$ by reaction with the oxidation product of a color developing agent; $L_1$ represents a timing group; $Z_1$ represents an active group having a development-inhibiting function; and a is 0 or 1.

7. A photographic material package unit as in claim 1, wherein a light-sensitive silver halide emulsion to be used in at least one layer of BL, GL and RL contains silver halide grains as controlled so that these may be developed from the edge or corner of the grains or from the site near edge or corner thereof in an amount of at least 50% by number of the total silver halide grains in the emulsion, when processed with a color developer after exposure.

8. A photographic material package unit as in claim 1, wherein the photographic material contains a sensitizing dye selected from the compounds represented by formulae (II), (III) and (IV):

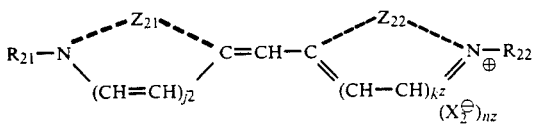

(II)

where $Z_{21}$ and $Z_{22}$, which may be the same or different, each represents an atomic group necessary for forming a substituted or unsubstituted heterocyclic group selected from benzothiazole, naphthothiazole, benzoselenazole, naphthoselenazole, benzoxazole, naphthoxazole, benzimidazole, naphthimidazole, indolenine, benzindolenine, indole and quinoline; which may optionally be substituted; $R_{21}$ and $R_{22}$, which may be the same or different, each represents an alkyl group, an alkenyl group, an alkinyl group or an aralkyl group, provided that at least one of $R_{21}$ and $R_{22}$ is substituted with at least one sulfonic acid group, carboxyl group or hydroxyl group; $j_2$ and $k_2$ each is 0 or 1; $n_2$ is 0 or 1, provided that when $n_2$ is 0, the compound forms an internal salt; and $X_2\ominus$ represents an acid anion necessary for charge balance;

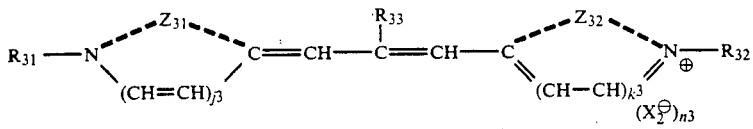

(III)

where $Z_{31}$ represents an atomic group necessary for forming a substituted or unsubstituted heterocyclic group selected from benzimidaozle, benzoxazole, naphthoimidazole and naphthoxazole; $Z_{32}$ represents an atomic gruop necessary for forming a substituted or unsubstituted heterocyclic group selected from benzimidazole, naphthoimidazole, benzoxazole, naphthoxazole, benzothiazole and benzoselenazole; $R_{31}$ have the same definition as $R_{21}$ in formula (II); $R_{32}$ has the same definition as $R_{22}$ in formula (II); $R_{33}$ represents hydrogen, a lower alkyl group or an aralkyl group; $j_3$ and $k_3$ each is 0 or 1; $n_3$ has the same meaning as $n_2$ in formula (II); and $X_3\ominus$ represents an acid anion necessary for charge balance;

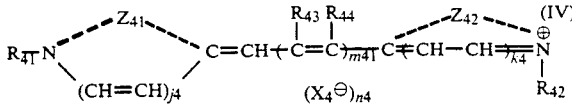

(IV)

where $Z_{41}$ and $Z_{42}$, which may be the same or different, each represents an atomic group necessary for forming a substituted or unsubstituted 5-membered or 6-membered heterocyclic ring, or a substituted or unsubstituted 5-membered or 6-membered heterocyclic ring condensed with another ring; $R_{41}$ and $R_{42}$, which may be the same or different, each represents an alkenyl group, an alkinyl group, an aralkyl group, an unsubstituted alkyl group or alkyl group substituted with a halogen atom, a cyano group, an aryloxy group, a substituted or unsubstituted amino group, a carboxylic acid group, a sulfonic acid group or a hydroxyl group; $m_{41}$ is an integer of 1, 2 or 3; when $m_{41}$ is 1, $R_{43}$ represents hydrogen, a lower alkyl group, an aralkyl group or an aryl group, and $R_{44}$ represents hydrogen; when $m_{41}$ is 2 or 3, $R_{43}$ represents hydrogen, and $R_{44}$ represents hydrogen, a lower alkyl group or an aralkyl group; plural $R_{43}$ groups may be linked to form a ring; $j_4$ and $k_4$ each is 0 or 1; $n_4$ is 0 or 1; and $X_4\ominus$ represents an acid anion necessary for charge balance.

9. A photographic material package unit as in claim 1, wherein the photographic material contains a pyrazoloazole magenta coupler represented by formula (V):

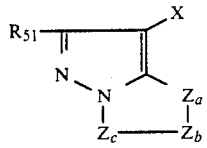

(V)

where $R_{51}$ represents hydrogen or a substituted or unsubstituted alkyl group, a substituted or unsubstituted branched alkyl group, substituted or unsubstituted alkoxy group, an aryloxy group, or a ureido group; X represents hydrogen or a group capable of being released by coupling reaction with the oxidaiton product of an aromatic primary amine color developing agent; Za, Zb and Zc, which may be the same or different, each represents a methine group, a substituted methine group, =N— or —NH—, provided that one of the Za-Zb bond and the Zb-Zc bond is a double bond and the other is a single bond.

* * * * *